US010118400B2

(12) United States Patent
Igarashi et al.

(10) Patent No.: US 10,118,400 B2
(45) Date of Patent: Nov. 6, 2018

(54) LIQUID EJECTION SYSTEM

(71) Applicant: SEIKO EPSON CORPORATION, Tokyo (JP)

(72) Inventors: Hitoshi Igarashi, Shiojiri (JP); Kazuhisa Kawakami, Matsumoto (JP); Katsumi Yamada, Matsumoto (JP); Yasuhiro Taguchi, Shimosuwa-machi (JP); Eiko Yanagida, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/355,128

(22) Filed: Nov. 18, 2016

(65) Prior Publication Data

US 2017/0144446 A1 May 25, 2017

(30) Foreign Application Priority Data

Nov. 20, 2015 (JP) ..... 2015-227376

(51) Int. Cl.
*B41J 2/175* (2006.01)
*B41J 29/02* (2006.01)
*B41J 29/13* (2006.01)

(52) U.S. Cl.
CPC ..... *B41J 2/17553* (2013.01); *B41J 2/1752* (2013.01); *B41J 2/17509* (2013.01); *B41J 2/17566* (2013.01); *B41J 29/02* (2013.01); *B41J 29/13* (2013.01)

(58) Field of Classification Search
CPC ..... B41J 2/17553
See application file for complete search history.

(56) References Cited

U.S. PATENT DOCUMENTS 6,286,932 B1 * 9/2001 Hirano ..... B41J 2/17553 347/43
9,302,516 B2 4/2016 Osakabe et al.
2001/0035897 A1 * 11/2001 Hayashi ..... B41J 2/17513 347/65
2003/0079795 A1 * 5/2003 Allison ..... B41J 2/17509 141/2
2007/0247496 A1 * 10/2007 Sekiguchi ..... B41J 2/17513 347/84

(Continued)

FOREIGN PATENT DOCUMENTS

JP 11-032188 A 2/1999
JP 2000-211161 A 8/2000

(Continued)

*Primary Examiner* — Shelby Fidler
(74) *Attorney, Agent, or Firm* — Foley & Lardner LLP

(57) ABSTRACT

A liquid ejection system of this invention includes a mechanism unit that can change the relative position of a medium relative to a liquid ejection head capable of ejecting a liquid, and a liquid storage container having a liquid storage portion capable of storing the liquid that is to be supplied to the liquid ejection head. A liquid injection portion that enables injection of the liquid into the liquid storage portion is provided in the liquid storage container. In an orientation in which the liquid injection portion faces a direction upward relative to the horizontal direction, in a plan view of the mechanism unit from vertically above, at least a portion of the liquid storage container excluding the liquid injection portion is overlapped with the region of the mechanism unit.

10 Claims, 47 Drawing Sheets

(56) References Cited

U.S. PATENT DOCUMENTS

| | | | | |
|---|---|---|---|---|
| 2013/0169720 | A1* | 7/2013 | Nakamura | B41J 2/175 347/86 |
| 2014/0043408 | A1* | 2/2014 | Kudo | B41J 2/175 347/86 |
| 2015/0103121 | A1* | 4/2015 | Ito | B41J 2/17509 347/86 |
| 2015/0109386 | A1 | 4/2015 | Koike et al. | |
| 2015/0130879 | A1* | 5/2015 | Kimura | B41J 2/17506 347/85 |
| 2015/0210081 | A1 | 7/2015 | Suzuki et al. | |

FOREIGN PATENT DOCUMENTS

| | | | |
|---|---|---|---|
| JP | 2015-080907 | A | 4/2015 |
| JP | 2015-093428 | A | 5/2015 |
| JP | 2015-163462 | A | 9/2015 |
| JP | 2015-199264 | A | 11/2015 |

* cited by examiner

LIQUID EJECTION SYSTEM

BACKGROUND

Priority is claimed under 35 U.S.C. § 119 to Japanese Applications No. 2015-227376 filed on Nov. 20, 2015 which is hereby incorporated by reference in their entirety.

1. Technical Field

The present invention relates to a liquid ejection system and the like.

2. Related Art

Inkjet printers have been known as examples of a liquid ejection device. With an inkjet printer, printing can be performed on a printing medium such as a printing sheet by discharging ink, which is one example of a liquid, from an ejection head. Such an inkjet printer has been known to have a configuration in which ink stored in a tank, which is one example of a liquid storage container, is supplied to the ejection head. (For example, see JP-A-2015-80907). Note that in the following, the expression "liquid ejection system" is sometimes used to refer to a configuration in which a liquid storage container such as a tank has been added to a liquid ejection device such as an inkjet printer.

JP-A-2015-80907 is an example of related art.

The liquid ejection system described in JP-A-2015-80907 has an issue in that when the volume of the liquid storage container increases, the liquid ejection system tends to become larger.

SUMMARY

The invention can solve at least the above-described issues, and can be realized in the following aspects or application examples.

Application Example 1

A liquid ejection system according to an aspect of the invention is a liquid ejection system capable of ejecting a liquid toward a targeted medium, the liquid ejection system including: a mechanism unit that includes a liquid ejection head capable of ejecting the liquid, and that can change a relative position of the medium relative to the liquid ejection head; and a liquid storage container having a liquid storage portion capable of storing the liquid that is to be supplied to the liquid ejection head, wherein a liquid injection portion that enables injection of the liquid into the liquid storage portion is provided in the liquid storage container, and in an orientation in which the liquid injection portion faces a direction upward relative to a horizontal direction, in a plan view of the mechanism unit from vertically above, at least a portion of the liquid storage container excluding the liquid injection portion is overlapped with a region of the mechanism unit.

According to this liquid ejection system, an increase in the projected area (footprint) of the mechanism unit and the liquid storage container in a plan view is readily mitigated. Accordingly, an increase in the size of the liquid ejection system is readily mitigated.

Application Example 2

It is preferable that in the above liquid ejection system, the portion of the liquid storage container that is overlapped with the mechanism unit is located vertically below the mechanism unit.

According to this liquid ejection system, the portion of the liquid storage container that is overlapped with the region of the mechanism unit is located vertically below the mechanism unit, and therefore an increase in the projected area of the mechanism unit and the liquid storage container in a plan view is readily mitigated.

Application Example 3

It is preferable that the above liquid ejection system further includes an air introduction portion that is in communication with the liquid storage portion and is capable of introducing air into the liquid storage portion. Also, in the orientation in which the liquid injection portion faces a direction upward relative to the horizontal direction, in a plan view of the mechanism unit from vertically above, at least a portion of the air introduction portion is overlapped with a region of the mechanism unit.

According to this liquid ejection system, an increase in the projected area of the mechanism unit and the air introduction portion in a plan view is readily mitigated. Accordingly, an increase in the size of the liquid ejection system is readily mitigated.

Application Example 4

It is preferable that in the above liquid ejection system further includes an air introduction portion that is in communication with the liquid storage portion and is capable of introducing air into the liquid storage portion. Also, in the orientation in which the liquid injection portion faces a direction upward relative to the horizontal direction, in a plan view of the mechanism unit from vertically above, at least a portion of the air introduction portion is overlapped with a region of the mechanism unit, and the portion of the air introduction portion that is overlapped with the region of the mechanism unit is located vertically above the mechanism unit.

According to this liquid ejection system, the portion of the air introduction portion that is overlapped with the region of the mechanism unit is located vertically above the mechanism unit, and therefore an increase in the projected area of the mechanism unit and the air introduction portion in a plan view is readily mitigated.

Application Example 5

It is preferable that in the above liquid ejection system, a volume of the air introduction portion is equivalent to a volume of the liquid storage portion, or is greater than the volume of the liquid storage portion.

According to this liquid ejection system, the air introduction portion has a volume capable of receiving and storing the liquid in the liquid storage portion. For this reason, even if the liquid in the liquid storage portion flows into the air introduction portion for example, the flowing liquid can be stored in the air introduction portion, thus readily avoiding the leakage of liquid from the liquid storage portion to the outside of the liquid storage container via the air introduction portion.

Application Example 6

It is preferable that in the above liquid ejection system, the air introduction portion is configured to be able to be separated from the liquid storage container.

According to this liquid ejection system, the air introduction portion is constituted so as to be able to be separated from the liquid storage container. In other words, the liquid storage container and the air introduction portion are constituted as separate bodies. According to this configuration, it is possible to add an air introduction portion to the liquid storage container or extend the air introduction portion.

Application Example 7

It is preferable that in the above liquid ejection system, the air introduction portion and the liquid storage container are connected by a connection portion.

According to this liquid ejection system, a connection between the air introduction portion and the liquid storage container is achieved via the connection portion.

Application Example 8

It is preferable that in the above liquid ejection system, the connection portion is a tube.

According to this liquid ejection system, a connection between the air introduction portion and the liquid storage container is achieved via the tube.

Application Example 9

It is preferable that in the above liquid ejection system, the connection portion is located outside of a path along which relative positions of the liquid ejection head and the medium change.

According to this liquid ejection system, it is possible to avoid the case where the connection portion hinders change in the relative positions of the liquid ejection head and the medium.

Application Example 10

It is preferable that in the above liquid ejection system, the connection portion is located outside of the mechanism unit.

According to this liquid ejection system, it is possible to avoid the case where the connection portion obstructs operation of the mechanism unit.

Application Example 11

It is preferable that the above liquid ejection system further includes a scanner unit capable of reading an image. Also, in the orientation in which the liquid injection portion faces a direction upward relative to the horizontal direction, the scanner unit is located vertically above the mechanism unit, and is arranged at a position that is overlapped with the mechanism unit in a plan view of the mechanism unit from vertically above, and in the orientation in which the liquid injection portion faces a direction upward relative to the horizontal direction, the portion of the air introduction portion that is overlapped with the region of the mechanism unit is located vertically below the scanner unit.

According to this liquid ejection system, an increase in the projected area of the scanner unit, the air introduction portion, and the mechanism unit in a plan view is readily mitigated. Accordingly, an increase in the size of the liquid ejection system is readily mitigated.

Application Example 12

It is preferable that the above liquid ejection system further includes a scanner unit capable of reading an image. Also, in the orientation in which the liquid injection portion faces a direction upward relative to the horizontal direction, the scanner unit is located vertically above the mechanism unit, and is arranged at a position that is overlapped with the mechanism unit in a plan view of the mechanism unit from vertically above, and in the orientation in which the liquid injection portion faces a direction upward relative to the horizontal direction, the portion of the air introduction portion that is overlapped with the region of the mechanism unit is located to one side of the scanner unit.

According to this liquid ejection system, an increase in the projected area of the scanner unit and the mechanism unit in a plan view is readily mitigated. Also, the portion of the air introduction portion that is overlapped with the region of the mechanism unit is located to one side of the scanner unit, and therefore an increase in the thickness of the liquid ejection system is readily mitigated. Accordingly, an increase in the size of the liquid ejection system is readily mitigated.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
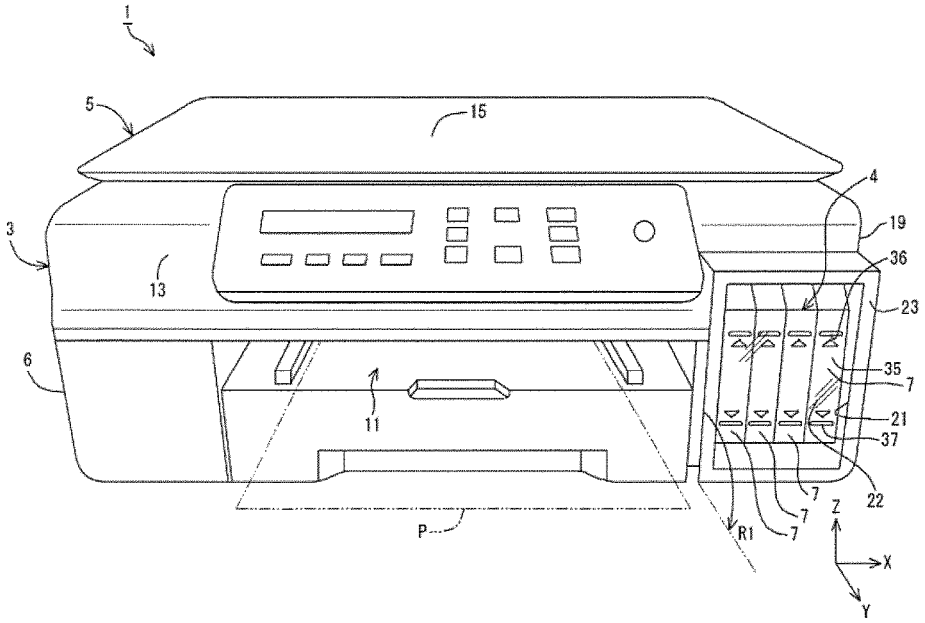
FIG. 1 is a perspective view of a relevant configuration of a liquid ejection system according to a first embodiment.

Embodiments of the invention will be described below with reference to the drawings by way of example of a liquid ejection system that includes an inkjet printer (referred to hereinafter as a printer), which is one example of a liquid ejection device. Note that the various configurations in the drawings are shown at recognizable sizes, and therefore the configurations and members are not necessarily drawn to scale.

First Embodiment

As shown in FIG. 1, a liquid ejection system 1 of this embodiment has a printer 3 as one example of a liquid ejection device, an ink supply apparatus 4 as one example of a liquid supply apparatus, and a scanner unit 5. The printer 3 has a casing 6. The casing 6 constitutes the outer shell of the printer 3. Also, in the liquid ejection system 1, the ink supply apparatus 4 is stored inside the casing 6. The ink supply apparatus 4 has a tank 7 as one example of a liquid storage container. The ink supply apparatus 4 has multiple (two, or more than two) tanks 7. Note that in this embodiment, four tanks 7 are provided.

The casing 6 and the scanner unit 5 constitute the outer shell of the liquid ejection system 1. Note that the liquid ejection system 1 can also have a configuration that omits the scanner unit 5. The tank 7 is one example of a liquid storage container. The liquid ejection system 1 can perform printing on a recording medium P such as a recording sheet using ink as one example of a liquid.

FIG. 1 includes X, Y, and Z axes that are mutually orthogonal coordinate axes. The X, Y, and Z axes are included as necessary in the other figures referenced below as well. In such cases, the X, Y, and Z axes in these figures correspond to the X, Y, and Z axes in FIG. 1. FIG. 1 shows a state in which the liquid ejection system 1 is arranged on an XY plane defined by the X axis and the Y axis. In this embodiment, a state in which the XY plane matches the horizontal plane and the liquid ejection system 1 is arranged on the XY plane is the in-use state of the liquid ejection system 1. The orientation of the liquid ejection system 1 when the liquid ejection system 1 is arranged on the XY plane that matches the horizontal plane will be referred to as the in-use orientation of the liquid ejection system 1.

The terms "X axis", "Y axis", and "Z axis" used to indicate constituent parts and units of the liquid ejection system 1 in the figures and descriptions given below refer to the X axis, the Y axis, and the Z axis in a state in which the constituent parts and units have been incorporated (mounted) in the liquid ejection system 1. Also, the orientations of the constituent parts and units in the in-use orientation of the liquid ejection system 1 will be referred to as the in-use orientations of the constituent parts and units. Moreover, the descriptions of the liquid ejection system 1, the constituent parts and units thereof, and the like given below are assumed to be descriptions in the in-use orientations thereof unless particularly stated otherwise.

The Z axis is the axis that is orthogonal to the XY plane. In the in-use state of the liquid ejection system 1, the Z axis direction is the vertically upward direction. Also, in the in-use state of the liquid ejection system 1, the −Z axis direction is the vertically downward direction in FIG. 1. Note that the directions of the arrows on the X, Y, and Z axes indicate + (positive) directions, and the directions opposite to the arrow directions indicate – (negative) directions. Note that the four tanks 7 mentioned above are arranged side-by-side along the X axis. For this reason, the X axis direction can also be defined as the direction along which the four tanks 7 are aligned.

Figure 2:
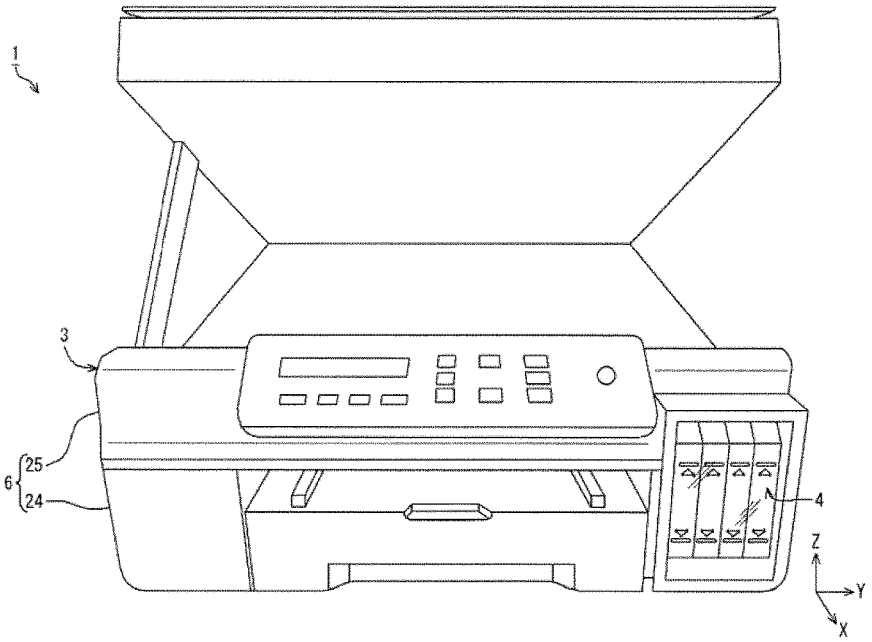
FIG. 2 is a perspective view of the relevant configuration of the liquid ejection system according to the first embodiment.

In the liquid ejection system 1, the printer 3 and the scanner unit 5 are overlapped with each other. When the printer 3 is used, the scanner unit 5 is located vertically above the printer 3. The scanner unit 5 is a flatbed type of scanner unit, and has an imaging device (not shown) such as an image sensor. The scanner unit 5 can read images and the like recorded on a medium such as a sheet, as image data via the imaging device. For this reason, the scanner unit 5 functions as a reading apparatus for reading images and the like. The scanner unit 5 is configured to be capable of pivoting relative to the printer 3. The scanner unit 5 also functions as a cover for the printer 3. As shown in FIG. 2, an operator can pivot the scanner unit 5 relative to the printer 3 by lifting the scanner unit 5 in the Z axis direction. Accordingly, the scanner unit 5 that functions as a cover for the printer 3 can be opened relative to the printer 3.

As shown in FIG. 1, the printer 3 is provided with a sheet discharge portion 11. A recording medium P is discharged from the sheet discharge portion 11 of the printer 3. The surface of the printer 3 on which the sheet discharge portion 11 is provided is considered to be a front surface 13 of the printer 3. The liquid ejection system 1 also has an upper surface 15 that intersects the front surface 13, and a side portion 19 that intersects the front surface 13 and the upper surface 15. The ink supply apparatus 4 is provided on the side portion 19 side of the printer 3. The casing 6 is provided with a window portion 21. The window portion 21 is provided in the front surface 13 of the casing 6.

The window portion 21 has translucency. Also, the tank 7 is provided at a position that is overlapped with the window portion 21. For this reason, the operator who is using the liquid ejection system 1 can view the tank 7 through the window portion 21. In this embodiment, the window portion 21 is provided as an opening formed in the casing 6. Also, the window portion 21 provided as an opening is blocked with a member 22 that has translucency. For this reason, the operator can view the tank 7 through the window portion 21, which is an opening. Note that it is also possible to employ a configuration that omits the member 22 that blocks the window portion 21. Even if the member 22 that blocks the window portion 21 is omitted, the operator can view the tank 7 through the window portion 21, which is an opening.

In this embodiment, at least a portion of the section of the tank 7 that faces the window portion 21 has translucency. The ink in the tank 7 can be viewed through the section of the tank 7 that has translucency. Accordingly, by viewing the four tanks 7 through the window portion 21, the operator can view the amount of ink in the tanks 7. In other words, at least a portion of the section of the tank 7 that faces the window portion 21 can be utilized as a viewing portion that allows viewing of the amount of ink.

The casing 6 has a cover 23. The cover 23 is configured to be able to pivot in an R1 direction in the figure relative to the casing 6. The cover 23 is provided on the front surface 13 of the printer 3. In a view of the printer 3 in the –Y axis direction, the cover 23 is provided at a position that is overlapped with the tank 7 on the front surface 13 of the printer 3. When the cover 23 is pivoted in the R1 direction in the figure relative to the casing 6, the cover 23 is opened relative to the casing 6. By opening the cover 23 relative to the casing 6, the operator can access the liquid injection portions (described later) of the tank 7 from outside the casing 6.

Also, as shown in FIG. 2, the casing 6 includes a first casing 24 and a second casing 25. The first casing 24 and the second casing 25 are overlapped with each other along the Z axis. The first casing 24 is located on the –Z axis direction side of the second casing 25. The tank 7, a mechanism unit (described later), and the like are stored between the first casing 24 and the second casing 25. In other words, the tank 7 and the mechanism unit are covered by the casing 6. For this reason, the tank 7 and the mechanism unit can be protected by the casing 6.

Figure 3:
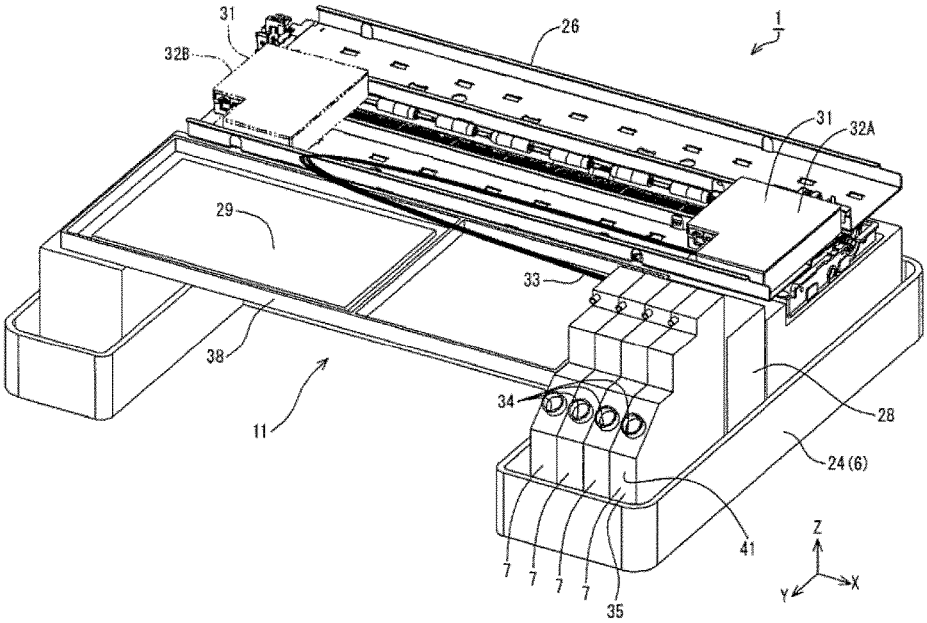
FIG. 3 is a perspective view of the relevant configuration of the liquid ejection system according to the first embodiment.

When the scanner unit 5 and the second casing 25 are detached from the liquid ejection system 1, the tank 7, a mechanism unit 26, and the like are exposed, as shown in FIG. 3. Besides the tank 7 and the mechanism unit 26, a waste liquid absorbing unit 28, an electrical wiring board 29, and the like are also arranged inside the casing 6. The waste liquid absorbing unit 28 includes an absorbing material that is capable of absorbing ink discharged from a recording portion 31 of the mechanism unit 26. A control circuit, which is for controlling the driving of the liquid ejection system 1, electrical components, electronic components, and the like are mounted on the electrical wiring board 29. The control circuit, electrical components, electronic components, and the like are electrically wired to each other on the electrical wiring board 29. The electrical wiring board 29 has the functionality of a control unit that controls the driving of the liquid ejection system 1.

The mechanism unit 26 has a recording portion 31. The mechanism unit 26 also has a conveying apparatus (not shown) that conveys the recording medium P in the Y axis direction, a moving apparatus (not shown) that moves the recording portion 31 back and forth along the X axis, and the like. Due to the moving apparatus, the recording portion 31 can move back and forth along the X axis between a first standby position 32A and a second standby position 32B. In this embodiment, the region between the first standby position 32A and the second standby position 32B is the movable region of the recording portion 31. In the printer 3, the recording portion 31 is covered by the casing 6. Accordingly, the recording portion 31 can be protected by the casing 6.

Ink in the tank 7 is supplied to the recording portion 31 via ink supply tubes 33. The recording portion 31 is provided with a recording head (not shown), which is one example of a liquid ejection head. Nozzle openings (not shown) that face the recording medium P are formed in the recording head. Ink supplied from the tank 7 to the recording portion 31 via the ink supply tubes 33 is supplied to the recording head. The ink supplied to the recording portion 31 is then discharged as ink droplets from the nozzle openings of the recording head toward the recording medium P. Note that although the printer 3 and the ink supply apparatus 4 are described as individual configurations in the above example, the ink supply apparatus 4 can also be included in the configuration of the printer 3.

A maintenance apparatus (not shown) for maintaining the properties of the recording head is provided at a location that faces the recording head of the recording portion 31 at the first standby position 32A. The maintenance apparatus includes a suction apparatus that can suction ink from the recording head. Ink suctioned from the recording head by the suction apparatus is absorbed by and held by the absorbing material of the waste liquid absorbing unit 28. The waste liquid absorbing unit 28 has a function for holding ink discharged from the recording head as waste liquid.

In the liquid ejection system 1 having the above-described configuration, recording is performed on the recording medium P by causing the recording head of the recording portion 31 to discharge ink droplets at predetermined positions on the recording medium P while conveying the recording medium P in the Y axis direction as well as moving the recording portion 31 back and forth along the X axis. Note that in this embodiment, the ink supply apparatus 4 has multiple (four) tanks 7. However, the number of tanks 7 is not limited to four, and the number of tanks that are employed can be three, a number lower than three, or a number greater than four.

Here, the term "direction along the X axis" is not limited to a direction that is completely parallel with the X axis, and also encompasses directions that are inclined relative to the X axis by a margin of error, a tolerance, or the like, while excluding a direction that is orthogonal to the X axis. Similarly, the term "direction along the Y axis" is not limited to a direction that is completely parallel with the Y axis, and also encompasses directions that are inclined relative to the Y axis by a margin of error, a tolerance, or the like, while excluding a direction that is orthogonal to the Y axis. The term "direction along the Z axis" is not limited to a direction that is completely parallel with the Z axis, and also encompasses directions that are inclined relative to the Z axis by a margin of error, a tolerance, or the like, while excluding a direction that is orthogonal to the Z axis. In other words, directions along any axis or plane are not limited to directions that are completely parallel to such axes or planes, and also encompass directions that are inclined relative to such axes or planes by a margin of error, a tolerance, or the like, while excluding directions that are orthogonal to such axes or planes.

The ink is not limited to being either water-based ink or oil-based ink. Also, water-based ink may have a configuration in which a solute such as a dye is dissolved in an aqueous solvent, or may have a configuration in which a dispersoid such as a pigment is dispersed in an aqueous dispersion medium. Also, oil-based ink may have a configuration in which a solute such as a dye is dissolved in an oil-based solvent, or may have a configuration in which a dispersoid such as a pigment is dispersed in an oil-based dispersion medium.

Furthermore, sublimation transfer ink can be used as the ink. Sublimation transfer ink is ink that includes a sublimation color material such as a sublimation dye. One example of a printing method is a method in which sublimation transfer ink is ejected onto a transfer medium by a liquid ejection device, a printing target is brought into contact with the transfer medium and heated to cause the color material to sublimate and be transferred to the printing target. The printing target is a T-shirt, a smartphone, or the like. In this way, if the ink includes a sublimation color material, printing can be performed on a diverse range of printing targets (recording media).

As shown in FIG. 3, the tank 7 is provided with a liquid injection portion 34. With the tank 7, ink can be injected into the tank 7 from outside the tank 7 via the liquid injection portions 34. As previously described, in the liquid ejection system 1 shown in FIG. 1, the operator can access the liquid injection portions 34 of the tank 7 from outside the casing 6 by opening the cover 23 relative to the casing 6. Also, the surface of the tank 7 that faces the Y axis direction is set as a viewing surface 35. The viewing surface 35 faces the window portion 21. The operator can view the amount of ink in each of the tanks 7 by viewing the viewing surface 35 of the tank 7 through the window portion 21.

In this embodiment, caps (not shown) are attached to the liquid injection portions 34 in the state where the liquid ejection system 1 is used in printing. The caps are configured to be able to be attached to and detached from the tank 7. When injecting ink into the tank 7, the operator detaches a cap to free a liquid injection portion 34, and then the operator can inject ink into the liquid injection portion 34. Note that when the liquid ejection system 1 is in the in-use orientation, the liquid injection portion 34 faces a direction upward relative to the horizontal direction.

Note that as shown in FIG. 1, the tank 7 can also have a configuration in which upper limit marks 36, lower limit marks 37, and the like are provided on the viewing surface 35 that enables viewing of the stored amount of ink. In this embodiment, the upper limit mark 36 and the lower limit mark 37 are provided for each of the tanks 7. The operator can find out the amount of ink in the tank 7 by using the upper limit mark 36 and the lower limit mark 37 as a guide. Note that the upper limit mark 36 indicates a guide regarding the amount of ink that can be injected through the liquid injection portion 34 without overflowing from the liquid injection portion 34. Also, the lower limit mark 37 indicates a guide regarding an ink amount for prompting ink injection. There is no limitation to a configuration in which both the upper limit marks 36 and the lower limit marks 37 are provided, and a configuration can be employed in which only either the upper limit marks 36 or the lower limit marks 37 are provided on the tank 7.

Figure 4:
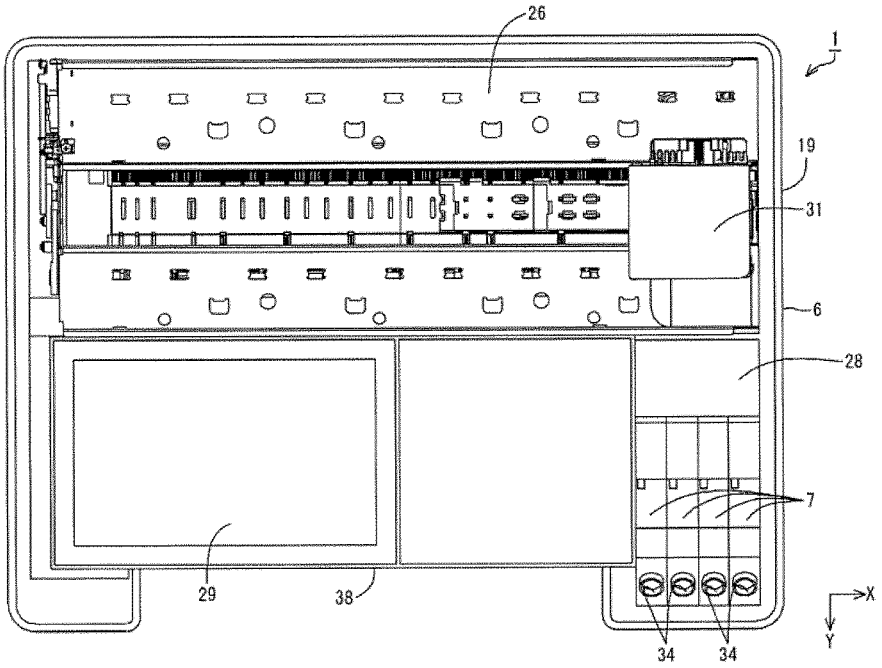
FIG. 4 is a plan view of the relevant configuration of the liquid ejection system according to the first embodiment.

In a plan view of the liquid ejection system 1 from the Z axis direction to the −Z axis direction, as shown in FIG. 4, the mechanism unit 26 is arranged on the −Y axis direction side of the tank 7, the waste liquid absorbing unit 28, and the electrical wiring board 29. In other words, the mechanism unit 26 is arranged the farthest on the −Y axis direction side among these members. The tank 7 is arranged on the Y axis direction side of the mechanism unit 26.

The waste liquid absorbing unit 28 is arranged on the Y axis direction side of the mechanism unit 26, and on the −Y axis direction side of the tank 7. The tank 7 and the waste liquid absorbing unit 28 are arranged side-by-side along the Y axis in the stated order beginning from the Y axis direction. The electrical wiring board 29 is arranged on the Y axis direction side of the mechanism unit 26, and on the −X axis direction side of the tank 7 and the waste liquid absorbing unit 28. The electrical wiring board 29 is arranged on (on the Z axis direction side of) a board tray 38. The region on the −Z axis direction side of the board tray 38 is set as a region for the sheet discharge portion 11 (FIG. 3).

Here, as shown in FIG. 4, the position of the liquid injection portion 34 in the Y axis direction in the tank 7 is biased to one side relative to the tank 7. In other words, the liquid injection portion 34 of the tank 7 is arranged at a biased position on the tank 7. Also, the side of the tank 7 on which the liquid injection portion 34 is located is defined as the front surface side. Based on this definition, as shown in FIG. 3, the surface of the tank 7 that is located the farthest on the Y axis direction side is considered to be a front surface 41. Also, the viewing surface 35 of the tank 7 is located on the front surface 41 side. For this reason, the viewing surface 35 of the tank 7 corresponds to the front surface 41. The front surface 41 faces the Y axis direction.

Various working examples of the tank 7 will be described below. Note that in order to identify the tank 7 in the respective working examples below, different alphabet letters, signs, and the like are appended to reference signs for the tank 7 in each working example.

Working Example 1-1

Figure 5:
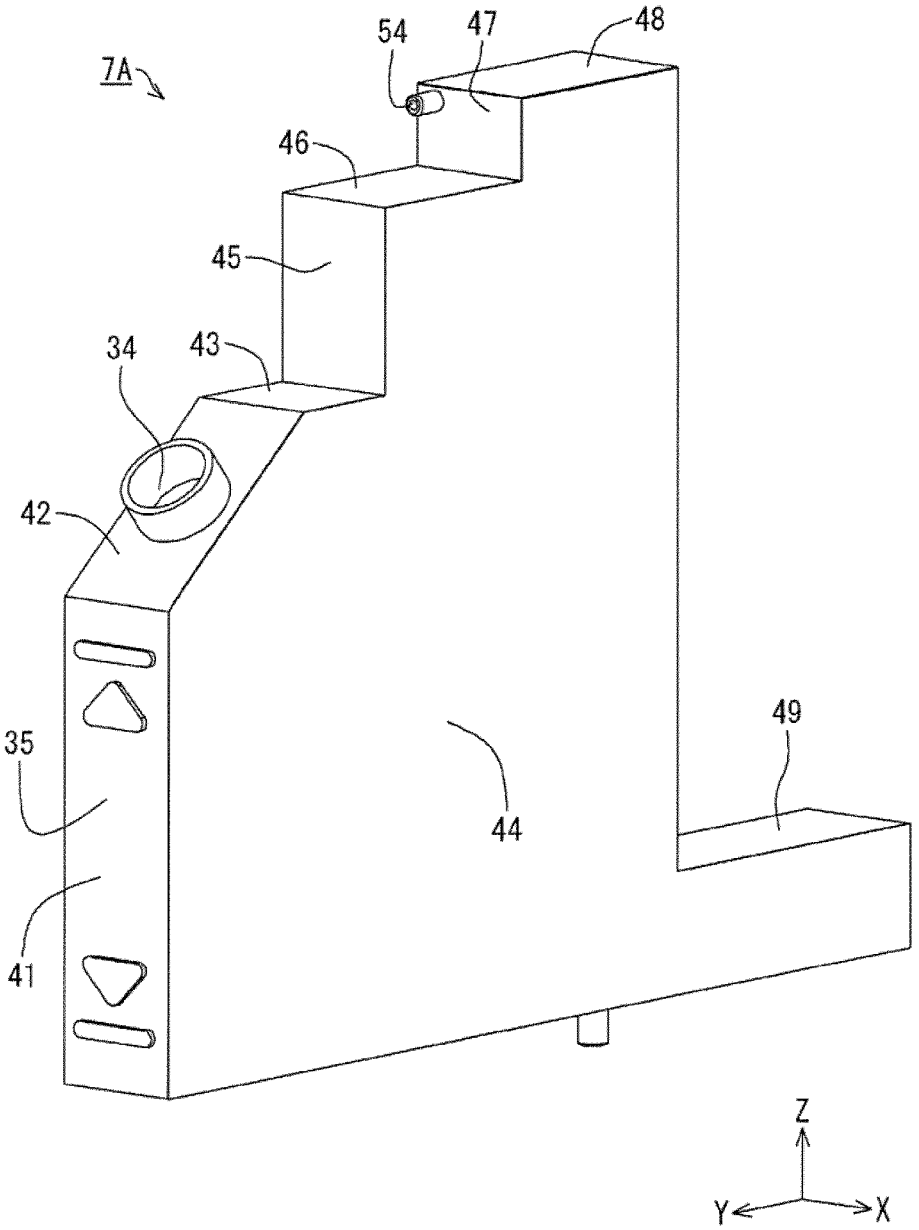
FIG. 5 is a perspective view of the tank in Working Example 1-1.
Figure 6:
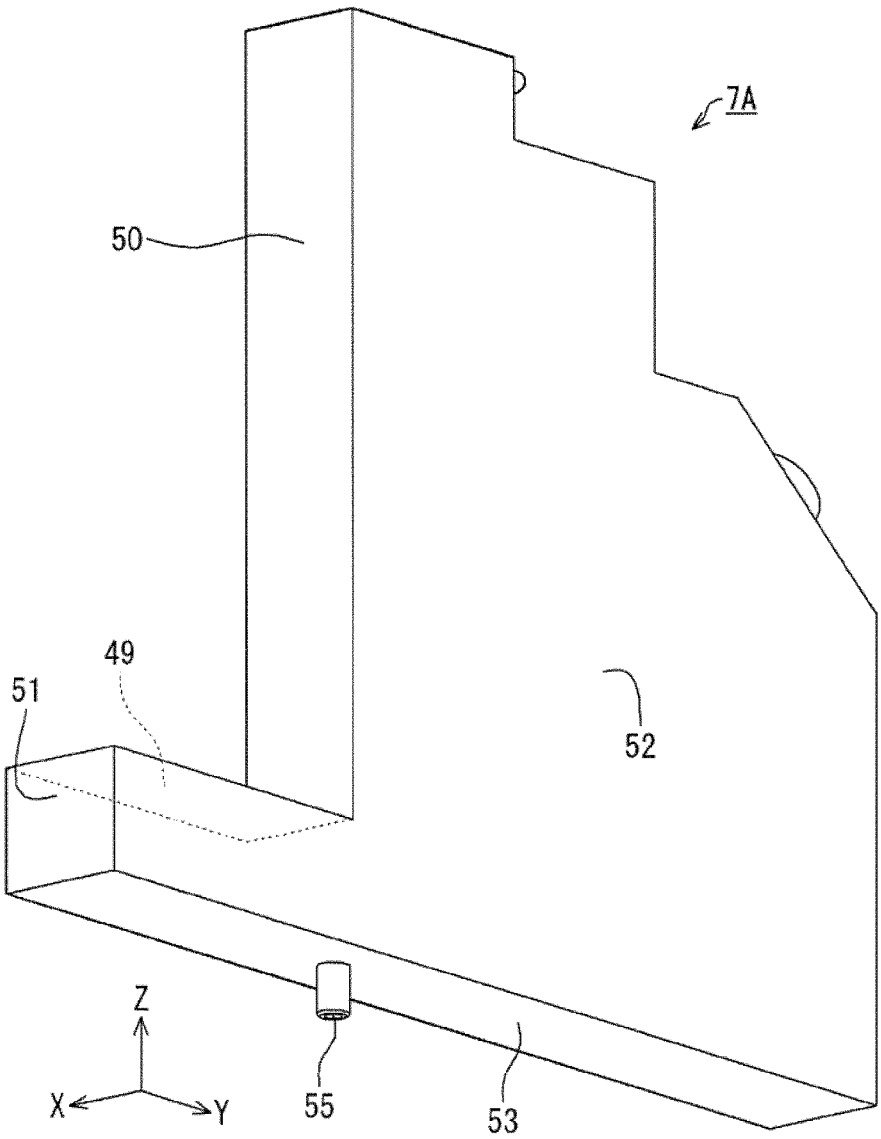
FIG. 6 is a perspective view of the tank in Working Example 1-1.

As shown in FIG. 5, a tank 7A of Working Example 1-1 has the front surface 41, an inclined surface 42, an upper surface 43, a side surface 44, a side surface 45, an upper surface 46, a side surface 47, an upper surface 48, and an upper surface 49. The front surface 41, the inclined surface 42, the upper surface 43, the side surface 44, the side surface 45, the upper surface 46, the side surface 47, the upper surface 48, and the upper surface 49 are surfaces of the tank 7A that face outward. As previously described, the front surface 41 is set as the viewing surface 35. Also, as shown in FIG. 6, the tank 7A has a rear surface 50, a rear surface 51, a side surface 52, and a lower surface 53. The rear surface 50, the rear surface 51, the side surface 52, and the lower surface 53 are surfaces of the tank 7A that face outward.

As shown in FIG. 5, the inclined surface 42 is located on the Z axis direction side of the front surface 41. The front surface 41 extends along the XZ plane. The inclined surface 42 intersects both the XZ plane and the XY plane. The end portion, on the −Z axis direction side, of the inclined surface 42 intersects the front surface 41. The inclined surface 42 is inclined so as to rise in the Z axis direction as it extends from the front surface 41 in the −Y axis direction. The liquid injection portion 34 is provided in the inclined surface 42.

The upper surface 43 is located on the −Y axis direction side of the inclined surface 42. The upper surface 43 extends along the XY plane. The upper surface 43 faces the Z axis direction. The end portion, on the Y axis direction side, of the upper surface 43 intersects the inclined surface 42. The end portion, on the Z axis direction side, of the inclined surface 42 intersects the upper surface 43. For this reason, the inclined surface 42 is interposed between the front surface 41 and the upper surface 43.

The side surface 44 is located on the X axis direction side of the front surface 41, the inclined surface 42, the upper surface 43, the side surface 45, the upper surface 46, the side surface 47, the upper surface 48, and the upper surface 49. The side surface 44 extends along the YZ plane. The side surface 44 faces the X axis direction. The side surface 44 intersects the front surface 41, the inclined surface 42, the upper surface 43, the side surface 45, the upper surface 46, the side surface 47, the upper surface 48, and the upper surface 49. The side surface 45 is located on the −Y axis direction side of the upper surface 43. The side surface 45 extends along the XZ plane. The side surface 45 faces the Y axis direction. The end portion, on the −Z axis direction side, of the side surface 45 intersects the upper surface 43.

The upper surface 46 is located on the Z axis direction side of the side surface 45. The upper surface 46 extends along the XY plane. The upper surface 46 faces the Z axis direction. The end portion, on the Y axis direction side, of the upper surface 46 intersects the side surface 45. According to the above-described configuration, the side surface 45 is interposed between the upper surface 43 and the upper surface 46. Also, the upper surface 43 is interposed between the inclined surface 42 and the side surface 45.

The side surface 47 is located on the −Y axis direction side of the upper surface 46. The side surface 47 extends along the XZ plane. The side surface 47 faces the Y axis direction. The end portion, on the −Z axis direction side, of the side surface 47 intersects the upper surface 46. The upper surface 48 is located on the Z axis direction side of the side surface 47. The upper surface 48 extends along the XY plane. The upper surface 48 faces the Z axis direction. The end portion, on the Y axis direction side, of the upper surface 48 intersects the side surface 47. According to the above-described configuration, the side surface 47 is interposed between the upper surface 46 and the upper surface 48. Also, the upper surface 46 is interposed between the side surface 45 and the side surface 47.

The upper surface 49 is located on the −Z axis direction side of the upper surface 48. Furthermore, the upper surface 49 is located on the −Z axis direction side of the inclined surface 42. Also, the upper surface 49 is located on the −Y axis direction side of the upper surface 48. The upper surface 49 extends along the XY plane. The upper surface 49 faces the Z axis direction. The end portion, on the Y axis direction side, of the upper surface 49 intersects the rear surface 50 (FIG. 6). According to the above configuration, the rear surface 50 shown in FIG. 6 is interposed between the upper surface 48 and the upper surface 49.

As shown in FIG. 6, the rear surface 50 faces the −Y axis direction. The rear surface 50 extends along the XZ plane. The rear surface 50 is located on the side opposite to the front surface 41 (FIG. 5). For this reason, the front surface 41 and rear surface 50 have a mutually opposing surface relationship. The rear surface 50 intersects the side surface 44, the upper surface 48, the upper surface 49, and the side surface 52 (FIG. 6) on the side opposite to the front surface 41 (FIG. 5).

The rear surface 51 is located on the −Y axis direction side of the rear surface 50. The rear surface 51 faces the −Y axis direction. The rear surface 51 extends along the XZ plane. The rear surface 51 is located on the −Z axis direction side of the upper surface 49. The end portion, on the Z axis direction side, of the rear surface 51 intersects the upper surface 49. For this reason, the upper surface 49 is interposed between the rear surface 50 and the rear surface 51. Also, the rear surface 51 intersects the upper surface 49, the side surface 52, the lower surface 53, and the side surface 44 (FIG. 5).

As shown in FIG. 6, the side surface 52 faces the −X axis direction. The side surface 52 extends along the YZ plane. The side surface 52 is located on the side opposite to the side surface 44 (FIG. 5). The side surface 52 intersects the front surface 41, the inclined surface 42, the upper surface 43, the side surface 45, the upper surface 46, the side surface 47, the upper surface 48, and the upper surface 49 on the side opposite to the side surface 44 (FIG. 5). As shown in FIG. 6, the side surface 52 intersects the lower surface 53 as well.

As shown in FIG. 6, the lower surface 53 faces the −Z axis direction. The lower surface 53 extends along the XY plane. The lower surface 53 is located on the −Z axis direction side of the rear surface 51, the side surface 52, the front surface 41 (FIG. 5), and the side surface 44. The lower surface 53 intersects the rear surface 51, the side surface 52, the front surface 41 (FIG. 5), and the side surface 44 on the −Z axis direction side of the rear surface 51, the side surface 52, the front surface 41 (FIG. 5), and the side surface 44. Note that another flat surface, curved surface, or the like may be interposed between two surfaces that intersect each other among the front surface 41, the inclined surface 42, the upper surface 43, the side surface 44, the side surface 45, the upper surface 46, the side surface 47, the upper surface 48, the upper surface 49, the rear surface 50, the rear surface 51, the side surface 52, and the lower surface 53.

Also, that the term "surface extending along the XZ plane" is not limited to a surface that extends completely parallel to the XZ plane, and also encompasses surfaces that are inclined relative to the XZ plane by a margin of error, a tolerance, or the like, while excluding a surface that is orthogonal to the XZ plane. Similarly, the term "surface extending along the YZ plane" is not limited to a surface that extends completely parallel to the YZ plane, and also encompasses surfaces that are inclined relative to the YZ plane by a margin of error, a tolerance, or the like, while excluding a surface that is orthogonal to the YZ plane. The term "surface extending along the XY plane" is not limited to a surface that extends completely parallel to the XY plane, and also encompasses surfaces that are inclined relative to the XY plane by a margin of error, a tolerance, or the like, while excluding a surface that is orthogonal to the XY plane. Also, the front surface 41, the inclined surface 42, the upper surface 43, the side surface 44, the side surface 45, the upper surface 46, the side surface 47, the upper surface 48, the upper surface 49, the rear surface 50, the rear surface 51, the side surface 52, and the lower surface 53 are not limited to being flat surfaces, and may include unevenness, a step, or the like.

Also, the term "two surfaces intersect" refers to a positional relationship in which two surfaces are not parallel to each other. Besides the case where the two surfaces are directly in contact with each other, even in a positional relationship where two surfaces are separated from each other rather than being in direct contact, it can be said that the two surfaces intersect if an extension of the plane of one surface intersects an extension of the plane of the other surface. The angle formed by the two intersecting surfaces may be a right angle, an obtuse angle, or an acute angle.

As shown in FIG. 5, an air inlet portion 54 is provided in the side surface 47 of the tank 7A. The air inlet portion 54 protrudes from the side surface 47 in the Y axis direction. The air inlet portion 54 is in communication with the interior of the tank 7A. The air inlet portion 54 is an introduction portion for introducing air into the tank 7A. Also, as shown in FIG. 6, a liquid supply portion 55 is provided in the lower surface 53 of the tank 7A. The liquid supply portion 55 protrudes from the lower surface 53 in the −Z axis direction. The liquid supply portion 55 is in communication with the interior of the tank 7A. Ink stored in the tank 7A is supplied to the ink supply tube 33 (FIG. 3) via the liquid supply portion 55.

Figure 7:
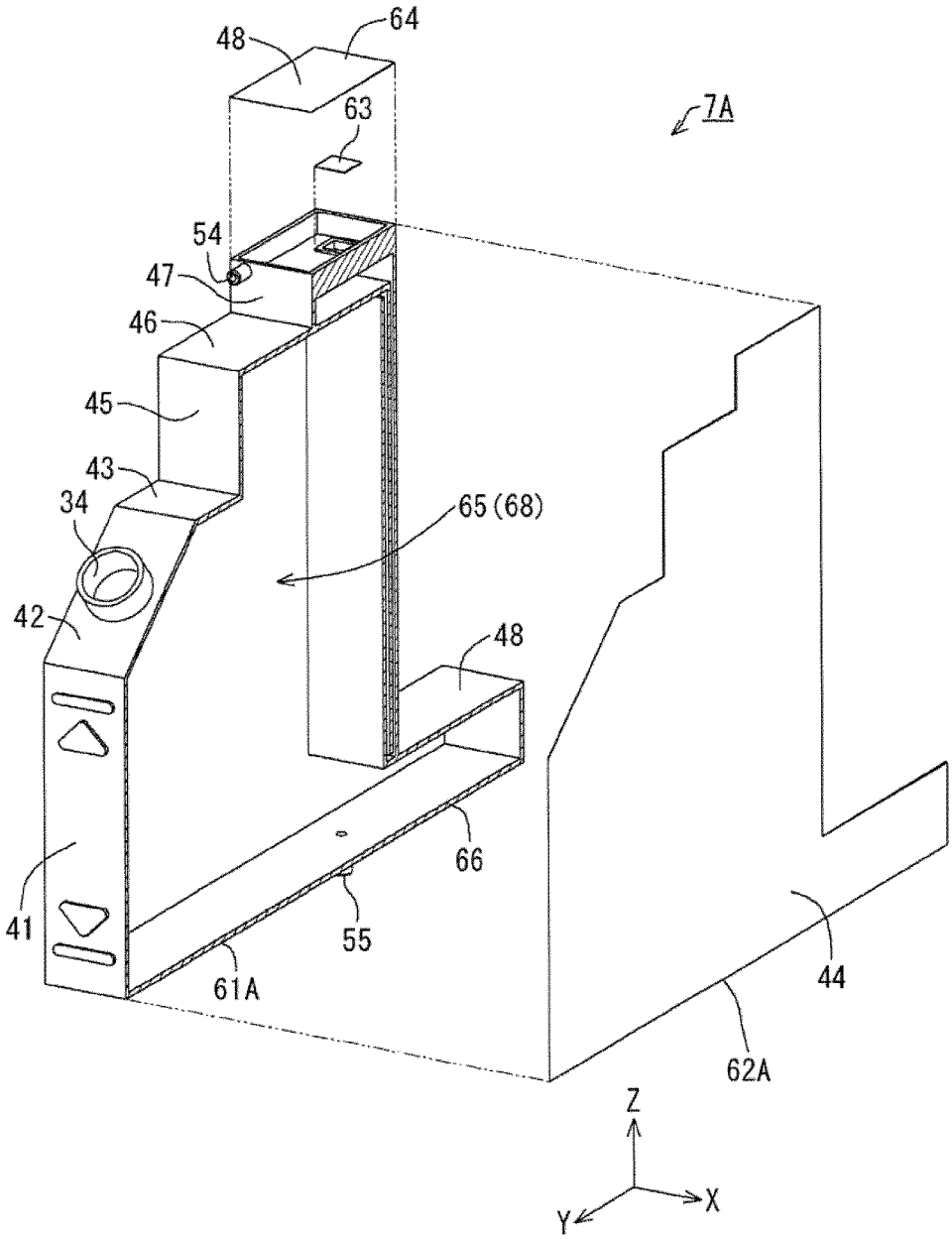
FIG. 7 is an exploded perspective view of the tank in Working Example 1-1.

As shown in FIG. 7, the tank 7A has a case 61A, which is one example of a tank main body, a sheet member 62A, a waterproof ventilation film 63, and a sheet member 64. The case 61A is constituted by a synthetic resin such as nylon or polypropylene, for example. Also, the sheet member 62A and the sheet member 64 are each formed in the shape of a film using a synthetic resin (e.g., nylon or polypropylene), and are bendable. In this embodiment, the surface of the sheet member 62A that faces the X axis direction corresponds to the side surface 44 of the tank 7A. Also, the surface of the sheet member 64 that faces the Z axis direction corresponds to the upper surface 48 of the tank 7A.

In the tank 7A, the sheet member 62A is located on the X axis direction side of the case 61A. The sheet member 64 is located on the Z axis direction side of the case 61A. The waterproof ventilation film 63 is interposed between the sheet member 64 and the case 61A. The waterproof ventilation film 63 is constituted by a material that is highly waterproof with respect to liquids (i.e., has a low liquid permeability) and has a high air permeability, and is formed in the shape of a film.

A recessed portion 65 is formed in the case 61A. The recessed portion 65 is formed so as to recede in the −X axis direction. Also, the recessed portion 65 is open in the X axis direction. Also, the case 61A is provided with a joining portion 66. The joining portion 66 is hatched in FIG. 7 in order to facilitate understanding of the configuration. The sheet member 62A is joined to the joining portion 66. In this embodiment, the case 61A and the sheet member 62A are joined by welding. When the sheet member 62A is joined to the case 61A, the recessed portion 65 is blocked by the sheet member 62A. The space surrounded by the recessed portion 65 and the sheet member 62A will be referred to as a liquid storage portion 68. In the tank 7A, ink is stored in the liquid storage portion 68 that is surrounded by the recessed portion 65 and the sheet member 62A.

Figure 8:
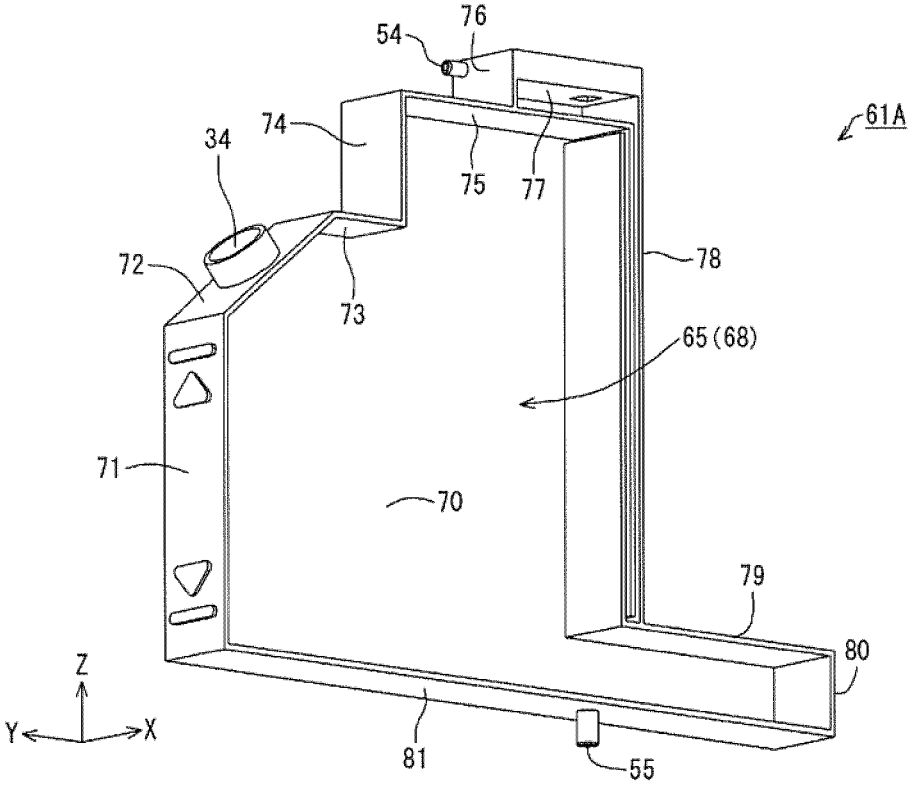
FIG. 8 is a perspective view of the case of the tank in Working Example 1-1.

As shown in FIG. 8, the case 61A has a wall 70, a wall 71, a wall 72, a wall 73, a wall 74, a wall 75, a wall 76, a wall 77, a wall 78, a wall 79, a wall 80, and a wall 81. The wall 70 extends along the YZ plane. Note that the surface of the wall 70 of the case 61A that faces the −X axis direction, that is to say the surface of the wall 70 on the side opposite to the recessed portion 65 side, corresponds to the side surface 52 of the tank 7A shown in FIG. 6.

As shown in FIG. 8, the walls 71 to 81 protrude from the wall 70 in the X axis direction. The end portion, on the Z axis direction side, of the wall 71 intersects the wall 72. The end portion, on the Z axis direction side, of the wall 72 intersects the wall 73. The end portion, on the −Y axis direction side, of the wall 73 intersects the wall 74. The end portion, on the Z axis direction side, of the wall 74 intersects the wall 75. The end portion, on the −Y axis direction side, of the wall 75 is located between the wall 76 and the wall 78. A gap is provided between the wall 78 and the end portion, on the −Y axis direction side, of the wall 75. The end portion, on the −Z axis direction side, of the wall 76 intersects the wall 75.

The wall 77 is located on the Z axis direction side of the wall 75. The end portion, on the Y axis direction side, of the wall 77 intersects the wall 76. Also, the end portion, on the −Y axis direction side, of the wall 77 intersects the wall 78. The end portion, on the −Z axis direction side, of the wall 78 intersects the wall 79. The end portion, on the −Y axis direction side, of the wall 79 intersects the wall 80. The end portion, on the −Z axis direction side, of the wall 80 intersects the wall 81. The end portion, on the Y axis direction side, of the wall 81 intersects the wall 71. In a plan view of the case 61A in the −X axis direction, the walls 71 to 81 surround the wall 70. This configures the recessed portion 65 that has the wall 70 as its bottom in the case 61A.

The wall 71 is located the farthest on the Y axis direction side among the walls 70 to 81. The wall 71 extends along the XZ plane. Note that the surface of the wall 71 of the case 61A that faces the Y axis direction, that is to say the surface of the wall 71 on the side opposite to the recessed portion 65 side, corresponds to the front surface 41 of the tank 7A. The wall 72 is located on the Z axis direction side of the wall 71. The wall 72 is inclined relative to both the XZ plane and XY plane. The wall 72 is inclined so as to rise in the Z axis direction as it extends from the wall 71 in the −Y axis direction. Note that the liquid injection portion 34 is provided in the wall 72. Also, the surface of the wall 72 of the case 61A on the side opposite to the recessed portion 65 side corresponds to the inclined surface 42 of the tank 7A.

The wall 73 extends along the XY plane. The wall 73 is located on the −Y axis direction side of the wall 72. The surface of the wall 73 of the case 61A on the side opposite to the recessed portion 65 side corresponds to the upper surface 43 of the tank 7A shown in FIG. 5. As shown in FIG. 8, the wall 74 is located on the Z axis direction side of the wall 73. The wall 74 extends along the XZ plane. The surface of the wall 74 on the side opposite to the recessed portion 65 side corresponds to the side surface 45 of the tank 7A.

The wall 75 is located on the −Y axis direction side of the wall 74. The wall 75 extends along the XY plane. The surface of the wall 75 on the side opposite to the recessed portion 65 side in the region that protrudes farther in the Y axis direction than the wall 76 corresponds to the upper surface 46 of the tank 7A shown in FIG. 5. As shown in FIG. 8, the wall 76 is located on the Z axis direction side of the wall 75. The wall 76 extends along the XZ plane. The surface of the wall 76 on the side opposite to the recessed portion 65 side corresponds to the side surface 47 of the tank 7A.

The wall 77 is located on the −Y axis direction side of the wall 76. The wall 77 extends along the XY plane. The wall 78 is located on the −Y axis direction side of the wall 77. The wall 78 extends along the XZ plane. The surface of the wall 78 on the side opposite to the recessed portion 65 side corresponds to the rear surface 50 of the tank 7A shown in FIG. 6. As shown in FIG. 8, the wall 79 is located on the −Z axis direction side of the wall 78. The wall 79 extends along the XY plane. Note that the end portion, on the −Z axis direction side, of the wall 78 intersects the wall 79, and protrudes from the wall 79 in the Z axis direction. The surface of the wall 79 on the side opposite to the recessed portion 65 side corresponds to the upper surface 49 of the tank 7A shown in FIG. 5.

As shown in FIG. 8, the wall 80 is located on the −Y axis direction side of the wall 79. The wall 80 extends along the XZ plane. The end portion, on the Z axis direction side, of the wall 80 intersects the wall 79. The wall 80 protrudes from the wall 79 in the −Z axis direction. The surface of the wall 80 on the side opposite to the recessed portion 65 side corresponds to the rear surface 51 of the tank 7A shown in FIG. 6. As shown in FIG. 8, the wall 81 is located on the −Z axis direction side of the wall 80 and the wall 71. The wall 81 extends along the XY plane. The end portion, on the −Y axis direction side, of the wall 81 intersects the wall 80, and the end portion, on the Y axis direction side, of the wall 81 intersects the wall 71. The surface of the wall 81 on the side opposite to the recessed portion 65 side corresponds to the lower surface 53 of the tank 7A shown in FIG. 6. Note that the walls 70 to 81 are not limited to being flat walls, and may include unevenness, a step, or the like.

Figure 9:
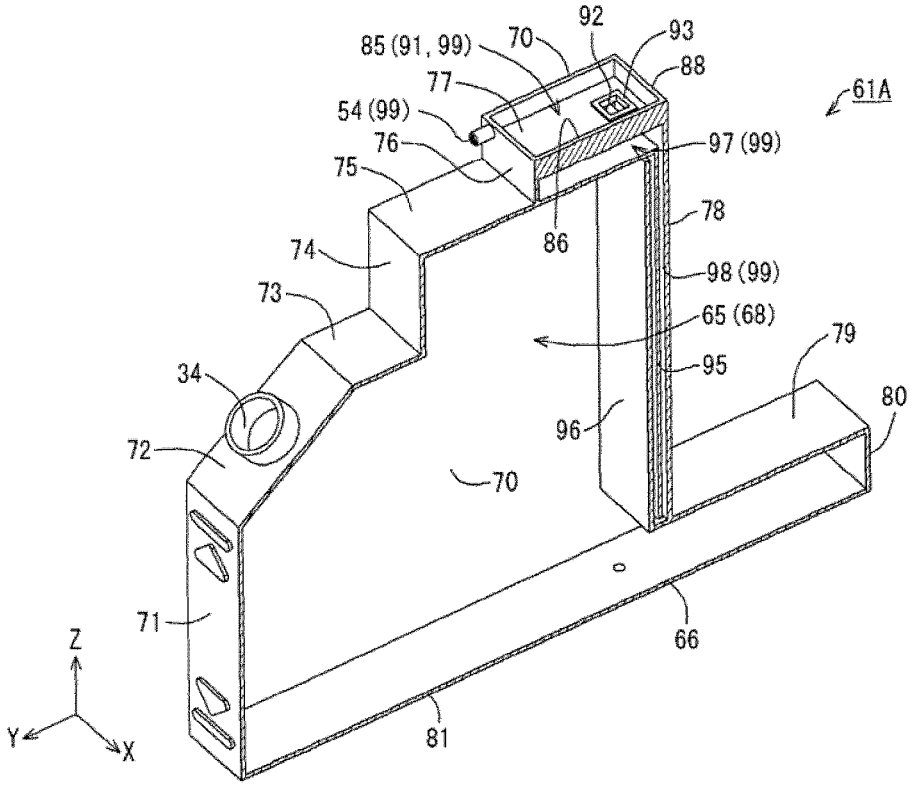
FIG. 9 is a perspective view of the case of the tank in Working Example 1-1.

As shown in FIG. 9, in the case 61A, a recessed portion 85 is formed on the side of the wall 77 that is opposite to the recessed portion 65 side, that is to say on the Z axis direction side of the wall 77. The recessed portion 85 is formed so as to recede in the −Z axis direction. Also, the recessed portion 85 is open in the Z axis direction. The recessed portion 85 is configured by the wall 77, the wall 76, the wall 70, the wall 78, and a partition wall 86. The wall 76, the wall 70, and the wall 78 protrude farther in the Z axis direction than the wall 77. Also, the partition wall 86 protrudes from the wall 77 in the Z axis direction, and extends along the YZ plane. The end portion, on the Y axis direction side, of the partition wall 86 intersects the wall 76, and the end portion, on the −Y axis direction side, of the partition wall 86 intersects the wall 78. In a plan view of the case 61A in the −Z axis direction, the wall 76, the wall 70, the wall 78, and the partition wall 86 surround the wall 77. This configures the recessed portion 85 that has the wall 77 as its bottom in the case 61A.

The end portions, on the Z axis direction side, of the wall 76, the wall 70, the wall 78, and the partition wall 86 are set as a joining portion 88. The sheet member 64 (FIG. 7) is joined to the joining portion 88. In this embodiment, the case 61A and the sheet member 64 are joined by welding. When the sheet member 64 is joined to the case 61A, the recessed portion 85 (FIG. 9) is blocked by the sheet member 64. The space enclosed by the recessed portion 85 and the sheet member 64 constitutes an air chamber 91.

Here, as shown in FIG. 9, a through-hole 92 is formed in the wall 77. The through-hole 92 passes through the wall 77 along the Z axis. For this reason, the recessed portion 65 and the recessed portion 85 are in communication via the through-hole 92. A joining portion 93 is provided so as to surround the through-hole 92 on the Z axis direction side of the wall 77. In a plan view of the case 61A in the −Z axis direction, the joining portion 93 surrounds the through-hole 92. The waterproof ventilation film 63 (FIG. 7) is joined to the joining portion 93. In this embodiment, the joining portion 93 and the waterproof ventilation film 63 are joined by welding. The waterproof ventilation film 63 has a size and shape capable of covering the through-hole 92. For this reason, when the waterproof ventilation film 63 is joined to the joining portion 93, the through-hole 92 (FIG. 9) is blocked in the Z axis direction by the waterproof ventilation film 63. Accordingly, it is possible to suppress cases where ink in the liquid storage portion 68 flows into the air chamber 91 via the through-hole 92.

Here, a partition wall 95 and a partition wall 96 are provided in the recessed portion 65. The partition wall 95 and the partition wall 96 each extend along the XZ plane. The partition wall 95 and the partition wall 96 are located between the wall 78 and the wall 74. The partition wall 95 is located on the Y axis direction side of the wall 78. The partition wall 96 is located on the Y axis direction side of the partition wall 95. The partition wall 95 and the partition wall 96 each protrude from the wall 70 in the X axis direction. The amounts of protrusion of the partition wall 95 and the partition wall 96 from the wall 70 are set equivalent to the amounts of protrusion of the walls 71 to 81 from the wall 70. The end portions, on the X axis direction side, of the partition wall 95 and the partition wall 96 are set as the joining portion 66, similarly to the end portions, on the X axis direction side, of the walls 71 to 81.

The end portion, on the Z axis direction side, of the partition wall 95 is connected to the end portion, on the −Y axis direction side of the wall 75. In other words, the end portion, on the Z axis direction side, of the partition wall 95 intersects the end portion, on the −Y axis direction side, of the wall 75. Also, a gap is provided between the wall 79 and the end portion, on the −Z axis direction side, of the partition wall 95. In other words, the end portion, on the −Z axis direction side, of the partition wall 95 is separated from the wall 79. The end portion, on the −Z axis direction side, of the partition wall 96 is connected to the end portion, on the Y axis direction side of the wall 79. In other words, the end portion, on the −Z axis direction side, of the partition wall 96 intersects the end portion, on the Y axis direction side, of the wall 79. Also, a gap is provided between the wall 75 and the end portion, on the Z axis direction side, of the partition wall 96. In other words, the end portion, on the Z axis direction side, of the partition wall 96 is separated from the wall 75.

The space surrounded by the wall 70, the wall 75, the wall 76, the wall 77, the wall 78, and the sheet member 62A is called a buffer chamber 97. The space surrounded by the gap between the wall 78 and the partition wall 95, the gap between the partition wall 95 and the partition wall 96, and the sheet member 62A is called a flow channel 98 through which air and ink can flow. The buffer chamber 97 is in communication with the recessed portion 65 via the flow channel 98. The functionality of the buffer chamber 97 includes a function of storing ink that has flowed in reverse through the flow channel 98 from the liquid storage portion 68 (recessed portion 65).

Also, the air inlet portion 54 passes through the wall 76 along the Y axis, and is in communication with the interior of the recessed portion 85. For this reason, in the tank 7A, the liquid storage portion 68 is in communication with the outside of the tank 7A via the flow channel 98, the buffer chamber 97, the air chamber 91, and the air inlet portion 54. Accordingly, the tank 7A is configured such that air from outside the tank 7A can be introduced into the liquid storage portion 68 via the air inlet portion 54, the air chamber 91, and the flow channel 98. The air inlet portion 54, the air chamber 91, the buffer chamber 97, and the flow channel 98 configure an air introduction portion 99. The pathway of the air introduction portion 99 is a tortuous path due to the partition wall 95 and the partition wall 96 in the flow channel 98. Accordingly, when air travels from the liquid storage portion 68 toward the air inlet portion 54, it travels through a tortuous path to the air inlet portion 54. This tortuous path readily hinders the evaporation of the liquid component of the ink in the liquid storage portion 68.

Figure 10:
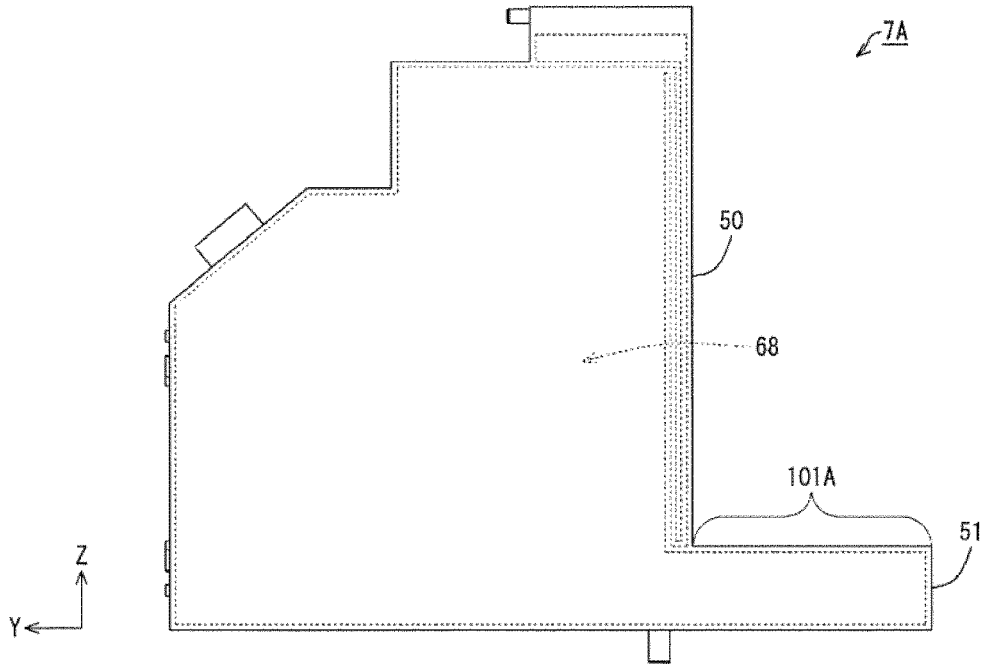
FIG. 10 is a side view of the tank in Working Example 1-1.
Figure 11:
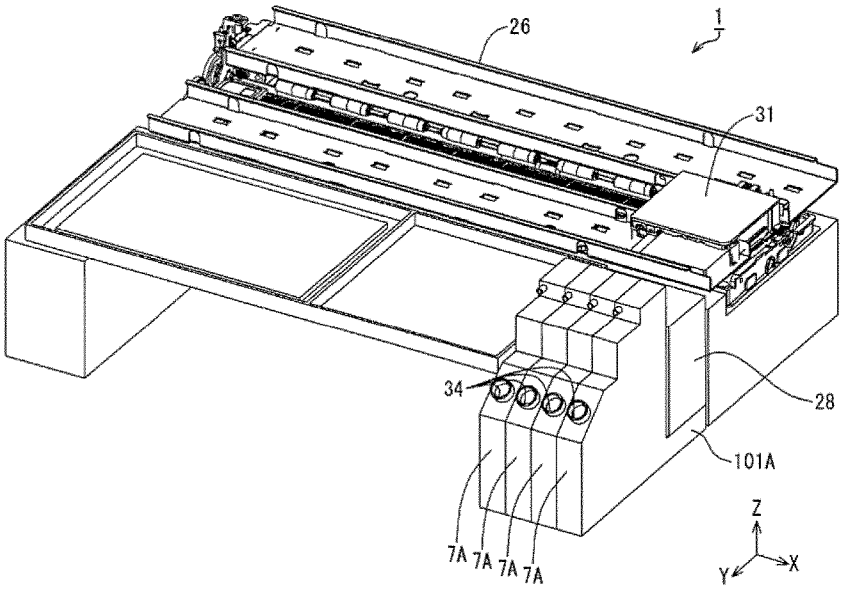
FIG. 11 is a perspective view of a liquid ejection system in which the tank of Working Example 1-1 is mounted.

As shown in FIG. 10, in the tank 7A having the above configuration, a portion of the liquid storage portion 68 protrudes farther in the −Y axis direction than the rear surface 50. Hereinafter, the portion of the tank 7A that protrudes farther in the −Y axis direction than the rear surface 50 will be denoted as a protruding storage portion 101A. In this embodiment, as shown in FIG. 11, the protruding storage portion 101A of the tank 7A is located on the −Z axis direction side of the waste liquid absorbing unit 28. Specifically, in a plan view of the mechanism unit 26 of the liquid ejection system 1 in the −Z axis direction when in the in-use orientation, at least a portion of the tank 7A, excluding the liquid injection portion 34, is overlapped with the region of the waste liquid absorbing unit 28. In other words, in the in-use orientation, at least a portion of the tank 7A, excluding the liquid injection portion 34, is located vertically below the waste liquid absorbing unit 28. According to this configuration, the amount of ink that can be stored in the tank 7A is readily increased while also mitigating an increase in the projected area (footprint) of the waste liquid absorbing unit 28 and the tank 7A in a plan view. Accordingly, an increase in the size of the liquid ejection system 1 is readily mitigated.

Working Example 1-2

Figure 12:
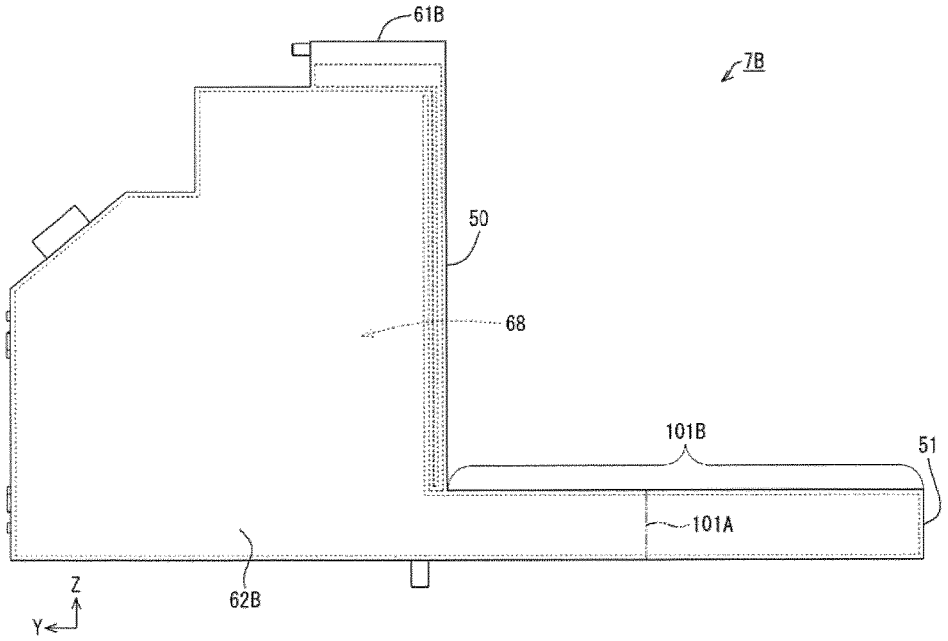
FIG. 12 is a side view of the tank in Working Example 1-2.

As shown in FIG. 12, a tank 7B of Working Example 1-2 has a protruding storage portion 101B. In the tank 7B of Working Example 1-2, the length of the protruding storage portion 101B along the Y axis is longer than that of the protruding storage portion 101A in Working Example 1-1. With the exception of the above point, the tank 7B of Working Example 1-2 has the same configuration as the tank 7A of Working Example 1-1. For this reason, in the following, configurations in the tank 7B of Working Example 1-2 that are the same as configurations in Working Example 1-1 will be denoted by the same reference signs as in Working Example 1-1, and will not be described in detail. Note that the tank 7B has a case 61B and a sheet member 62B. In the tank 7B, the dimensions of the protruding storage portion 101B are changed from the dimensions of the protruding storage portion 101A by changing the shapes and dimensions of the case 61B and the sheet member 62B from those in Working Example 1-1.

Figure 13:
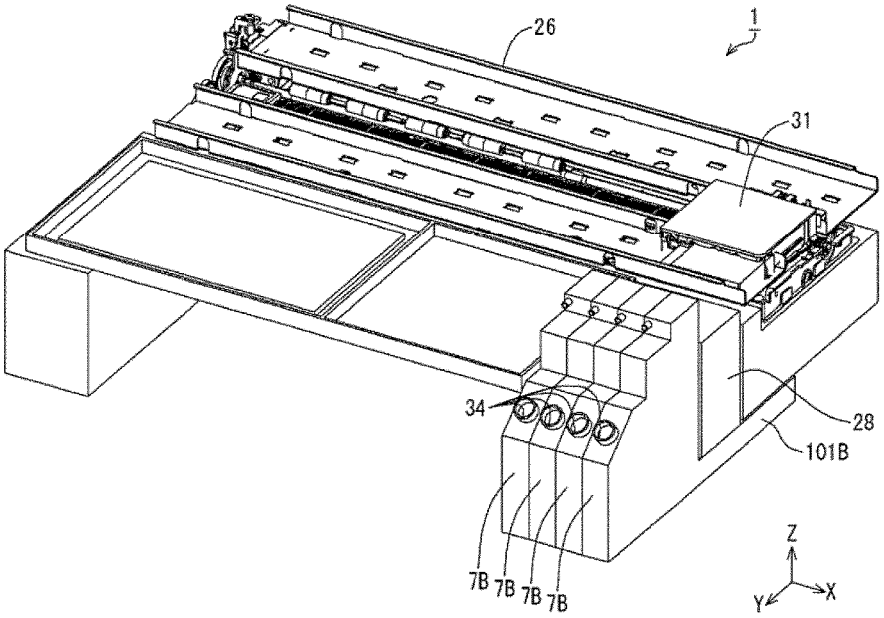
FIG. 13 is a perspective view of a liquid ejection system in which the tank of Working Example 1-2 is mounted.

As shown in FIG. 13, in the tank 7B, the protruding storage portion 101B protrudes farther in the −Y axis direction than the region of overlap with the waste liquid absorbing unit 28. In the tank 7B, the protruding storage portion 101B extends in the −Y axis direction beyond the region of overlap with the waste liquid absorbing unit 28, and reaches a region of overlap with the mechanism unit 26. Specifically, in a plan view of the mechanism unit 26 of the liquid ejection system 1 in the −Z axis direction when in the in-use orientation, at least a portion of the tank 7B, excluding the liquid injection portion 34, is overlapped with the region of the mechanism unit 26. In other words, in the in-use orientation, at least a portion of the tank 7B, excluding the liquid injection portion 34, is located vertically below the mechanism unit 26.

Figure 14:
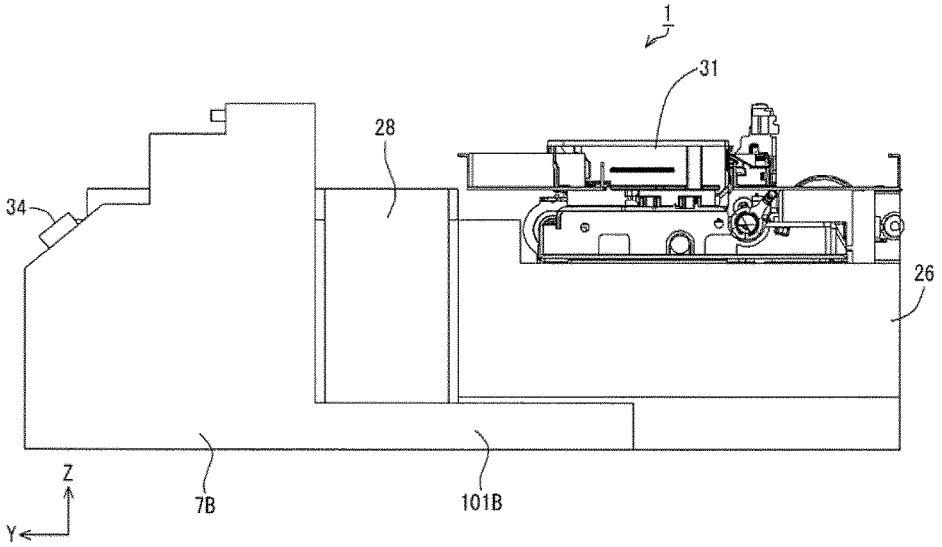
FIG. 14 is a side view of the liquid ejection system in which the tank of Working Example 1-2 is mounted.

According to this configuration, the amount of ink that can be stored in the tank 7B is readily increased while also mitigating an increase in the projected area (footprint) of the mechanism unit 26 and the tank 7B in a plan view. Accordingly, an increase in the size of the liquid ejection system 1 is readily mitigated. Note that in Working Example 1-2, as shown in FIG. 14, the protruding storage portion 101B of the tank 7B reaches a region of overlap with the movable region of the recording portion 31 in the mechanism unit 26. Furthermore, in the example shown in FIG. 14, the protruding storage portion 101B of the tank 7B reaches a region of overlap with the recording head in the recording portion 31.

Working Example 1-3

Figure 15:
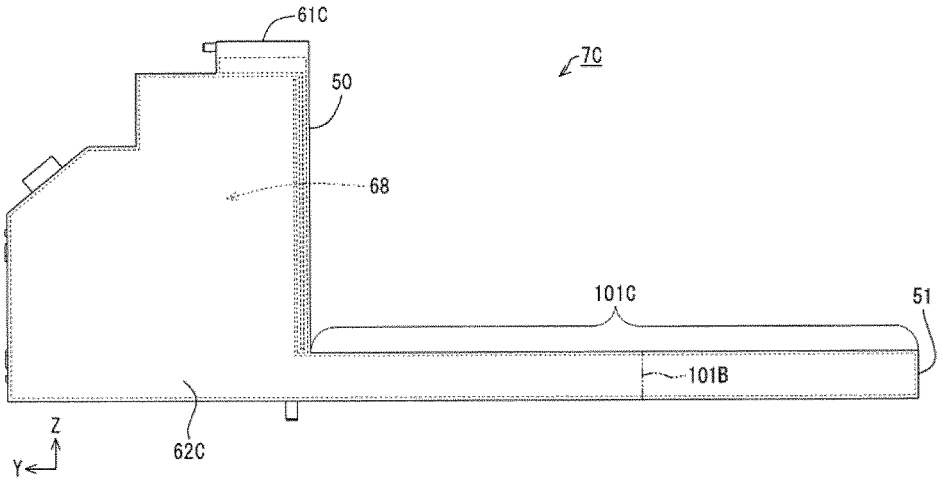
FIG. 15 is a side view of the tank in Working Example 1-3.

As shown in FIG. 15, a tank 7C of Working Example 1-3 has a protruding storage portion 101C. In the tank 7C of Working Example 1-3, the length of the protruding storage portion 101C along the Y axis is longer than that of the protruding storage portion 101B in Working Example 1-2. With the exception of the above point, the tank 7C of Working Example 1-3 has the same configuration as the tank 7A of Working Example 1-1 and the tank 7B of Working Example 1-2. For this reason, in the following, configurations in the tank 7C of Working Example 1-3 that are the same as configurations in Working Example 1-1 and Working Example 1-2 will be denoted by the same reference signs as in Working Example 1-1 and Working Example 1-2, and will not be described in detail. Note that the tank 7C has a case 61C and a sheet member 62C. In the tank 7C, the dimensions of the protruding storage portion 101C are changed from the dimensions of the protruding storage portion 101B by changing the shapes and dimensions of the case 61C and the sheet member 62C from those in Working Example 1-2.

Figure 16:
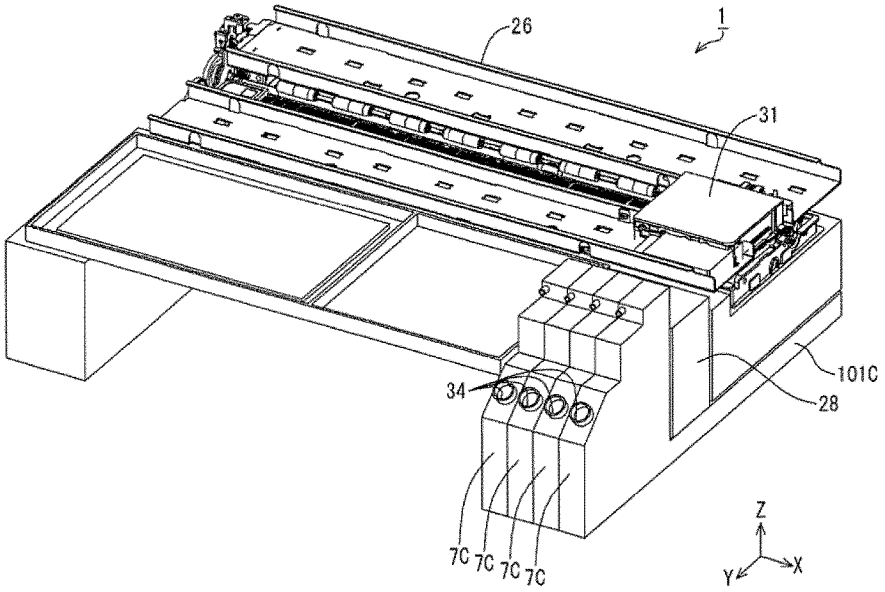
FIG. 16 is a perspective view of a liquid ejection system in which the tank of Working Example 1-3 is mounted.

As shown in FIG. 16, in the tank 7C, the protruding storage portion 101C protrudes farther in the −Y axis direction than the region of overlap with the waste liquid absorbing unit 28. In the tank 7C, the protruding storage portion 101C extends in the −Y axis direction beyond the region of overlap with the waste liquid absorbing unit 28, and reaches a region of overlap with the mechanism unit 26. Specifically, in a plan view of the mechanism unit 26 of the liquid ejection system 1 in the −Z axis direction when in the in-use orientation, at least a portion of the tank 7C, excluding the liquid injection portion 34, is overlapped with the region of the mechanism unit 26. In other words, in the in-use orientation, at least a portion of the tank 7C, excluding the liquid injection portion 34, is located vertically below the mechanism unit 26.

Figure 17:
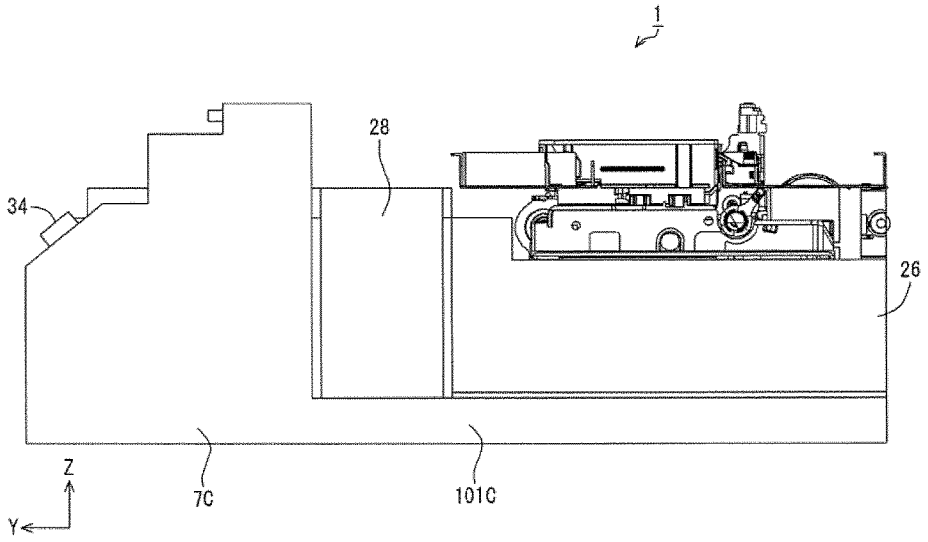
FIG. 17 is a side view of the liquid ejection system in which the tank of Working Example 1-3 is mounted.

Note that in Working Example 1-3, as shown in FIG. 17, the protruding storage portion 101C of the tank 7C extends beyond a region of overlap with the movable region of the recording portion 31 in the mechanism unit 26. Furthermore, in the example shown in FIG. 17, the protruding storage portion 101C of the tank 7C extends across the region of the mechanism unit 26 along the Y axis.

According to Working Example 1-3, the amount of ink that can be stored in the tank 7C is more readily increased while also mitigating an increase in the projected area (footprint) of the mechanism unit 26 and the tank 7C in a plan view. Accordingly, an increase in the size of the liquid ejection system 1 is more readily mitigated.

According to Working Examples 1-1 to 1-3, the amount of ink that can be stored in the tank 7 is readily increased while also mitigating an increase in the projected area (footprint) of the liquid ejection system 1 in a plan view. For this reason, it is possible to avoid increasing the amount of ink that can be stored in the tank 7 by extending the tank 7 in the X axis direction or extending the tank 7 in the Y axis direction for example. For example, with a configuration in which the tank 7 is extended in the X axis direction, it is thought that the tank 7 protrudes farther in the X axis direction than the mechanism unit 26 in a plan view of the liquid ejection system 1 in the −Z axis direction. According to Working Examples 1-1 to 1-3, it is possible to avoid this, and the position of the tank 7 in the X axis direction can be set farther on the −X axis direction side than the position of the mechanism unit 26 in the X axis direction.

Note that in Working Examples 1-1 to 1-3, the protruding storage portion 101A, the protruding storage portion 101B, and the protruding storage portion 101C are located on the −Z axis direction side of the waste liquid absorbing unit 28. However, the protruding storage portion 101A, the protruding storage portion 101B, and the protruding storage portion 101C are not limited to these positions, and may be located on the Z axis direction side of the waste liquid absorbing unit 28, for example. With this configuration, the positions of the protruding storage portion 101A, the protruding storage portion 101B, and the protruding storage portion 101C in the tank 7 need only be set shifted in the Z axis direction.

Also, in Working Example 1-2 and Working Example 1-3, the protruding storage portion 101B and the protruding storage portion 101C are located on the −Z axis direction side of the mechanism unit 26. However, the protruding storage portion 101B and the protruding storage portion 101C are not limited to these positions, and may be located on the Z axis direction side of the mechanism unit 26, for example. With this configuration, the positions of the protruding storage portion 101B and the protruding storage portion 101C in the tank 7 need only be set shifted in the Z axis direction.

Working Example 1-4

Figure 18:
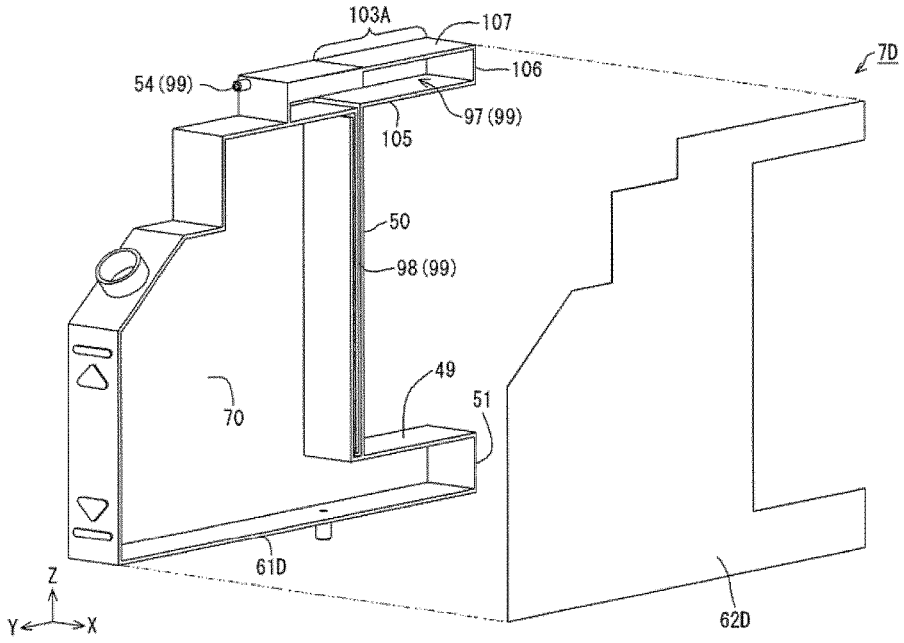
FIG. 18 is an exploded perspective view of the tank in Working Example 1-4.

As shown in FIG. 18, in a tank 7D of Working Example 1-4, the air introduction portion 99 protrudes farther in the −Y axis direction than the rear surface 50. In Working Example 1-4, the buffer chamber 97 protrudes farther in the −Y axis direction than the rear surface 50. In other words, in Working Example 1-4, the buffer chamber 97 has been extended in the −Y axis direction. Accordingly, in Working Example 1-4, the air introduction portion 99 has been extended. With the exception of the above point, the tank 7D of Working Example 1-4 has the same configuration as the tank 7A of Working Example 1-1. For this reason, in the following, configurations in the tank 7D of Working Example 1-4 that are the same as configurations in Working Example 1-1 will be denoted by the same reference signs as in Working Example 1-1, and will not be described in detail.

Note that the tank 7D has a case 61D and a sheet member 62D. In the tank 7D, the air introduction portion 99 has been extended by changing the shapes and dimensions of the case 61D and the sheet member 62D from those in Working Example 1-1. In the following, the portion of the air introduction portion 99 of the tank 7D that protrudes farther in the −Y axis direction than the rear surface 50 will be referred to as a protruding introduction portion 103A.

The case 61D has a wall 105, a wall 106, and a wall 107. The wall 105 and the wall 107 each extend along the XY plane. The wall 105 is located on the Z axis direction side of the upper surface 49, and faces the upper surface 49. The wall 105 protrudes from the rear surface 50 in the −Y axis direction. The end portion, on the Y axis direction side, of the wall 105 intersects the rear surface 50. The wall 107 is located on the Z axis direction side of the wall 105. The wall 106 extends along the XZ plane. The wall 106 is located on the −Y axis direction side of the rear surface 50. The end portion, on the Z axis direction side, of the wall 106 intersects the wall 107, and the end portion, on the −Z axis direction side, of the wall 106 intersects the wall 105.

Also, in the case 61D, a portion of the wall 70 protrudes farther in the −Y axis direction than the rear surface 50. Also, a portion of the sheet member 62D also protrudes farther in the −Y axis direction than the rear surface 50. End portions, on the −X axis direction side, of the wall 105, the wall 106, and the wall 107 intersect a region of the wall 70 that protrudes farther in the −Y axis direction than the rear surface 50. The protruding introduction portion 103A is constituted by a region surrounded by the wall 105, the wall 106, the wall 107, the region of the wall 70 that protrudes farther in the −Y axis direction than the rear surface 50, and the sheet member 62D.

Figure 19:
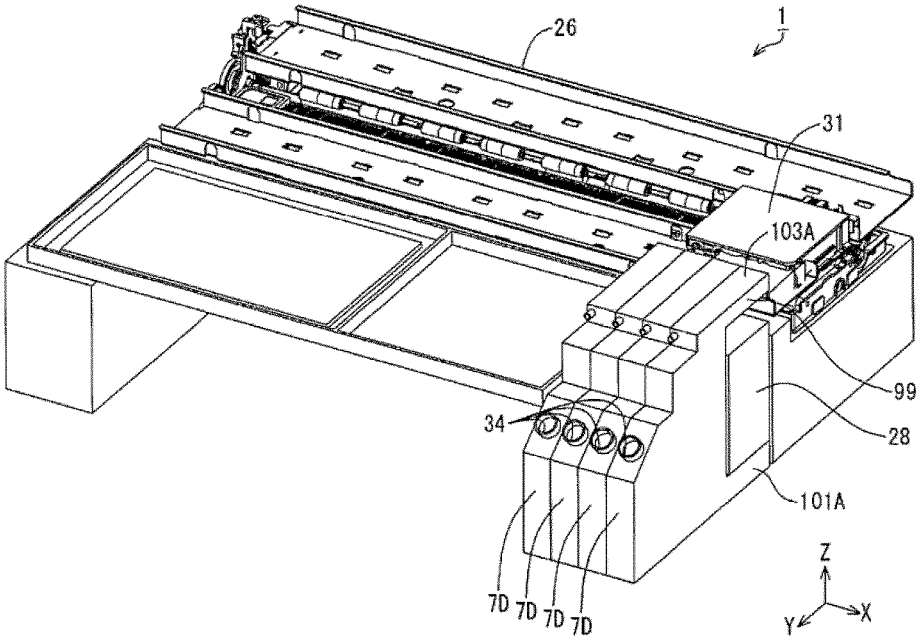
FIG. 19 is a perspective view of a liquid ejection system in which the tank of Working Example 1-4 is mounted.

In this working example, as shown in FIG. 19, the protruding introduction portion 103A of the tank 7D is located on the Z axis direction side of the waste liquid absorbing unit 28. Specifically, in a plan view of the mechanism unit 26 of the liquid ejection system 1 in the −Z axis direction when in the in-use orientation, at least a portion of the air introduction portion 99 of the tank 7D is overlapped with the region of the waste liquid absorbing unit 28. In other words, in the in-use orientation, at least a portion of the air introduction portion 99 of the tank 7D is located vertically above the waste liquid absorbing unit 28.

According to this configuration, the amount of ink that can be stored in the buffer chamber 97 of the tank 7D is readily increased while also mitigating an increase in the projected area (footprint) of the waste liquid absorbing unit 28 and the tank 7D in a plan view. Accordingly, ink that has flowed in reverse through the flow channel 98 from the liquid storage portion 68 (recessed portion 65) is more readily stored. Accordingly, an increase in the size of the liquid ejection system 1 is readily mitigated, and the leakage of ink in the liquid storage portion 68 out through the air inlet portion 54 is readily avoided.

Working Example 1-5

Figure 20:
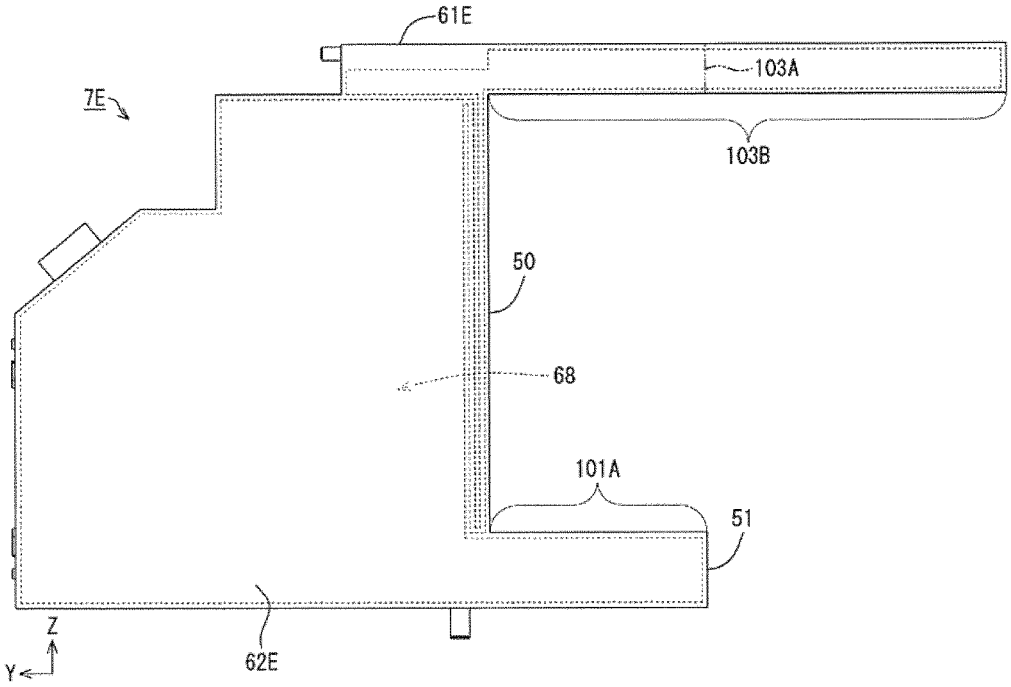
FIG. 20 is a side view of the tank in Working Example 1-5.

As shown in FIG. 20, a tank 7E of Working Example 1-5 has a protruding introduction portion 103B. In the tank 7E of Working Example 1-5, the length of the protruding introduction portion 103B along the Y axis is longer than that of the protruding introduction portion 103A in Working Example 1-4. With the exception of the above point, the tank 7E of Working Example 1-5 has the same configuration as the tank 7D of Working Example 1-4. For this reason, in the following, configurations in the tank 7E of Working Example 1-5 that are the same as configurations in Working Example 1-4 will be denoted by the same reference signs as in Working Example 1-4, and will not be described in detail. Note that the tank 7E has a case 61E and a sheet member 62E. In the tank 7E, the dimensions of the protruding introduction portion 103B are changed from the dimensions of the protruding introduction portion 103A by changing the shapes and dimensions of the case 61E and the sheet member 62E from those in Working Example 1-4.

Figure 21:
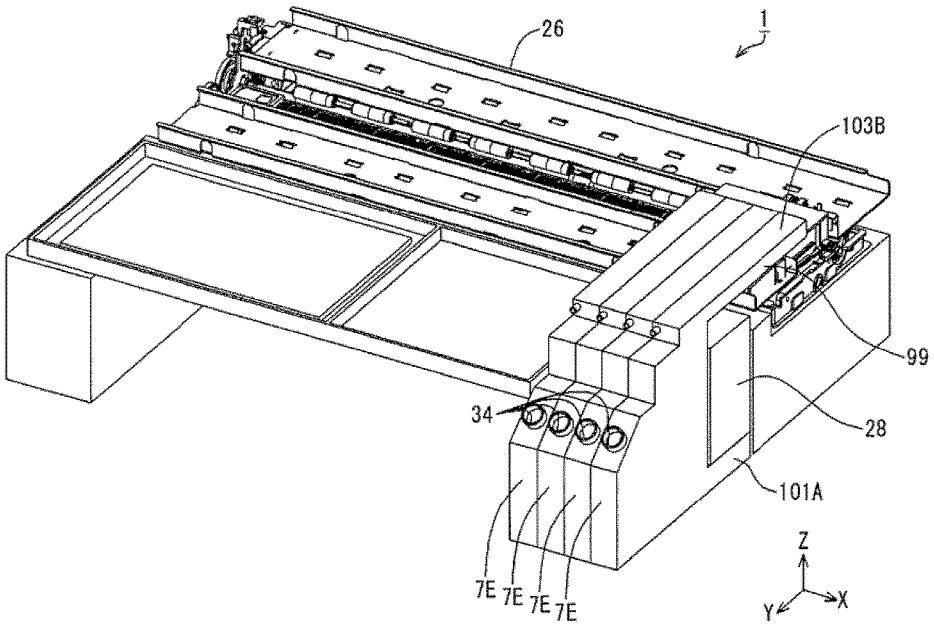
FIG. 21 is a perspective view of a liquid ejection system in which the tank of Working Example 1-5 is mounted.

As shown in FIG. 21, in the tank 7E, the protruding introduction portion 103B protrudes farther in the −Y axis direction than the region of overlap with the waste liquid absorbing unit 28. In the tank 7E, the protruding introduction portion 103B extends in the −Y axis direction beyond the region of overlap with the waste liquid absorbing unit 28, and reaches a region of overlap with the mechanism unit 26. Specifically, in a plan view of the mechanism unit 26 of the liquid ejection system 1 in the −Z axis direction when in the in-use orientation, at least a portion of the air introduction portion 99 of the tank 7E is overlapped with the region of the mechanism unit 26. In other words, in the in-use orientation, at least a portion of the air introduction portion 99 of the tank 7E is located vertically above the mechanism unit 26.

Figure 22:
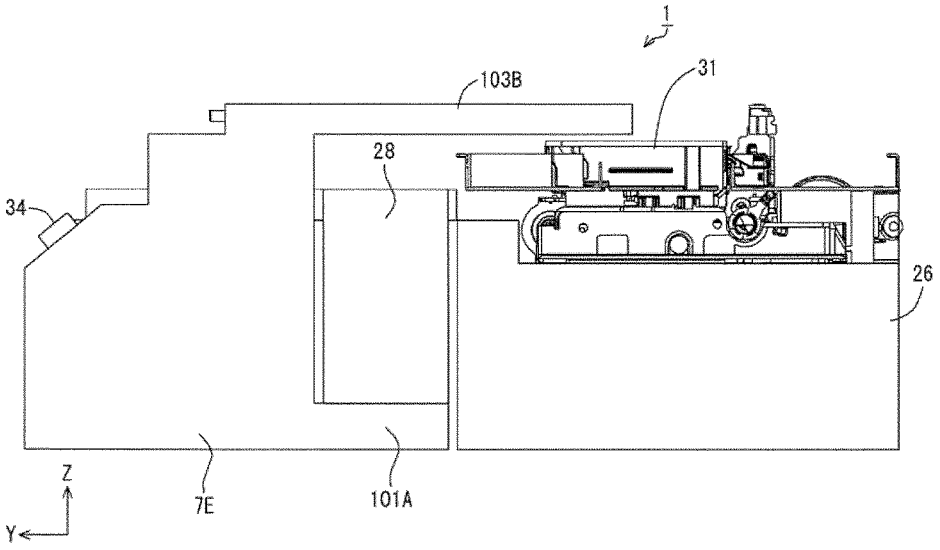
FIG. 22 is a side view of the liquid ejection system in which the tank of Working Example 1-5 is mounted.

According to this configuration, the amount of ink that can be stored in the buffer chamber 97 of the tank 7E is readily increased while also mitigating an increase in the projected area (footprint) of the mechanism unit 26 and the tank 7E in a plan view. Accordingly, ink that has flowed in reverse through the flow channel 98 from the liquid storage portion 68 (recessed portion 65) is more readily stored. Accordingly, an increase in the size of the liquid ejection system 1 is readily mitigated, and the leakage of ink in the liquid storage portion 68 out through the air inlet portion 54 is readily avoided. Note that in Working Example 1-5, as shown in FIG. 22, the protruding introduction portion 103B of the tank 7E reaches a region of overlap with the movable region of the recording portion 31 in the mechanism unit 26. Furthermore, in the example shown in FIG. 22, the protruding introduction portion 103B of the tank 7E reaches a region of overlap with the recording head in the recording portion 31.

Working Example 1-6

Figure 23:
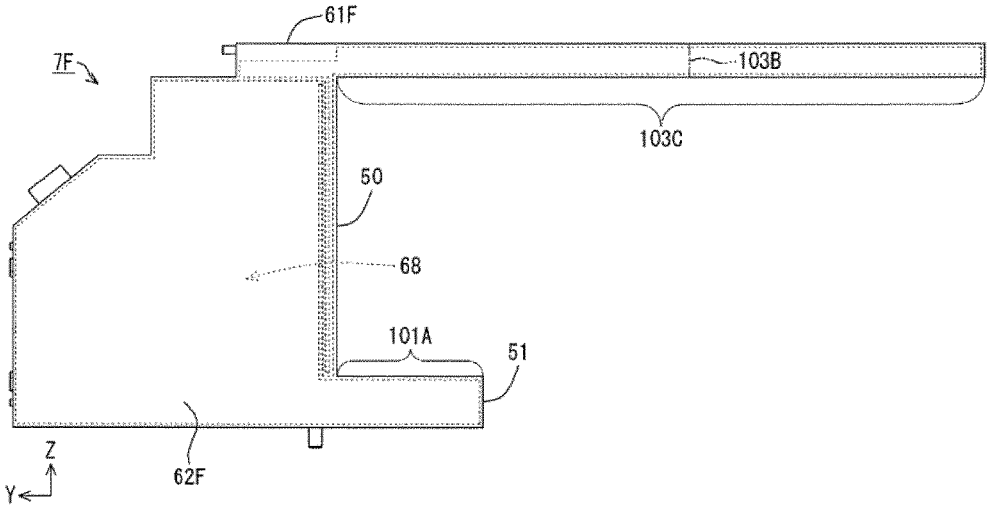
FIG. 23 is a side view of the tank in Working Example 1-6.

As shown in FIG. 23, a tank 7F of Working Example 1-6 has a protruding introduction portion 103C. In the tank 7F of Working Example 1-6, the length of the protruding introduction portion 103C along the Y axis is longer than that of the protruding introduction portion 103B in Working Example 1-5. With the exception of the above point, the tank 7F of Working Example 1-6 has the same configuration as the tank 7D of Working Example 1-4 and the tank 7E of Working Example 1-5. For this reason, in the following, configurations in the tank 7F of Working Example 1-6 that are the same as configurations in Working Example 1-4 and Working Example 1-5 will be denoted by the same reference signs as in Working Example 1-4 and Working Example 1-5, and will not be described in detail. Note that the tank 7F has a case 61F and a sheet member 62F. In the tank 7F, the dimensions of the protruding introduction portion 103C are changed from the dimensions of the protruding introduction portion 103B by changing the shapes and dimensions of the case 61F and the sheet member 62F from those in Working Example 1-5.

Figure 24:
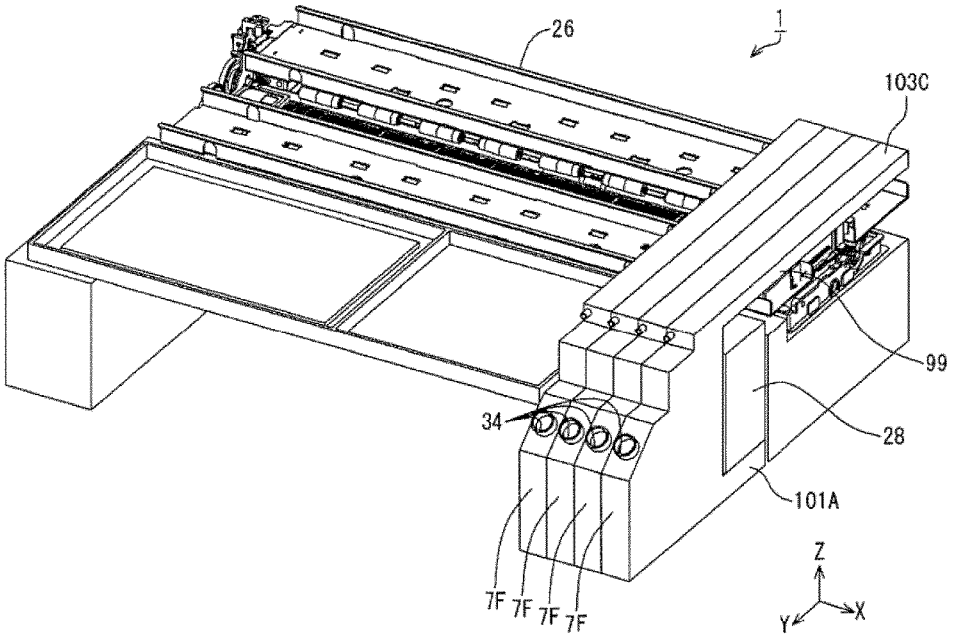
FIG. 24 is a perspective view of a liquid ejection system in which the tank of Working Example 1-6 is mounted.

As shown in FIG. 24, in the tank 7F, the protruding introduction portion 103C protrudes farther in the −Y axis direction than the region of overlap with the waste liquid absorbing unit 28. In the tank 7F, the protruding introduction portion 103C extends in the −Y axis direction beyond the region of overlap with the waste liquid absorbing unit 28, and reaches a region of overlap with the mechanism unit 26. Specifically, in a plan view of the mechanism unit 26 of the liquid ejection system 1 in the −Z axis direction when in the in-use orientation, at least a portion of the air introduction portion 99 of the tank 7F is overlapped with the region of the mechanism unit 26. In other words, in the in-use orientation, at least a portion of the air introduction portion 99 of the tank 7F is located vertically above the mechanism unit 26.

Figure 25:
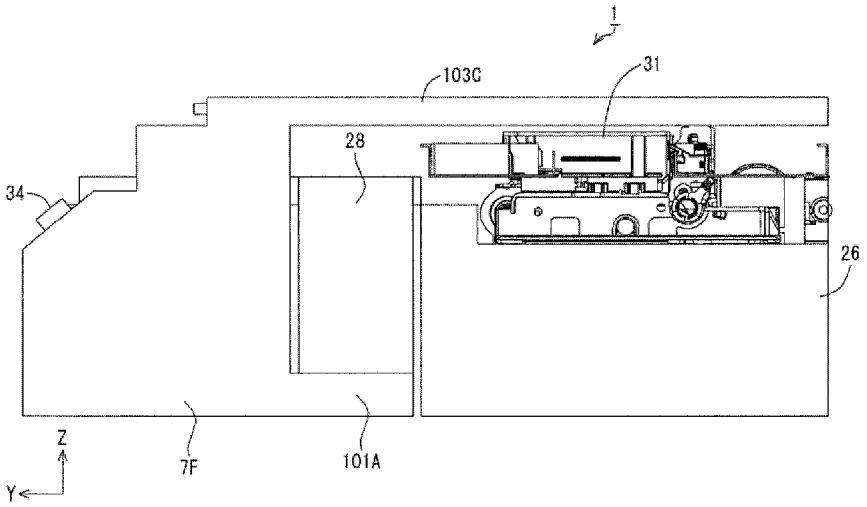
FIG. 25 is a side view of the liquid ejection system in which the tank of Working Example 1-6 is mounted.

Note that in Working Example 1-6, as shown in FIG. 25, the protruding introduction portion 103C of the tank 7F extends beyond a region of overlap with the movable region of the recording portion 31 in the mechanism unit 26. Furthermore, in the example shown in FIG. 25, the protruding introduction portion 103C of the tank 7F extends across the region of the mechanism unit 26 along the Y axis.

According to Working Example 1-6, the amount of ink that can be stored in the tank 7F is more readily increased while also mitigating an increase in the projected area (footprint) of the mechanism unit 26 and the tank 7F in a plan view. Accordingly, an increase in the size of the liquid ejection system 1 is more readily mitigated.

According to Working Examples 1-4 to 1-6, the amount of ink that can be stored in the buffer chamber 97 of the tank 7 is readily increased while also mitigating an increase in the projected area (footprint) of the liquid ejection system 1 in a plan view. For this reason, it is possible to avoid increasing the amount of ink that can be stored in the buffer chamber 97 of the tank 7 by extending the tank 7 in the X axis direction or extending the tank 7 in the Y axis direction for example. For example, with a configuration in which the tank 7 is extended in the X axis direction, it is thought that the tank 7 protrudes farther in the X axis direction than the mechanism unit 26 in a plan view of the liquid ejection system 1 in the −Z axis direction. According to Working Examples 1-4 to 1-6, it is possible to avoid this, and the position of the tank 7 in the X axis direction can be set farther on the −X axis direction side than the position of the mechanism unit 26 in the X axis direction.

Note that in Working Examples 1-4 to 1-6, the protruding introduction portion 103A, the protruding introduction portion 103B, and the protruding introduction portion 103C are located on the Z axis direction side of the waste liquid absorbing unit 28. However, the protruding introduction portion 103A, the protruding introduction portion 103B, and the protruding introduction portion 103C are not limited to these positions, and may be located on the −Z axis direction side of the waste liquid absorbing unit 28, for example. With this configuration, the positions of the protruding introduction portion 103A, the protruding introduction portion 103B, and the protruding introduction portion 103C in the tank 7 need only be set shifted in the −Z axis direction.

Also, in Working Example 1-5 and Working Example 1-6, the protruding introduction portion 103B and the protruding introduction portion 103C are located on the Z axis direction side of the mechanism unit 26. However, the protruding introduction portion 103B and the protruding introduction portion 103C are not limited to these positions, and may be located on the −Z axis direction side of the mechanism unit 26, for example. With this configuration, the positions of the protruding introduction portion 103B and the protruding introduction portion 103C in the tank 7 need only be set shifted in the −Z axis direction.

Working Examples 1-4 to 1-6 illustrate configurations in which the protruding introduction portion 103A, the protruding introduction portion 103B, and the protruding introduction portion 103C are applied to the tank 7A of Working Example 1-1. However, the configuration of the tank 7 is not limited to these examples. The tank 7 may have a configuration in which the protruding introduction portion 103A, the protruding introduction portion 103B, or the protruding introduction portion 103C of Working Examples 1-4 to 1-6 are applied to the tank 7B of Working Example 1-2 or the tank 7C of Working Example 1-3. The following describes examples in which the protruding introduction portion 103A, the protruding introduction portion 103B, and the protruding introduction portion 103C of Working Examples 1-4 to 1-6 are applied to the tank 7B and the tank 7C.

Working Example 1-7

A tank 7G of Working Example 1-7 has a configuration in which the protruding introduction portion 103A of Working Example 1-4 is applied to the tank 7B of Working Example 1-2. With the exception of the above point, Working Example 1-7 has the same configuration as Working Example 1-2 and Working Example 1-4. In the following, configurations that are the same as configurations in Working Example 1-2 and Working Example 1-4 will be denoted by the same reference signs as in Working Example 1-2 and Working Example 1-4, and will not be described in detail.

Figure 26:
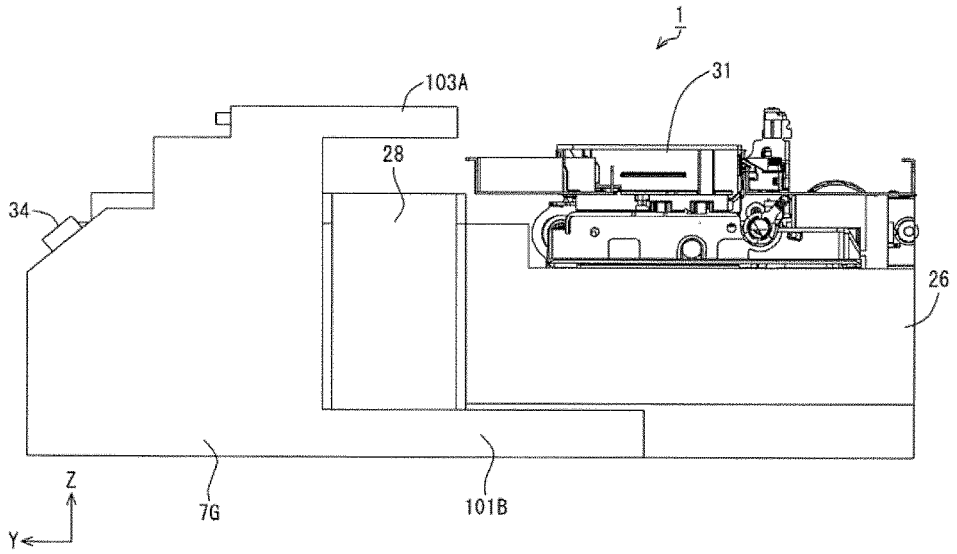
FIG. 26 is a side view of a liquid ejection system in which a tank of Working Example 1-7 is mounted.

As shown in FIG. 26, the tank 7G has the protruding storage portion 101B and the protruding introduction portion 103A. The protruding storage portion 101B extends in the −Y axis direction beyond the region of overlap with the waste liquid absorbing unit 28, and reaches a region of overlap with the mechanism unit 26. Also, the protruding introduction portion 103A is overlapped with the region of the waste liquid absorbing unit 28. The same effects as in Working Example 1-2 and Working Example 1-4 are obtained in Working Example 1-7 as well.

Working Example 1-8

A tank 7H of Working Example 1-8 has a configuration in which the protruding introduction portion 103B of Working Example 1-5 is applied to the tank 7B of Working Example 1-2. With the exception of the above point, Working Example 1-8 has the same configuration as Working Example 1-2 and Working Example 1-5. In the following, configurations that are the same as configurations in Working Example 1-2 and Working Example 1-5 will be denoted by the same reference signs as in Working Example 1-2 and Working Example 1-5, and will not be described in detail.

Figure 27:
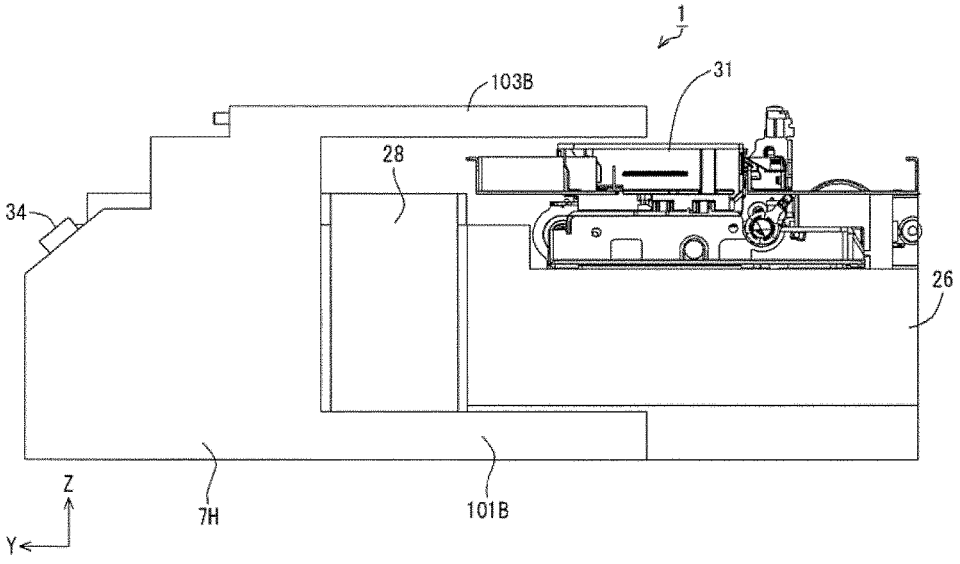
FIG. 27 is a side view of a liquid ejection system in which a tank of Working Example 1-8 is mounted.

As shown in FIG. 27, the tank 7H has the protruding storage portion 101B and the protruding introduction portion 103B. The protruding storage portion 101B extends in the −Y axis direction beyond the region of overlap with the waste liquid absorbing unit 28, and reaches a region of overlap with the mechanism unit 26. Also, the protruding introduction portion 103B extends in the −Y axis direction beyond the region of overlap with the waste liquid absorbing unit 28, and reaches a region of overlap with the mechanism unit 26. The same effects as in Working Example 1-2 and Working Example 1-5 are obtained in Working Example 1-8 as well.

Working Example 1-9

A tank 7J of Working Example 1-9 has a configuration in which the protruding introduction portion 103C of Working Example 1-6 is applied to the tank 7B of Working Example 1-2. With the exception of the above point, Working Example 1-9 has the same configuration as Working Example 1-2 and Working Example 1-6. In the following, configurations that are the same as configurations in Working Example 1-2 and Working Example 1-6 will be denoted by the same reference signs as in Working Example 1-2 and Working Example 1-6, and will not be described in detail.

Figure 28:
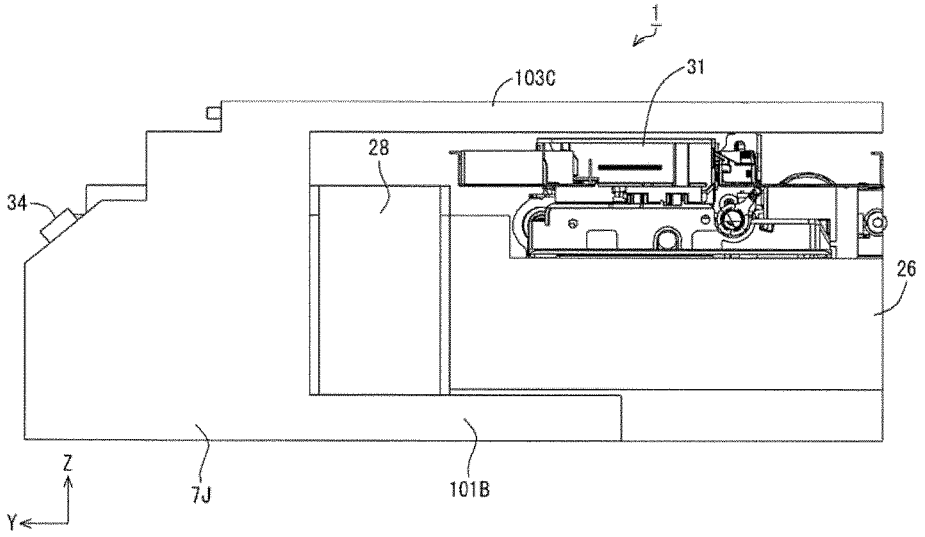
FIG. 28 is a side view of a liquid ejection system in which a tank of Working Example 1-9 is mounted.

As shown in FIG. 28, the tank 7J has the protruding storage portion 101B and the protruding introduction portion 103C. The protruding storage portion 101B extends in the −Y axis direction beyond the region of overlap with the waste liquid absorbing unit 28, and reaches a region of overlap with the mechanism unit 26. Also, the protruding introduction portion 103C extends beyond a region of overlap with the movable region of the recording portion 31 in the mechanism unit 26, and extends across the region of the mechanism unit 26 along the Y axis. The same effects as in Working Example 1-2 and Working Example 1-6 are obtained in Working Example 1-9 as well.

Working Example 1-10

A tank 7K of Working Example 1-10 has a configuration in which the protruding introduction portion 103A of Working Example 1-4 is applied to the tank 7C of Working Example 1-3. With the exception of the above point, Working Example 1-10 has the same configuration as Working Example 1-3 and Working Example 1-4. In the following, configurations that are the same as configurations in Working Example 1-3 and Working Example 1-4 will be denoted by the same reference signs as in Working Example 1-3 and Working Example 1-4, and will not be described in detail.

Figure 29:
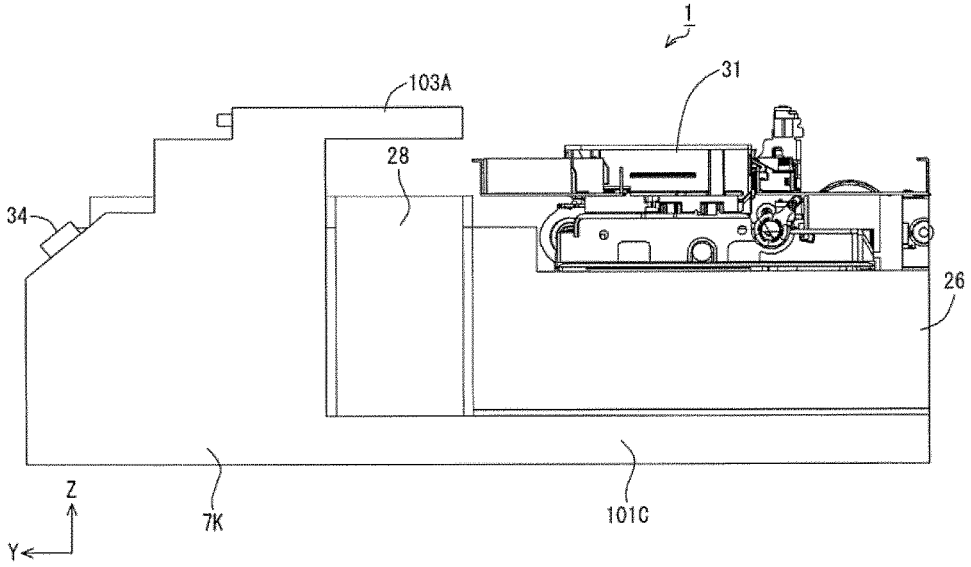
FIG. 29 is a side view of a liquid ejection system in which a tank of Working Example 1-10 is mounted.

As shown in FIG. 29, the tank 7K has the protruding storage portion 101C and the protruding introduction portion 103A. Also, the protruding storage portion 101C extends beyond a region of overlap with the movable region of the recording portion 31 in the mechanism unit 26, and extends across the region of the mechanism unit 26 along the Y axis. Also, the protruding introduction portion 103A is overlapped with the region of the waste liquid absorbing unit 28. The same effects as in Working Example 1-3 and Working Example 1-4 are obtained in Working Example 1-10 as well.

Working Example 1-11

A tank 7L of Working Example 1-11 has a configuration in which the protruding introduction portion 103B of Working Example 1-5 is applied to the tank 7C of Working Example 1-3. With the exception of the above point, Working Example 1-11 has the same configuration as Working Example 1-3 and Working Example 1-5. In the following, configurations that are the same as configurations in Working Example 1-3 and Working Example 1-5 will be denoted by the same reference signs as in Working Example 1-3 and Working Example 1-5, and will not be described in detail.

Figure 30:
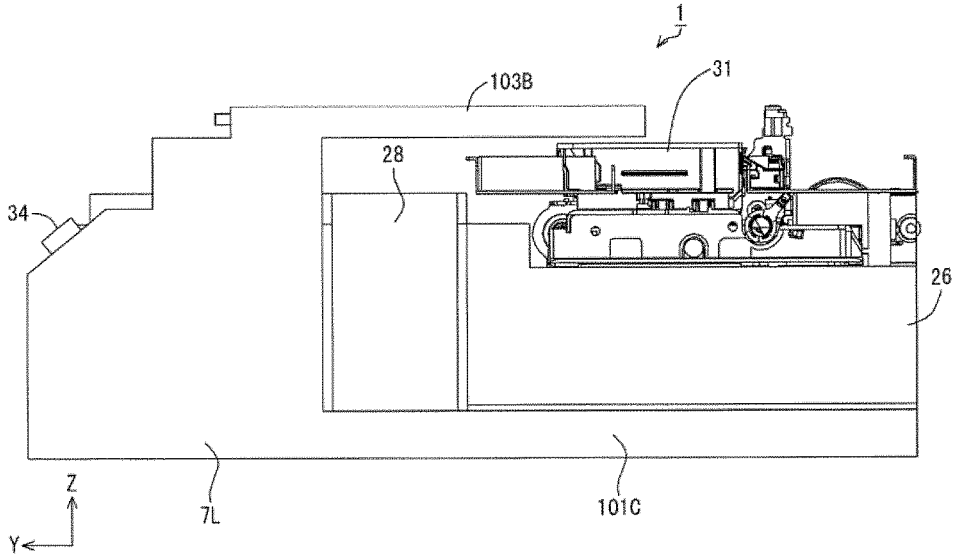
FIG. 30 is a side view of a liquid ejection system in which a tank of Working Example 1-11 is mounted.

As shown in FIG. 30, the tank 7L has the protruding storage portion 101C and the protruding introduction portion 103B. Also, the protruding storage portion 101C extends beyond a region of overlap with the movable region of the recording portion 31 in the mechanism unit 26, and extends across the region of the mechanism unit 26 along the Y axis. Also, the protruding introduction portion 103B extends in the −Y axis direction beyond the region of overlap with the waste liquid absorbing unit 28, and reaches a region of overlap with the mechanism unit 26. The same effects as in Working Example 1-3 and Working Example 1-5 are obtained in Working Example 1-11 as well.

Working Example 1-12

A tank 7M of Working Example 1-12 has a configuration in which the protruding introduction portion 103C of Working Example 1-6 is applied to the tank 7C of Working Example 1-3. With the exception of the above point, Working Example 1-12 has the same configuration as Working Example 1-3 and Working Example 1-6. In the following, configurations that are the same as configurations in Working Example 1-3 and Working Example 1-6 will be denoted by the same reference signs as in Working Example 1-3 and Working Example 1-6, and will not be described in detail.

Figure 31:
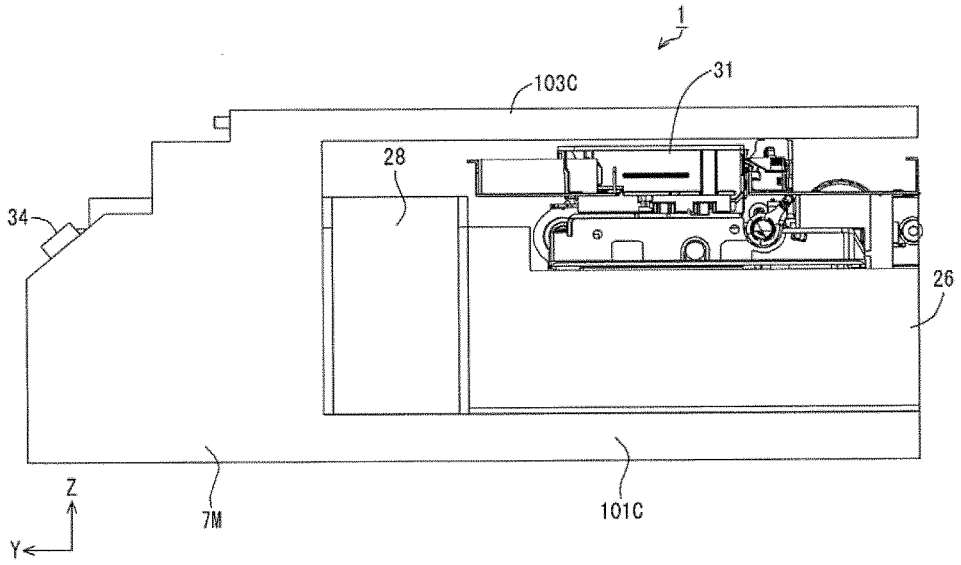
FIG. 31 is a side view of a liquid ejection system in which a tank of Working Example 1-12 is mounted.

As shown in FIG. 31, the tank 7M has the protruding storage portion 101C and the protruding introduction portion 103C. Also, the protruding storage portion 101C extends beyond a region of overlap with the movable region of the recording portion 31 in the mechanism unit 26, and extends across the region of the mechanism unit 26 along the Y axis. Also, the protruding introduction portion 103C extends beyond a region of overlap with the movable region of the recording portion 31 in the mechanism unit 26, and extends across the region of the mechanism unit 26 along the Y axis. The same effects as in Working Example 1-3 and Working Example 1-6 are obtained in Working Example 1-12 as well.

In Working Examples 1-1 to 1-12, it is preferable that the volume of the region including the buffer chamber 97 and the flow channel 98 in the air introduction portion 99 is equivalent to the volume of the liquid storage portion 68, or greater than the volume of the liquid storage portion 68. According to this configuration, even if ink in the liquid storage portion 68 flows into the air introduction portion 99 for example, the flowing ink can be stored in the air introduction portion 99, thus more readily avoiding the leakage of ink from the liquid storage portion 68 to the outside of the tank 7 via the air introduction portion 99.

In Working Examples 1-1 to 1-12, the air introduction portion 99 is constituted as a portion of the tank 7. For this reason, the air introduction portion 99 is integrated with the tank 7. However, the configuration of the air introduction portion 99 is not limited to these examples. A configuration is possible in which at least a portion of the air introduction portion 99 can be separated from the tank 7. An example in which a portion of the air introduction portion 99 can be separated from the tank 7 will be described below as Working Example 1-13.

Working Example 1-13

Figure 32:
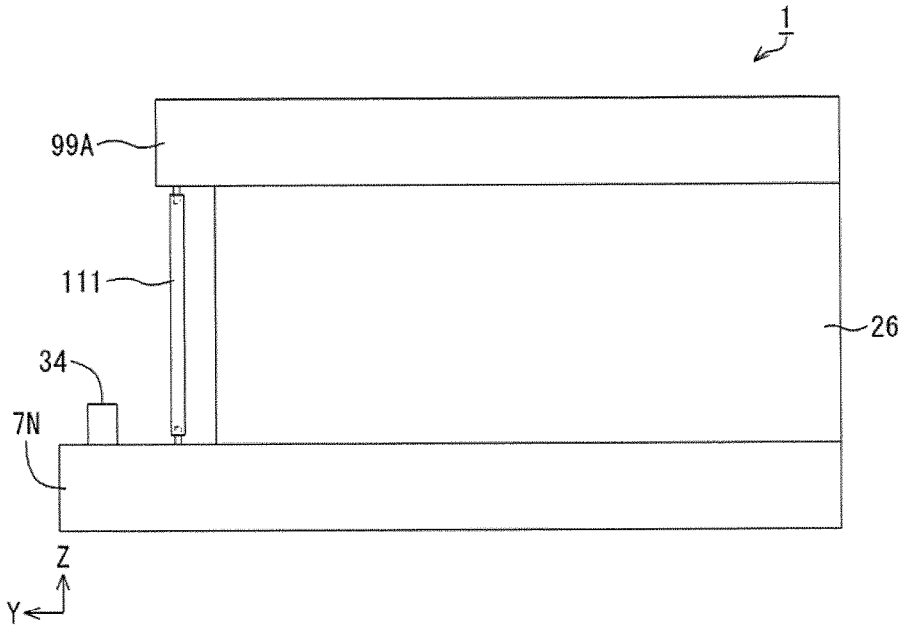
FIG. 32 is a side view schematically showing a liquid ejection system in which an air introduction portion and a tank of Working Example 1-13 are installed.

In Working Example 1-13, a tank 7N and an air introduction portion 99A are configured as separate bodies as shown in FIG. 32, which is a side view schematically showing the liquid ejection system 1. In the in-use orientation of the liquid ejection system 1, a portion of the tank 7N excluding the liquid injection portion 34 is overlapped with the region of the mechanism unit 26. In the example shown in FIG. 32, a portion of the tank 7N excluding the liquid injection portion 34 is located vertically below the mechanism unit 26.

The air introduction portion 99A is located on the Z axis direction side of the mechanism unit 26. At least a portion of the air introduction portion 99A is overlapped with the region of the mechanism unit 26. In the example shown in FIG. 32, a portion of the air introduction portion 99A is located vertically above the mechanism unit 26. The liquid storage portion 68 of the tank 7N and the air introduction portion 99A are connected via a connection portion 111, which is an example of a connection portion. In other words, the liquid storage portion 68 of the tank 7N and the air introduction portion 99A are in communication via the connection portion 111. Accordingly, air can be introduced into the liquid storage portion 68 of the tank 7 via the air introduction portion 99A and the connection portion 111.

In this working example, the connection portion 111 is located outside of the mechanism unit 26. Accordingly, the connection portion 111 can be arranged outside of the path along which the relative positions of the recording head and the recording medium P change. Accordingly, it is possible to avoid the case where the connection portion 111 hinders change in the relative positions of the recording head and the recording medium P. Note that the connection portion 111 is not limited to being arranged outside of the mechanism unit 26. The arrangement of the connection portion 111 may involve the inside of the mechanism unit 26 as long as the connection portion 111 is outside of the path along which the relative positions of the recording head and the recording medium P change.

In this working example, the tank 7N and the air introduction portion 99A can be separated from each other by disconnecting the connection between the tank 7N and the air introduction portion 99A by the connection portion 111. According to this configuration, it is possible to add the air introduction portion 99 to the tank 7 or extend the air introduction portion 99. Also, the tank 7N and the air introduction portion 99A are connected via the connection portion 111, thus making it possible to easily change the position of the air introduction portion 99A relative to the tank 7N. Accordingly, it is possible to raise the degree of freedom regarding the position of the air introduction portion 99A relative to the tank 7N.

Also, by employing a flexible tube as the connection portion 111, it is possible to raise the degree of freedom regarding the piping route of the connection portion 111. Accordingly, it is possible to facilitate arrangement in a narrow space between the mechanism unit 26 and the casing 6 of the liquid ejection system 1, a narrow space inside the mechanism unit 26, and the like.

Figure 33:
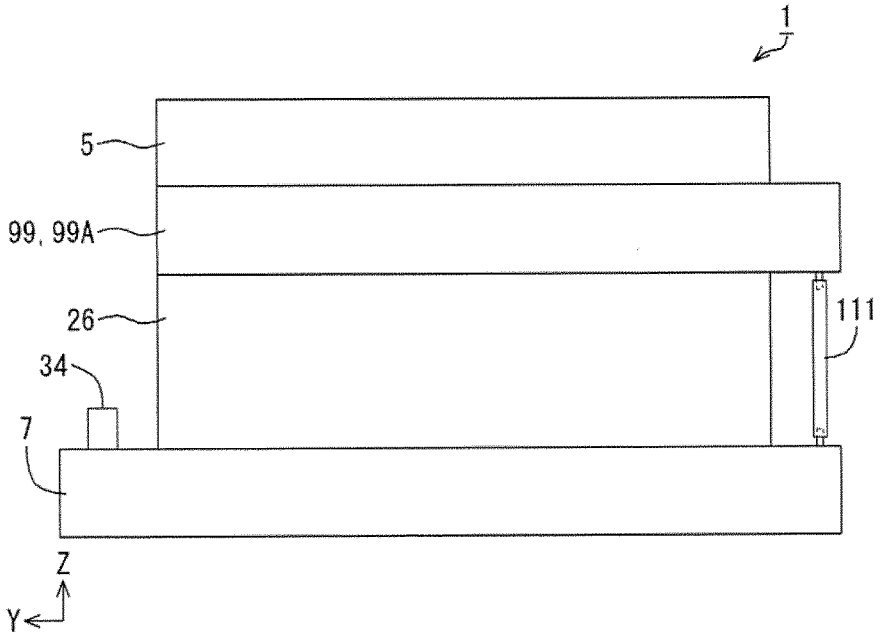
FIG. 33 is a side view schematically showing an example of another configuration of the liquid ejection system according to the first embodiment.

In Working Examples 1-4 to 1-13 of the first embodiment, a configuration is possible in which portions of the air introduction portion 99 and the air introduction portion 99A that are located on the Z axis direction side of the mechanism unit 26 are located on the −Z axis direction side of the scanner unit 5 as shown in FIG. 33. With this configuration, in the in-use orientation of the liquid ejection system 1, the portions of the air introduction portion 99 and the air introduction portion 99A that are overlapped with the region of the mechanism unit 26 are located vertically below the scanner unit 5. According to this configuration, an increase in the projected area (footprint) of the scanner unit 5, the air introduction portion 99, the air introduction portion 99A, and the mechanism unit 26 in a plan view is readily mitigated.

Figure 34:
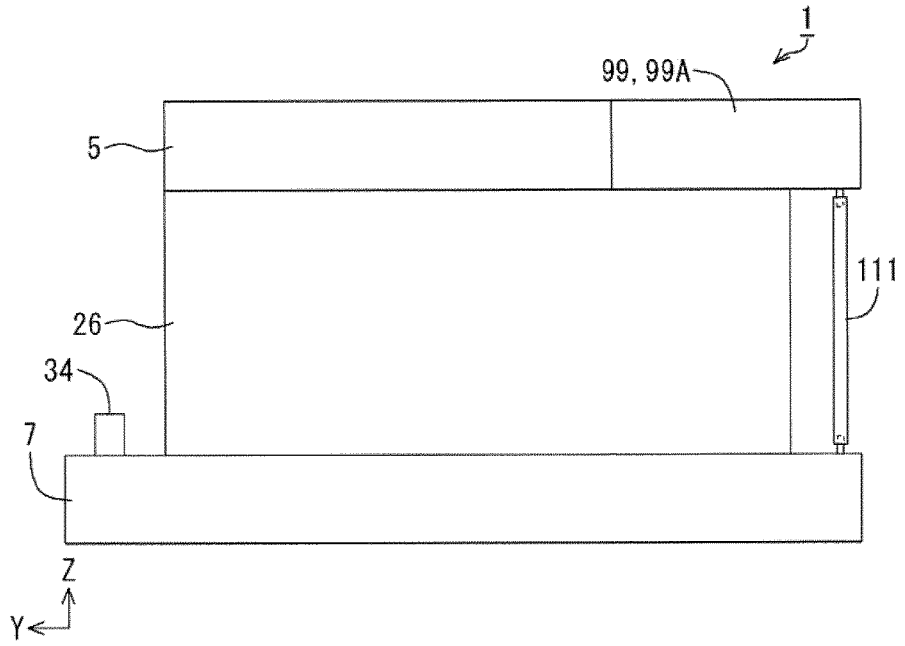
FIG. 34 is a side view schematically showing an example of yet another configuration of the liquid ejection system according to the first embodiment.

In Working Examples 1-4 to 1-12 of the first embodiment, a configuration is possible in which portions of the air introduction portion 99 and the air introduction portion 99A that are located on the Z axis direction side of the mechanism unit 26 are located to one side of the scanner unit 5 as shown in FIG. 34. With this configuration, in the in-use orientation of the liquid ejection system 1, the portions of the air introduction portion 99 and the air introduction portion 99A that are overlapped with the region of the mechanism unit 26 are located to one side of the scanner unit 5. According to this configuration, an increase in the thickness of the liquid ejection system 1 is readily mitigated. Accordingly, an increase in the size of the liquid ejection system 1 is readily mitigated.

Second Embodiment

Figure 35:
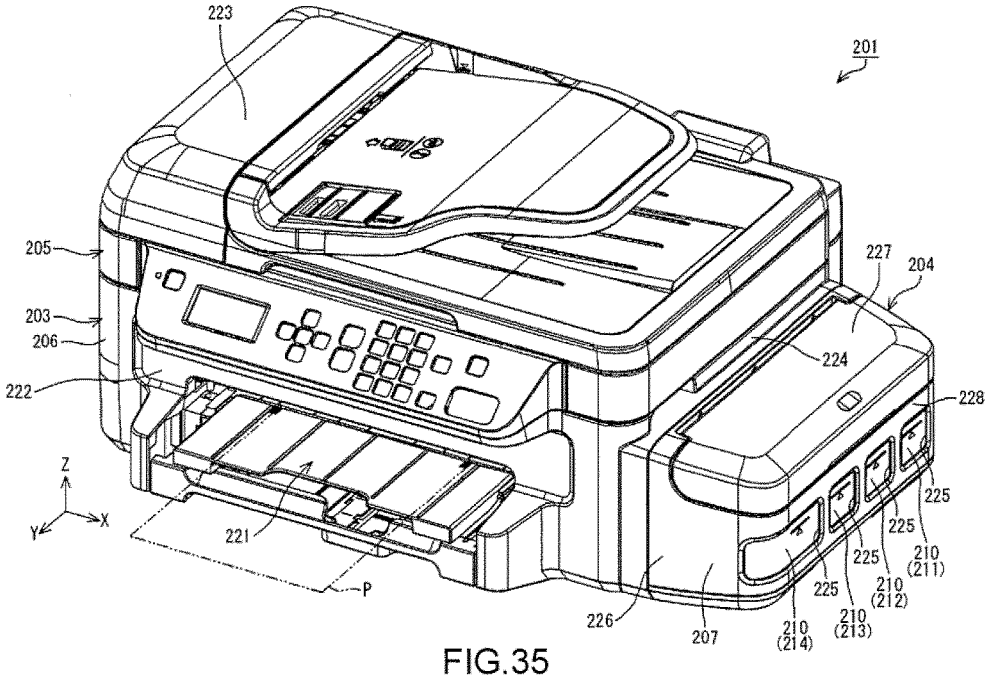
FIG. 35 is a perspective view of the relevant configuration of a liquid ejection system according to a second embodiment.

As shown in FIG. 35, a liquid ejection system 201 of this embodiment has a printer 203 as one example of a liquid ejection device, an ink supply apparatus 204 as one example of a liquid supply apparatus, and a scanner unit 205. The printer 203 has a casing 206. The casing 206 constitutes the outer shell of the printer 203. A mechanism unit (described later) of the printer 203 is stored inside the casing 206. The ink supply apparatus 204 has a casing 207, which is one example of a liquid container mounting portion, and multiple (two or a number greater than two) tanks 210. Note that in this embodiment, four tanks 210 are provided. The casing 206, the casing 207, and the scanner unit 205 constitute the outer shell of the liquid ejection system 201. Note that the liquid ejection system 201 can also have a configuration that omits the scanner unit 205. The tank 210 is one example of a liquid storage container. The liquid ejection system 201 can perform printing on a recording medium P such as a recording sheet using ink as one example of a liquid.

FIG. 35 includes X, Y, and Z axes that are mutually orthogonal coordinate axes. The X, Y, and Z axes are included as necessary in the other figures referenced below as well. In such cases, the X, Y, and Z axes in these figures correspond to the X, Y, and Z axes in FIG. 35. FIG. 35 shows a state in which the liquid ejection system 201 is arranged on an XY plane defined by the X axis and the Y axis. In this embodiment, a state in which the XY plane matches the horizontal plane and the liquid ejection system 201 is arranged on the XY plane is the in-use state of the liquid ejection system 201. The orientation of the liquid ejection system 201 when the liquid ejection system 201 is arranged on the XY plane that matches the horizontal plane will be referred to as the in-use orientation of the liquid ejection system 201.

The terms "X axis", "Y axis", and "Z axis" used to indicate constituent parts and units of the liquid ejection system 201 in the figures and descriptions given below refer to the X axis, the Y axis, and the Z axis in a state in which the constituent parts and units have been incorporated (mounted) in the liquid ejection system 201. Also, the orientations of the constituent parts and units in the in-use orientation of the liquid ejection system 201 will be referred to as the in-use orientations of the constituent parts and units. Moreover, the descriptions of the liquid ejection system 201, the constituent parts and units thereof, and the like given below are assumed to be descriptions in the in-use orientations thereof unless particularly stated otherwise.

The Z axis is the axis that is orthogonal to the XY plane. In the in-use state of the liquid ejection system 201, the Z axis direction is the vertically upward direction. Also, in the in-use state of the liquid ejection system 201, the −Z axis direction is the vertically downward direction in FIG. 35. Note that the directions of the arrows on the X, Y, and Z axes indicate + (positive) directions, and the directions opposite to the arrow directions indicate − (negative) directions. Note that the four tanks 210 mentioned above are arranged side-by-side along the −Y axis. For this reason, the Y axis direction can also be defined as the direction along which the four tanks 210 are aligned. In the first embodiment, four tanks 7 are arranged side-by-side along the X axis. The first embodiment and the second embodiment are different from each other in this respect.

In the liquid ejection system 201, the printer 203 and the scanner unit 205 are overlapped with each other. When the printer 203 is used, the scanner unit 205 is located vertically above the printer 203. The scanner unit 205 is a flatbed type of scanner unit, and has an imaging device (not shown) such as an image sensor. The scanner unit 205 can read images and the like recorded on a medium such as a sheet, as image data via the imaging device. For this reason, the scanner unit 205 functions as a reading apparatus for reading images and the like. The scanner unit 205 is configured to be capable of pivoting relative to the printer 203. The scanner unit 205 also functions as a cover for the printer 203. An operator can pivot the scanner unit 205 relative to the printer 203 by lifting the scanner unit 205 in the Z axis direction. Accordingly, the scanner unit 205 that functions as a cover for the printer 203 can be opened relative to the printer 203.

The printer 203 is provided with a sheet discharge portion 221. A recording medium P is discharged from the sheet discharge portion 221 of the printer 203. The surface of the printer 203 on which the sheet discharge portion 221 is provided is considered to be a front surface 222. The liquid ejection system 201 also has an upper surface 223 that intersects the front surface 222, and a side portion 224 that intersects the front surface 222 and the upper surface 223. The ink supply apparatus 204 is provided on a side portion 224. The casing 207 is provided with window portions 225. The window portions 225 are provided in a side portion 228 that intersects a front surface 226 and an upper surface 227 in the casing 207.

The window portions 225 have translucency. Also, the four tanks 210 described above are provided at positions that are overlapped with the window portions 225. For this reason, the operator who is using the liquid ejection system 201 can view the four tanks 210 through the window portions 225. In this embodiment, the window portions 225 are provided as openings formed in the casing 207. For this reason, the operator can view the four tanks 210 through the window portions 225, which are openings. Note that the window portions 225 are not limited to being openings, and may be configured by members that have translucency, for example.

In this embodiment, at least a portion of the section of each of the tanks 210 that faces the window portion 225 has translucency. The ink in the tanks 210 can be viewed through the sections of the tanks 210 that have translucency. Accordingly, by viewing the four tanks 210 through the window portions 225, the operator can view the amount of ink in the tanks 210. In other words, at least a portion of the section of the tank 210 that faces the window portion 225 can be utilized as a viewing portion that allows viewing of the amount of ink.

Figure 36:
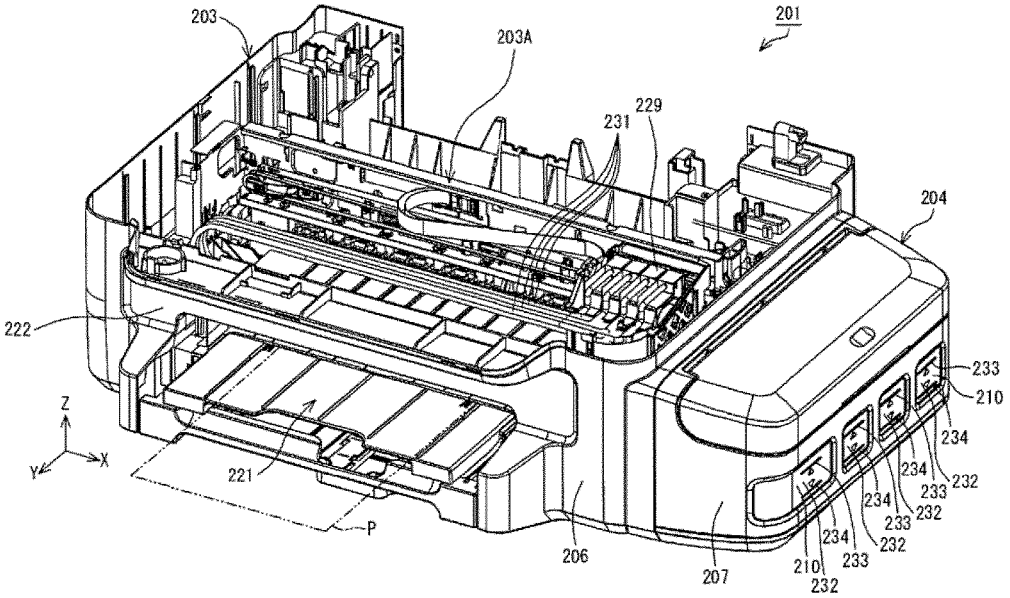
FIG. 36 is a perspective view of the relevant configuration of the liquid ejection system according to the second embodiment.

As shown in FIG. 36, the printer 203 has a mechanism unit 203A. The mechanism unit 203A has a recording portion 229. In the printer 203, the recording portion 229 is accommodated in the casing 206. The recording portion 229 performs recording on a recording medium P, which is conveyed in the Y axis direction by a conveying apparatus (not shown), using ink as one example of a liquid. Note that the conveying apparatus (not shown) intermittently conveys the recording medium P (a recording sheet or the like) in the Y axis direction. The recording portion 229 is configured to be able to be moved back and forth along the X axis by a moving apparatus (not shown). The ink supply apparatus 204 supplies ink to the recording portion 229. Note that in the liquid ejection system 201, at least a portion of the ink supply apparatus 204 protrudes outward from the casing 206. Note that the recording portion 229 is accommodated in the casing 206. Accordingly, the recording portion 229 can be protected by the casing 206.

Here, the term "direction along the X axis" is not limited to a direction that is completely parallel with the X axis, and also encompasses directions that are inclined relative to the X axis by a margin of error, a tolerance, or the like, while excluding a direction that is orthogonal to the X axis. Similarly, the term "direction along the Y axis" is not limited to a direction that is completely parallel with the Y axis, and also encompasses directions that are inclined relative to the Y axis by a margin of error, a tolerance, or the like, while excluding a direction that is orthogonal to the Y axis. The term "direction along the Z axis" is not limited to a direction that is completely parallel with the Z axis, and also encompasses directions that are inclined relative to the Z axis by a margin of error, a tolerance, or the like, while excluding a direction that is orthogonal to the Z axis. In other words, directions along any axis or plane are not limited to directions that are completely parallel to such axes or planes, and also encompass directions that are inclined relative to such axes or planes by a margin of error, a tolerance, or the like, while excluding directions that are orthogonal to such axes or planes.

The ink supply apparatus 204 has the tanks 210 as one example of a liquid storage container. In this embodiment, the ink supply apparatus 204 has multiple (four in this embodiment) tanks 210. The tanks 210 each protrude outward from the casing 206 of the printer 203. The tanks 210 are accommodated inside the casing 207. Accordingly, the tanks 210 can be protected by the casing 207. The casing 207 protrudes from the casing 206.

Note that in this embodiment, the ink supply apparatus 204 has multiple (four) tanks 210. However, the number of tanks 210 is not limited to four, and the number of tanks that are employed can be three, a number lower than three, or a number greater than four.

Furthermore, in this embodiment, the tanks 210 are configured to be separate from each other. However, the configuration of the tanks 210, which are one example of a liquid storage container, is not limited in this way. The liquid storage container can be configured as a single liquid storage container in which the tanks 210 are integrated. In this case, one liquid storage container is provided with multiple liquid storage portions. The liquid storage portions are configured to be individually separated from each other and be able to store different types of liquids. In this case, for example, different colors of ink can be separately stored in respective liquid storage portions.

As shown in FIG. 36, ink supply tubes 231 are respectively connected to the tanks 210. Ink in the tanks 210 is supplied from the ink supply apparatus 204 to the recording portion 229 via ink supply tubes 231. The recording portion 229 is provided with a recording head (not shown), which is one example of a liquid ejection head. Nozzle openings (not shown) that face the recording medium P are formed in the recording head. Ink supplied from the ink supply apparatus 204 to the recording portion 229 via the ink supply tubes 231 is supplied to the recording head. The ink supplied to the recording portion 229 is then discharged as ink droplets from the nozzle openings of the recording head toward the recording medium P. Note that although the printer 203 and the ink supply apparatus 204 are described as individual configurations in the above example, the ink supply apparatus 204 can also be included in the configuration of the printer 203.

Note that the tanks 210 may have a configuration in which upper limit marks 233, lower limit marks 234, and the like are provided on a viewing surface 232 that enables viewing of the stored amount of ink. The viewing surface 232 is one example of a viewing portion. Also, the upper limit mark 233 is one example of an upper limit indicator portion. The operator can find out the amount of ink in the tanks 210 by using the upper limit marks 233 and the lower limit marks 234 as a guide. Note that the upper limit marks 233 indicate a guide regarding the amount of ink that can be injected through later-described liquid injection portions 235 (FIG. 37) without overflowing from the liquid injection portions 235. Also, the lower limit marks 234 indicate a guide regarding an ink amount for prompting ink injection. A configuration is possible in which only either the upper limit marks 233 or the lower limit marks 234 are provided on the tanks 210.

Also, the casing 207 and the casing 206 may be separate from each other, or may be integrated. In the case where the casing 207 and the casing 206 are integrated with each other, the tanks 210 can be accommodated inside the casing 206 along with the recording portion 229 and the ink supply tubes 231. In the case where the casing 207 and the casing 206 are integrated with each other, the casing 206 corresponds to an exterior portion that accommodates the liquid storage containers and the liquid ejection head.

Also, the tanks 210 are not limited to be arranged on the side surface on the X axis direction side of the casing 206. A configuration is possible in which the tanks 210 are arranged on the front surface on the Y axis direction side of the casing 206, for example.

Also, in this embodiment, the tanks 210 are configured to be separate from each other. However, the configuration of the tanks 210 is not limited in this way. The tank 210 can have a configuration in which the tanks 210 are integrated. In this case, the one tank 210 is provided with multiple ink chambers. The ink chambers are configured to be individually separated from each other and be able to store different types of ink. In this case, for example, different colors of ink can be separately stored in respective ink chambers.

In the liquid ejection system 201 having the above-described configuration, recording is performed on the recording medium P by causing the recording head of the recording portion 229 to discharge ink droplets at predetermined positions on the recording medium P while conveying the recording medium P in the Y axis direction as well as moving the recording portion 229 back and forth along the X axis.

The ink is not limited to being either water-based ink or oil-based ink. Also, water-based ink may have a configuration in which a solute such as a dye is dissolved in an aqueous solvent, or may have a configuration in which a dispersoid such as a pigment is dispersed in an aqueous dispersion medium. Also, oil-based ink may have a configuration in which a solute such as a dye is dissolved in an oil-based solvent, or may have a configuration in which a dispersoid such as a pigment is dispersed in an oil-based dispersion medium.

Figure 37:
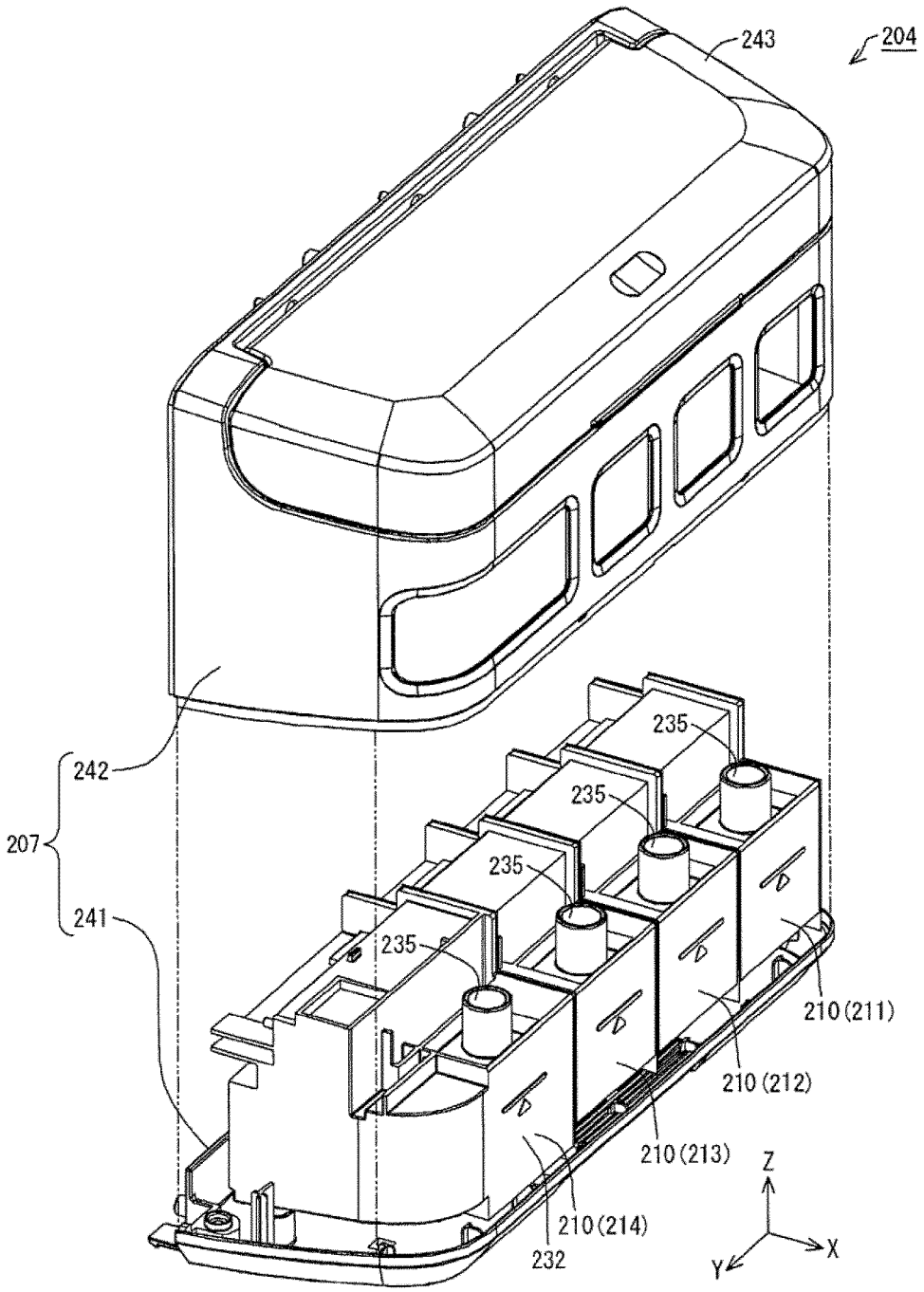
FIG. 37 is an exploded perspective view of the relevant configuration of an ink supply apparatus according to the second embodiment.

As shown in FIG. 37, the casing 207 of the ink supply apparatus 204 includes a first casing 241 and a second casing 242. A liquid injection portion 235 is formed in each of the tanks 210. With the tank 210, ink can be injected into the tank 210 from outside the tank 210 via the liquid injection portions 235. Note that the operator can access the liquid injection portions 235 of the tanks 210 from outside of the casing 207.

Here, the X axis, the Y axis, and the Z axis in FIG. 37 correspond to the X axis, the Y axis, and the Z axis for the liquid ejection system 201 shown in FIG. 35. In other words, the X axis, the Y axis, and the Z axis in FIG. 37 refer to the X axis, the Y axis, and the Z axis in a state in which the ink supply apparatus 204 has been incorporated in the liquid ejection system 201. Hereinafter, when the X axis, the Y axis, and the Z axis are used in figures showing constituent parts and units of the liquid ejection system 201, they refer to the X axis, the Y axis, and the Z axis in a state in which the constituent parts and units have been incorporated (mounted) in the liquid ejection system 201. Also, the orientations of the constituent parts and units in the in-use orientation of the liquid ejection system 201 will be referred to as the in-use orientations of the constituent parts and units.

As shown in FIG. 37, the first casing 241 is located on the −Z axis direction side of the tanks 210. The tanks 210 are supported to the first casing 241. The second casing 242 is located on the Z axis direction side of the first casing 241, and covers the tanks 210 on the Z axis direction side of the first casing 241. The tanks 210 are covered by the first casing 241 and the second casing 242.

In this embodiment, the four tanks 210 are arranged side-by-side along the Y axis. Hereinafter, when individually identifying the four tanks 210, the four tanks 210 will be respectively denoted as a tank 211, a tank 212, a tank 213, and a tank 214. The tank 211, the tank 212, the tank 213, and the tank 214 are arranged side-by-side in the Y axis direction in the stated order. In other words, the tank 212 is located on the Y axis direction side of the tank 211, the tank 213 is located on the Y axis direction side of the tank 212, and the tank 214 is located on the Y axis direction side of the tank 213.

Among the four tanks 210, the tank 211, the tank 212, and the tank 213 have the same shape as each other. The tank 214 has a different shape from the other tanks 210. The volume of the tank 214 is larger than volume of the other tanks 210. With the exception of the above point, the tank 214 has the same configuration as the other tanks 210. This configuration is favorable in the case where, for example, the tank 214 stores a type of ink that has a high frequency of use. This is because the type of ink that has a high frequency of use can be stored in a larger amount than the other types of ink.

Figure 38:
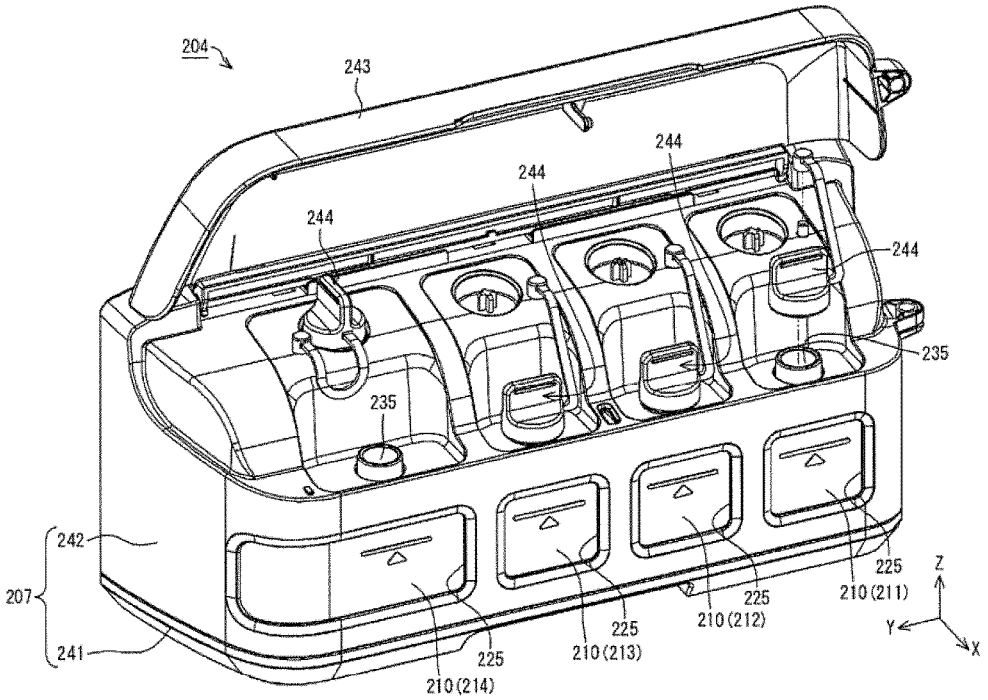
FIG. 38 is a perspective view of the relevant configuration of the ink supply apparatus according to the second embodiment.

The second casing 242 has a cover 243. The cover 243 is located at the end portion, on the Z axis direction side, of the second casing 242. As shown in FIG. 38, the cover 243 is configured to be capable of pivoting relative to the second casing 242. FIG. 38 shows a state in which the cover 243 is opened relative to the second casing 242. When the cover 243 is opened relative to the second casing 242, the liquid injection portions 235 of the tanks 210 are exposed. Accordingly, the operator can access the liquid injection portions 235 of the tanks 210 from outside of the casing 207. Note that the liquid injection portions 235 are sealed by plug members 244. When ink is to be injected into one of the tanks 210, the plug member 244 is detached from the liquid injection portion 235 so as to open the liquid injection portion 235, and then ink is injected. Note that when the liquid ejection system 201 is in the in-use orientation, the liquid injection portion 235 faces a direction upward relative to the horizontal direction.

Various working examples of the tank 210 will be described below. Note that in order to identify the tank 210 in the respective working examples below, different alphabet letters, signs, and the like are appended to reference signs for the tank 210 in each working example. Note that as mentioned above, among the four tanks 210, the tank 214 and the other tanks 210 have the same configuration as each other, with the exception of having different volumes. Hereinafter, working examples of the tank 210 will be described taking the example of the tank 211. The various working examples of the tank 210 described below can be applied to the tank 214 as well. For this reason, a detailed description will not be given for working examples of the tank 214.

Working Example 2-1

Figure 39:
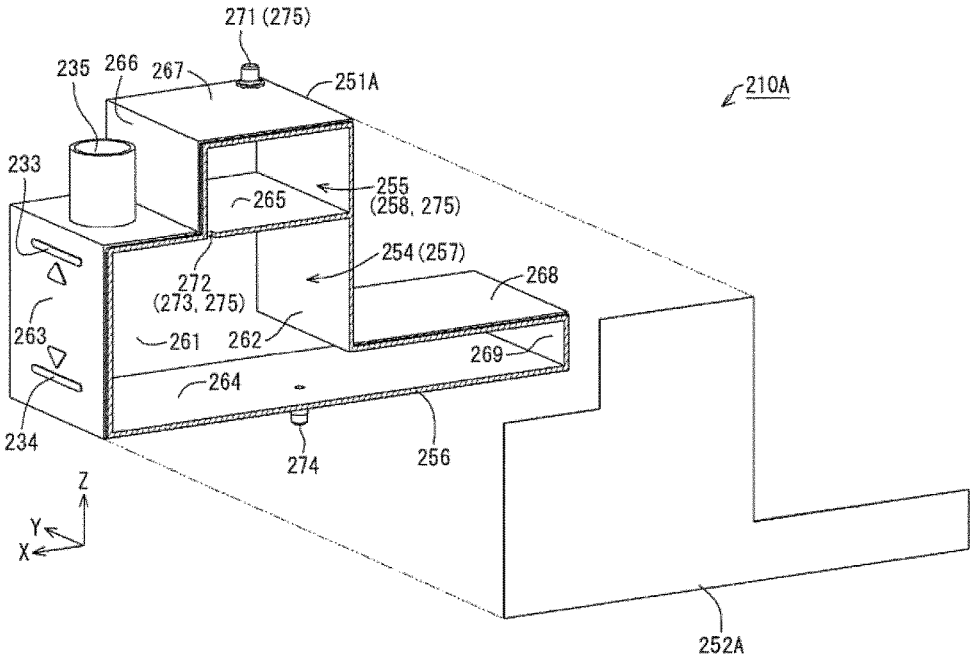
FIG. 39 is an exploded perspective view of a tank in Working Example 2-1.

The following describes a tank 210A of Working Example 2-1. As shown in FIG. 39, the tank 210A has a case 251A, which is one example of a tank main body, and a sheet member 252A. The case 251A is constituted by a synthetic resin such as nylon or polypropylene, for example. Also, the sheet member 252A is formed in the shape of a film using a synthetic resin (e.g., nylon or polypropylene), and is bendable.

A recessed portion 254 and a recessed portion 255 are formed in the case 251A. Also, the case 251A is provided with a joining portion 256. The joining portion 256 is hatched in FIG. 39 in order to facilitate understanding of the configuration. The sheet member 252A is joined to the joining portion 256 of the case 251A. In this embodiment, the case 251A and the sheet member 252A are joined by welding. When the sheet member 252A is joined to the case 251A, the recessed portion 254 and the recessed portion 255 are blocked by the sheet member 252A. The space surrounded by the recessed portion 254 and the sheet member 252A will be referred to as a liquid storage portion 257 (described later). Also, the space surrounded by the recessed portion 255 and the sheet member 252A will be referred to as a buffer chamber 258 (described later).

As shown in FIG. 39, the case 251A has a wall 261, a wall 262, a wall 263, a wall 264, a wall 265, a wall 266, a wall 267, a wall 268, and a wall 269. The recessed portion 254 is located on the −Z axis direction side of the wall 265. The recessed portion 255 is located on the Z axis direction side of the wall 265. The recessed portion 254 and the recessed portion 255 are overlapped along the Z axis with the wall 265 therebetween. The wall 261 of the recessed portion 254 and the wall 261 of the recessed portion 255 are the same wall. In other words, the recessed portion 254 and the recessed portion 255 share the wall 261.

In a plan view of the wall 261 in the Y axis direction, the recessed portion 254 is surrounded by the wall 262, the wall 263, the wall 264, the wall 265, the wall 268, and the wall 269. Also, in a plan view of the wall 261 in the Y axis direction, the recessed portion 255 is surrounded by the wall 262, the wall 265, the wall 266, and the wall 267. Note that the wall 262 of the recessed portion 254 and the wall 262 of the recessed portion 255 are the same wall. In other words, the recessed portion 254 and the recessed portion 255 share the wall 262. Also, the wall 265 of the recessed portion 254 and the wall 265 of the recessed portion 255 are the same wall. In other words, the recessed portion 254 and the recessed portion 255 share the wall 265.

The walls 262 to 269 each intersect the wall 261. The wall 262 and the wall 263 are provided at locations that oppose each other along the X axis with the wall 261 therebetween. Also, the wall 263 and the wall 269 are provided at locations that oppose each other along the X axis with the wall 261 therebetween. The wall 262 is located on the Z axis direction side of the wall 269. The wall 262 and the wall 266 are provided at locations that oppose each other along the X axis with the wall 261 therebetween. The wall 264 and the wall 265 are provided at locations that oppose each other along the Z axis with the wall 261 therebetween. Also, the wall 264 and the wall 268 are provided at locations that oppose each other along the Z axis with the wall 261 therebetween. The wall 265 is located on the Z axis direction side of the wall 268.

The wall 265 and the wall 267 are provided at locations that oppose each other along the Z axis with the wall 261 therebetween. The end portion, on the −Z axis direction side, of the wall 262 intersects the wall 268, the end portion on the Z axis direction side intersects the wall 267, and the wall 262 intersects the wall 265 between the wall 268 and the wall 267. The end portion, on the −Z axis direction side, of the wall 263 intersects the wall 264, and the end portion, on the Z axis direction side, of the wall 263 intersects the wall 265. Also, the end portion, on the −X axis direction side, of the wall 264 intersects the wall 269. The wall 266 intersects the wall 265 and the wall 267. Also, the end portion, on the X axis direction side, of the wall 268 intersects the wall 262, and the end portion, on the −X axis direction side, of the wall 268 intersects the wall 269.

The wall 262, the wall 263, the wall 264, the wall 265, the wall 268, and the wall 269 protrude from the wall 261 in the −Y axis direction. Accordingly, the recessed portion 254 is constituted by the wall 261 as the main wall, and the wall 262, the wall 263, the wall 264, the wall 265, the wall 268, and the wall 269 that extend from the main wall in the −Y axis direction. The recessed portion 254 is constituted so as to recede in the Y axis direction. The recessed portion 254 is open in the −Y axis direction, that is to say toward the sheet member 252A side. In other words, the recessed portion 254 is provided so as to recede in the Y axis direction, that is to say toward the side opposite to the sheet member 252A side. When the sheet member 252A is joined to the case 251A, the recessed portion 254 is blocked by the sheet member 252A, and the liquid storage portion 257 is constituted.

Also, the wall 266 and the wall 267 protrude from the wall 261 in the −Y axis direction. Accordingly, the recessed portion 255 is constituted by the wall 261 as the main wall, and the wall 262, the wall 265, the wall 266, and the wall 267 that extend from the main wall in the −Y axis direction. The recessed portion 255 is constituted so as to recede in the Y axis direction. The recessed portion 255 is open in the −Y axis direction, that is to say toward the sheet member 252A side. In other words, the recessed portion 255 is provided so as to recede in the Y axis direction, that is to say toward the side opposite to the sheet member 252A side. When the sheet member 252A is joined to the case 251A, the recessed portion 255 is blocked by the sheet member 252A, and the buffer chamber 258 is constituted. Note that the walls 261 to 269 are not limited to being flat walls, and may include unevenness. Also, the amounts of protrusion of the walls 262 to 269 from the wall 261 are set to the same amount of protrusion as each other.

The wall 266 and the wall 263 have a level change in the X axis direction. The wall 263 is located on the X axis direction side of the wall 266. In a plan view of the wall 261 from the sheet member 252A side, the liquid injection portion 235 is provided between the wall 263 and the wall 266. The liquid injection portion 235 is provided in the wall 265. Also, the air inlet portion 271 is provided in the wall 267. The air inlet portion 271 is in communication with the interior of the recessed portion 255. Air is introduced into the buffer chamber 258 via the air inlet portion 271.

Also, a notch 272 is formed in a portion of the wall 265 in which the recessed portion 255 and the recessed portion 254 intersect each other. The notch 272 is formed in the end portion, on the −Y axis direction side, of the wall 265. The notch 272 is formed so as to recede in the Y axis direction from the end portion, on the −Y axis direction side, of the wall 265. For this reason, when the sheet member 252A is joined to the case 251A, the recessed portion 254 and the recessed portion 255 are put into communication with each other via the notch 272. The space surrounded by the notch 272 and the sheet member 252A constitutes a flow channel 273 through which air and ink can flow.

In the tank 210A, the liquid storage portion 257 is in communication with the outside of the tank 210A via the flow channel 273, the buffer chamber 258, and the air inlet portion 271. Accordingly, the tank 210A is configured such that air from outside the tank 210A can be introduced into the liquid storage portion 257 via the air inlet portion 271, the buffer chamber 258, and the flow channel 273. The air inlet portion 271, the buffer chamber 258, and the flow channel 273 constitute an air introduction portion 275.

Here, a liquid supply portion 274 is provided in the wall 264 of the case 251A. The liquid supply portion 274 protrudes from the wall 264 in the −Z axis direction. The liquid supply portion 274 is in communication with the interior of the tank 210A. Ink stored in the liquid storage portion 257 of the tank 210A is supplied to an ink supply tube 231 (FIG. 36) via the liquid supply portion 274.

As shown in FIG. 39, the sheet member 252A faces the wall 261 while sandwiching the walls 262 to 269 in the Y axis direction. In a plan view in the Y axis direction, the sheet member 252A has a size and shape capable of covering the recessed portion 254 and the recessed portion 255. The sheet member 252A is welded to the joining portion 256 in a state of having a gap of separation from the wall 261. Accordingly, the recessed portion 254 and the recessed portion 255 are sealed by the sheet member 252A. For this reason, the sheet member 252A can also be considered to be a lid for the case 251A.

Figure 40:
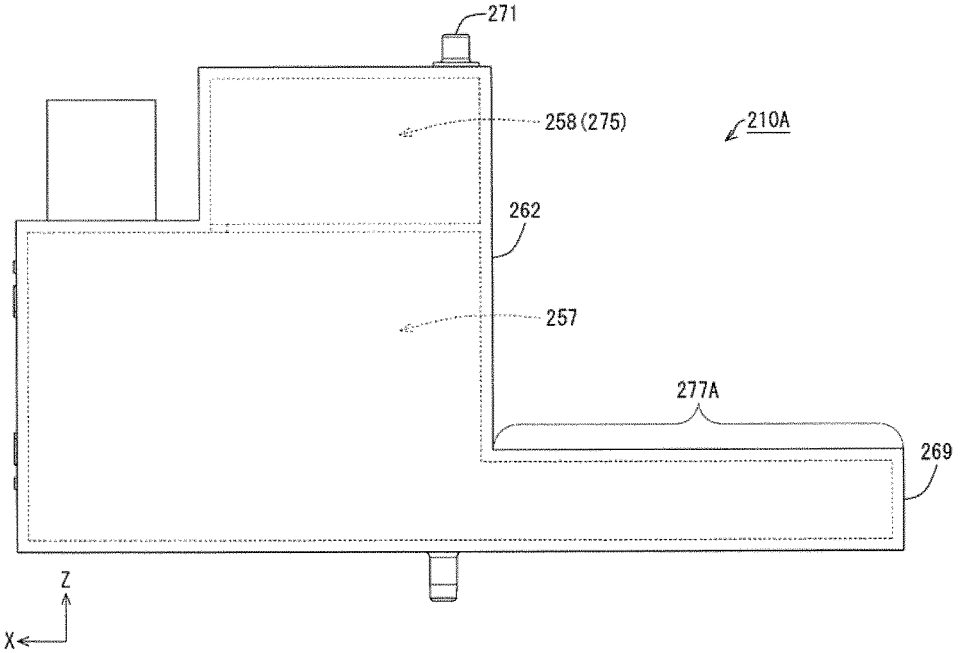
FIG. 40 is a side view of the tank in Working Example 2-1.
Figure 41:
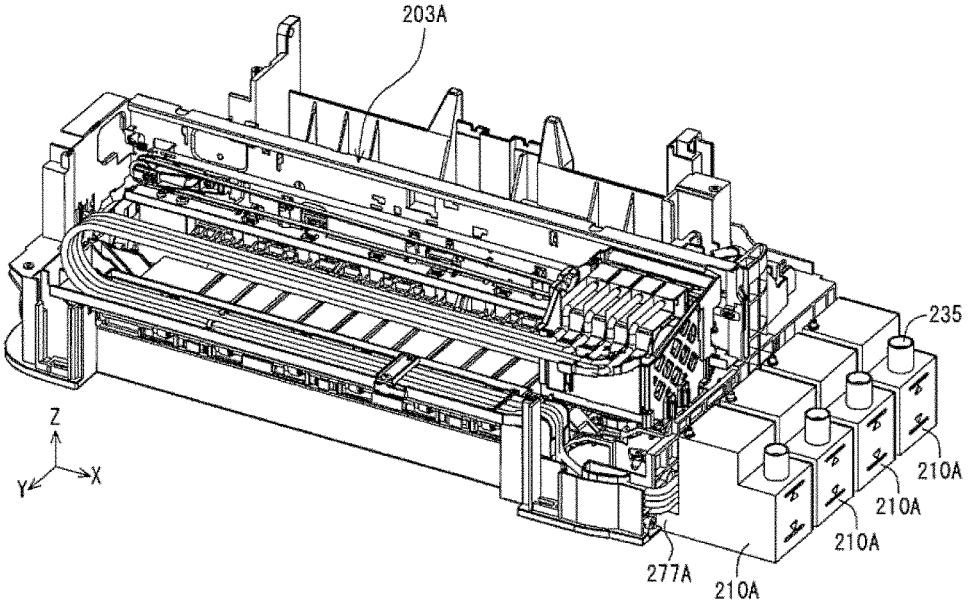
FIG. 41 is a perspective view of a liquid ejection system in which the tank of Working Example 2-1 is mounted.

As shown in FIG. 40, in the tank 210A having the above configuration, a portion of the liquid storage portion 257 protrudes farther in the −X axis direction than the wall 262. Hereinafter, the portion of the tank 210A that protrudes farther in the −X axis direction than the wall 262 will be denoted as a protruding storage portion 277A. In this embodiment, as shown in FIG. 41, the protruding storage portion 277A of the tank 210A is located on the −Z axis direction side of the mechanism unit 203A. Specifically, in a plan view of the mechanism unit 203A of the liquid ejection system 201 in the −Z axis direction when in the in-use orientation, at least a portion of the tank 210A, excluding the liquid injection portion 235, is overlapped with the region of the mechanism unit 203A. In other words, in the in-use orientation, at least a portion of the tank 210A, excluding the liquid injection portion 235, is located vertically below the mechanism unit 203A. According to this configuration, the amount of ink that can be stored in the tank 210A is readily increased while also mitigating an increase in the projected area (footprint) of the mechanism unit 203A and the tank 210A in a plan view. Accordingly, an increase in the size of the liquid ejection system 201 is readily mitigated.

As described above, according to Working Example 2-1, the amount of ink that can be stored in the tank 210 is readily increased while also mitigating an increase in the projected area (footprint) of the liquid ejection system 201 in a plan view. For this reason, it is possible to avoid increasing the amount of ink that can be stored in the tank 210 by extending the tank 210 in the X axis direction or extending the tank 210 in the Y axis direction for example. For example, with a configuration in which the tank 210 is extended in the Y axis direction, it is thought that the tank 210 protrudes farther in the Y axis direction than the mechanism unit 203A in a plan view of the liquid ejection system 201 in the −Z axis direction. According to Working Example 2-1, it is possible to avoid this, and the position of the tank 210 in the Y axis direction can be set farther on the −Y axis direction side than the position of the mechanism unit 203A in the Y axis direction.

Note that in Working Example 2-1, the protruding storage portion 277A is located on the −Z axis direction side of the mechanism unit 203A. However, the protruding storage portion 277A is not limited to this position, and may be located on the Z axis direction side of the mechanism unit 203A, for example. With this configuration, the position of the protruding storage portion 277A in the tank 210 need only be set shifted in the Z axis direction.

Working Example 2-2

Figure 42:
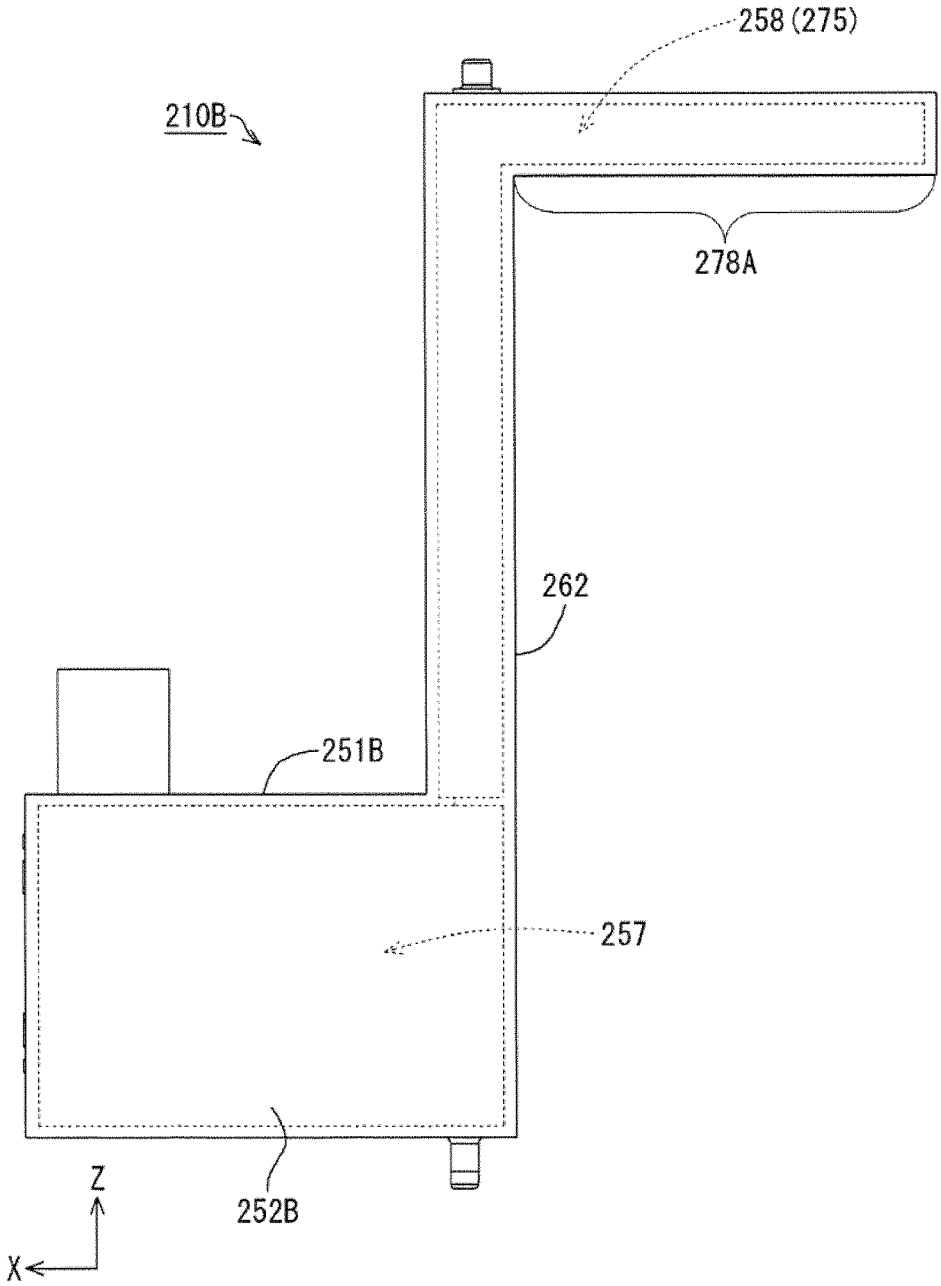
FIG. 42 is a side view of the tank in Working Example 2-2.

In a tank 210B of Working Example 2-2, the protruding storage portion 277A of Working Example 2-1 has been omitted, as shown in FIG. 42. Also, in Working Example 2-2, the air introduction portion 275 protrudes farther in the −X axis direction than the wall 262. In Working Example 2-2, the buffer chamber 258 protrudes farther in the −X axis direction than the wall 262. In other words, in Working Example 2-2, the buffer chamber 258 has been extended in the −X axis direction. Accordingly, in Working Example 2-2, the air introduction portion 275 has been extended. With the exception of the above point, the tank 210B of Working Example 2-2 has the same configuration as the tank 210A of Working Example 2-1. For this reason, in the following, configurations in the tank 210B of Working Example 2-2 that are the same as configurations in Working Example 2-1 will be denoted by the same reference signs as in Working Example 2-1, and will not be described in detail.

Note that the tank 210B has a case 251B and a sheet member 252B. In the tank 210B, the air introduction portion 275 has been extended by changing the shapes and dimensions of the case 251B and the sheet member 252B from those in Working Example 2-1. In the following, the portion of the air introduction portion 275 of the tank 210B that protrudes farther in the −X axis direction than the wall 262 will be referred to as a protruding introduction portion 278A.

Figure 43:
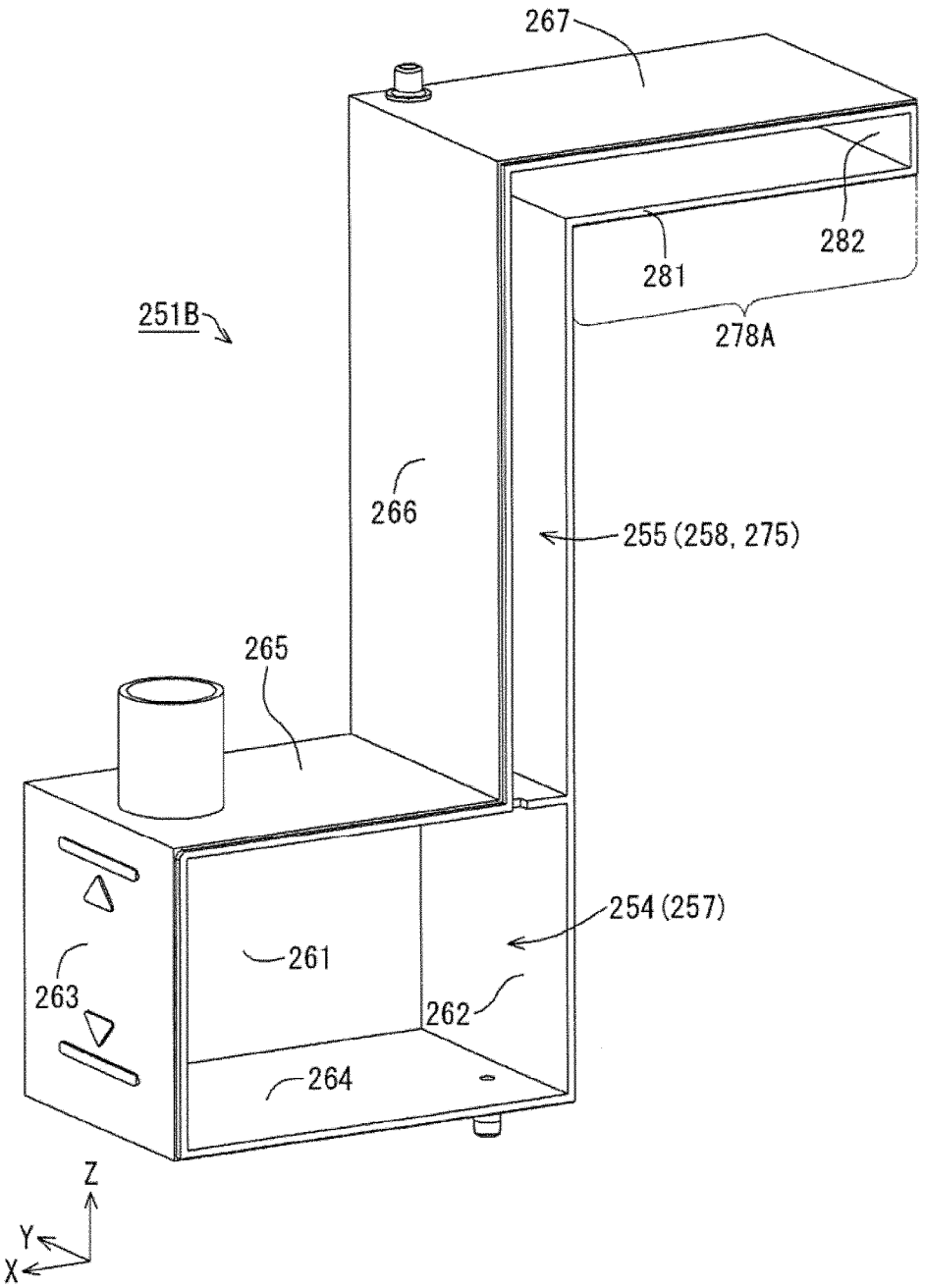
FIG. 43 is a perspective view of a case of the tank in Working Example 2-2.

As shown in FIG. 43, the case 251B has a wall 281 and a wall 282. Note that in Working Example 2-2, the wall 268 and the wall 269 (FIG. 39) of Working Example 2-1 have been omitted. Also, in Working Example 2-2, the end portion, on the −X axis direction side, of the wall 264 intersects the end portion, on the −Z axis direction side, of the wall 262. The wall 281 extends along the XY plane. The wall 282 extends along the YZ plane. The wall 281 is located on the Z axis direction side of the wall 265, and is located on the −Z axis direction side of the wall 267. Also, the wall 282 is located on the −X axis direction side of the wall 262. The end portion, on the X axis direction side, of the wall 281 intersects the end portion, on the Z axis direction side, of the wall 262, and the end portion, on the −X axis direction side, of the wall 281 intersects the end portion, on the −Z axis direction side, of the wall 282.

The end portion, on the Z axis direction side, of the wall 282 intersects the end portion, on the −X axis direction side, of the wall 267. The end portions, on the Y axis direction side, of the wall 281 and the wall 282 intersect the wall 261, and protrude from the wall 261 in the −Y axis direction. In other words, in Working Example 2-2, a portion of the wall 261 protrudes farther in the −X axis direction than the wall 262. Also, a portion of the wall 267 protrudes farther in the −X axis direction than the wall 262. The protruding introduction portion 278A is constituted by a region surrounded by the wall 281, the wall 282, the wall 267, the region of the wall 261 that protrudes farther in the −X axis direction than the wall 262, and the sheet member 252B.

Figure 44:
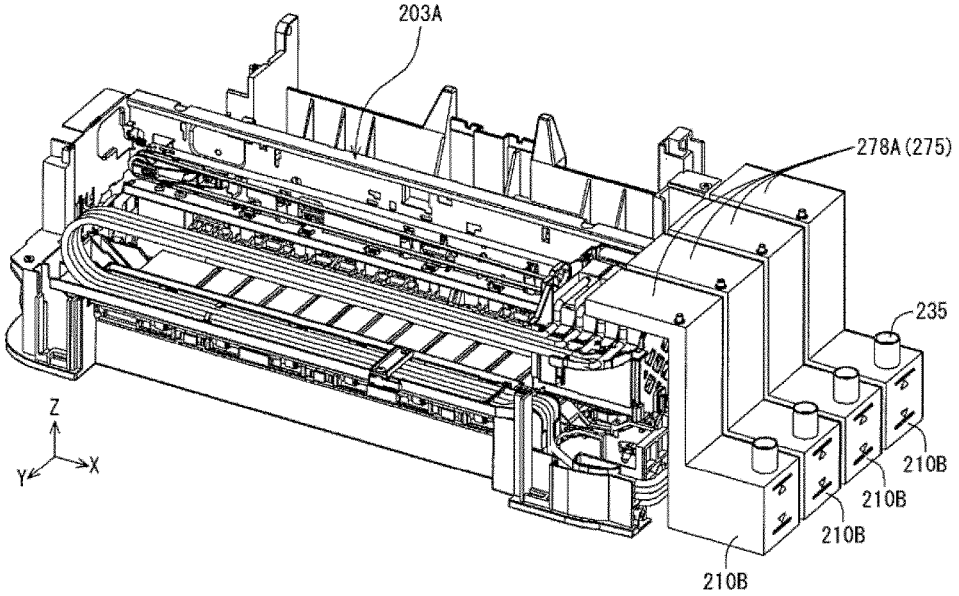
FIG. 44 is a perspective view of a liquid ejection system in which the tank of Working Example 2-2 is mounted.

In this working example, as shown in FIG. 44, the protruding introduction portion 278A of the tank 210B is located on the Z axis direction side of the mechanism unit 203A. Specifically, in a plan view of the mechanism unit 203A of the liquid ejection system 201 in the −Z axis direction when in the in-use orientation, at least a portion of the air introduction portion 275 of the tank 210B is overlapped with the region of the mechanism unit 203A. In other words, in the in-use orientation, at least a portion of the air introduction portion 275 of the tank 210B is located vertically above the mechanism unit 203A.

According to this configuration, the amount of ink that can be stored in the buffer chamber 258 (FIG. 42) of the tank 210B is readily increased while also mitigating an increase in the projected area (footprint) of the mechanism unit 203A and the tank 210B in a plan view. Accordingly, ink that has flowed in reverse through the air introduction portion 275 from the liquid storage portion 257 (FIG. 42) is more readily stored. Accordingly, an increase in the size of the liquid ejection system 201 is readily mitigated, and the leakage of ink in the liquid storage portion 257 out through the air inlet portion 271 is readily avoided.

According to Working Example 2-2, the amount of ink that can be stored in the buffer chamber 258 of the tank 210 is readily increased while also mitigating an increase in the projected area (footprint) of the liquid ejection system 201 in a plan view. For this reason, it is possible to avoid increasing the amount of ink that can be stored in the buffer chamber 258 of the tank 210 by extending the tank 210 in the X axis direction or extending the tank 210 in the Y axis direction for example. For example, with a configuration in which the tank 210 is extended in the Y axis direction, it is thought that the tank 210 protrudes farther in the Y axis direction than the mechanism unit 203A in a plan view of the liquid ejection system 201 in the −Z axis direction. According to Working Example 2-2, it is possible to avoid this, and the position of the tank 210 in the Y axis direction can be set farther on the −Y axis direction side than the position of the mechanism unit 203A in the Y axis direction.

Note that in Working Example 2-2, the protruding introduction portion 278A is located on the Z axis direction side of the mechanism unit 203A. However, the protruding introduction portion 278A is not limited to this position, and may be located on the −Z axis direction side of the mechanism unit 203A, for example. With this configuration, the position of the protruding introduction portion 278A in the tank 210 need only be set shifted in the −Z axis direction.

Working Example 2-3

Figure 45:
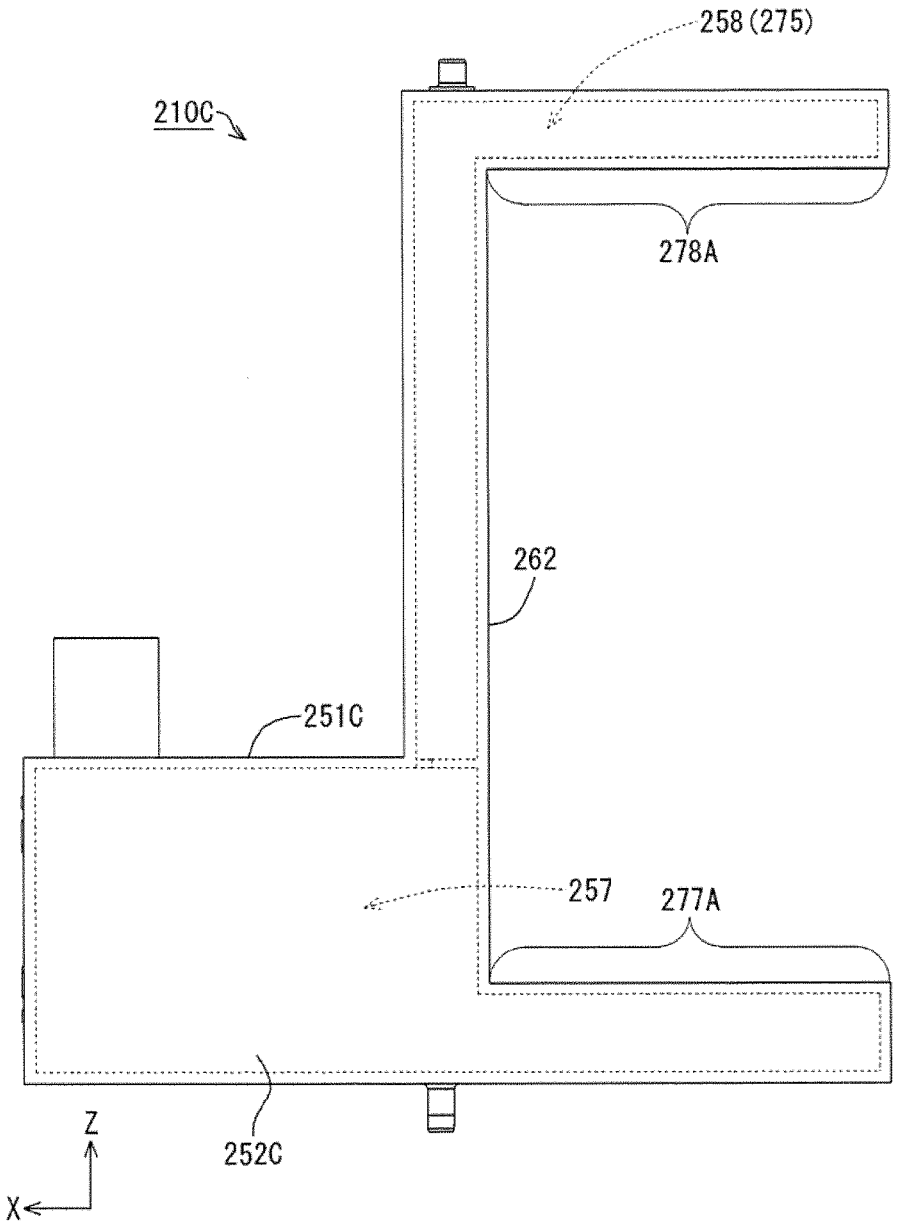
FIG. 45 is a side view of the tank in Working Example 2-3.

As shown in FIG. 45, a tank 210C of Working Example 2-3 has a protruding storage portion 277A and a protruding introduction portion 278A. In other words, the tank 210C has a configuration in which the protruding storage portion 277A of Working Example 2-1 has been added to the tank 210B of Working Example 2-2. With the exception of the above point, the tank 210C of Working Example 2-3 has the same configuration as in Working Example 2-1 and Working Example 2-2. For this reason, in the following, configurations in the tank 210C of Working Example 2-3 that are the same as configurations in Working Example 2-1 and Working Example 2-2 will be denoted by the same reference signs as in Working Example 2-1 and Working Example 2-2, and will not be described in detail.

Note that the tank 210C has a case 251C and a sheet member 252C. In the tank 210C, the protruding storage portion 277A is added by changing the shapes and dimensions of the case 251C and the sheet member 252C from those in Working Example 2-2.

Figure 46:
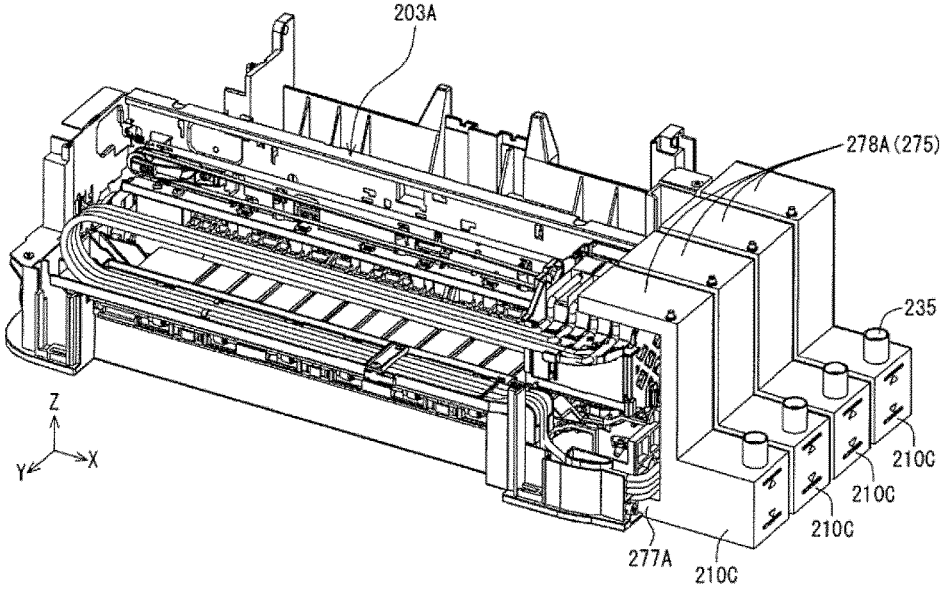
FIG. 46 is a perspective view of a liquid ejection system in which the tank of Working Example 2-3 is mounted.

In this embodiment, as shown in FIG. 46, the protruding storage portion 277A of the tank 210C is located on the −Z axis direction side of the mechanism unit 203A. Specifically, in a plan view of the mechanism unit 203A of the liquid ejection system 201 in the −Z axis direction when in the in-use orientation, at least a portion of the tank 210C, excluding the liquid injection portion 235, is overlapped with the region of the mechanism unit 203A. In other words, in the in-use orientation, at least a portion of the tank 210C, excluding the liquid injection portion 235, is located vertically below the mechanism unit 203A.

Also, in this working example, the protruding introduction portion 278A of the tank 210C is located on the Z axis direction side of the mechanism unit 203A. Specifically, in a plan view of the mechanism unit 203A of the liquid ejection system 201 in the −Z axis direction when in the in-use orientation, at least a portion of the air introduction portion 275 of the tank 210C is overlapped with the region of the mechanism unit 203A. In other words, in the in-use orientation, at least a portion of the air introduction portion 275 of the tank 210C is located vertically above the mechanism unit 203A. The same effects as in Working Example 2-1 and Working Example 2-2 are obtained in Working Example 2-3 as well.

In Working Examples 2-1 to 2-3, any amount of protrusion can be employed as the amount of protrusion of the protruding storage portion 277A and the protruding introduction portion 278A from the wall 262. In Working Examples 2-1 to 2-3, the amount of protrusion of the protruding storage portion 277A and the protruding introduction portion 278A from the wall 262 is set the same in the four tanks 210. However, in these working examples, a configuration is possible in which the amount of protrusion of the protruding storage portion 277A and the protruding introduction portion 278A from the wall 262 is set differently in the four tanks 210. According to this configuration, in the case where it is difficult for the same amount of space for accommodating the protruding storage portion 277A and the protruding introduction portion 278A in the mechanism unit 203A to be ensured for the four tanks 210 for example, the amount of protrusion of the protruding storage portion 277A and the protruding introduction portion 278A can be changed among the four tanks 210. This idea can also be applied to the first embodiment described above.

In Working Examples 2-1 to 2-3, it is preferable that the volume of the region including the buffer chamber 258 and the flow channel 273 in the air introduction portion 275 is equivalent to the volume of the liquid storage portion 257, or greater than the volume of the liquid storage portion 257. According to this configuration, even if ink in the liquid storage portion 257 flows into the air introduction portion 275 for example, the flowing ink can be stored in the air introduction portion 275, thus more readily avoiding the leakage of ink from the liquid storage portion 257 to the outside of the tank 210 via the air introduction portion 275.

In Working Examples 2-1 to 2-3, the air introduction portion 275 is constituted as a portion of the tank 210. For this reason, the air introduction portion 275 is integrated with the tank 210. However, the configuration of the air introduction portion 275 is not limited to these examples. A configuration is possible in which at least a portion of the air introduction portion 275 can be separated from the tank 210. An example in which a portion of the air introduction portion 275 can be separated from the tank 210 will be described below as Working Example 2-4.

Working Example 2-4

Figure 47:
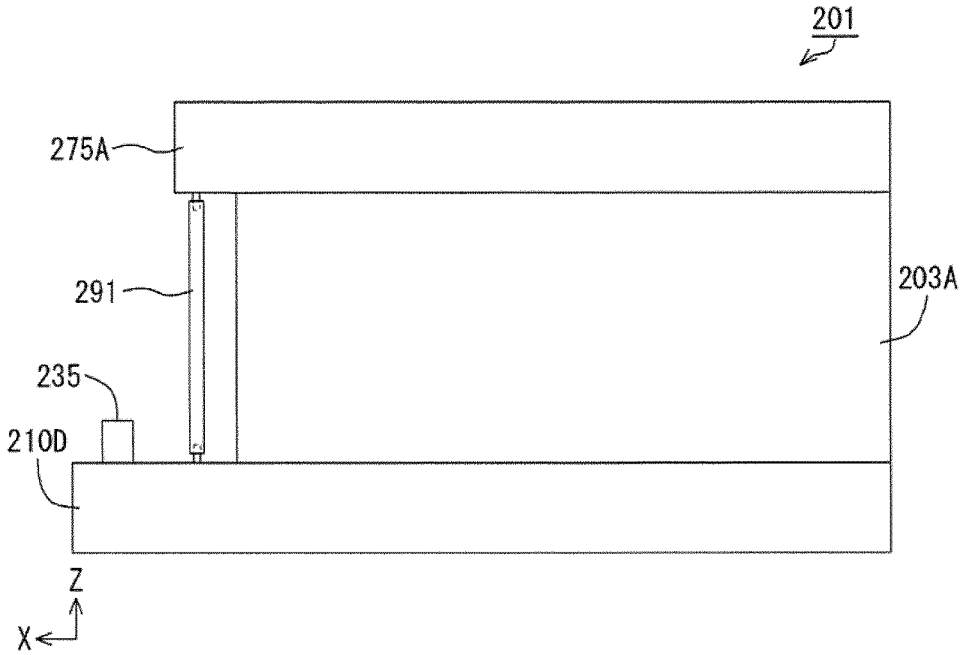
FIG. 47 is a side view schematically showing a liquid ejection system in which an air introduction portion and a tank of Working Example 2-4 are installed.

In Working Example 2-4, the tank 210D and the air introduction portion 275A are configured as separate bodies as shown in FIG. 47, which is a side view schematically showing the liquid ejection system 201. In the in-use orientation of the liquid ejection system 201, a portion of the tank 210D excluding the liquid injection portion 235 is overlapped with the region of the mechanism unit 203A. In the example shown in FIG. 47, a portion of the tank 210D excluding the liquid injection portion 235 is located vertically below the mechanism unit 203A.

The air introduction portion 275A is located on the Z axis direction side of the mechanism unit 203A. At least a portion of the air introduction portion 275A is overlapped with the region of the mechanism unit 203A. In the example shown in FIG. 47, a portion of the air introduction portion 275A is located vertically above the mechanism unit 203A. The liquid storage portion 257 of the tank 210D and the air introduction portion 275A are connected via the connection portion 291. In other words, the liquid storage portion 257 of the tank 210D and the air introduction portion 275A are in communication via the connection portion 291. Accordingly, air can be introduced into the liquid storage portion 257 of the tank 210D via the air introduction portion 275A and the connection portion 291.

In this working example, the connection portion 291 is located outside of the mechanism unit 203A. Accordingly, the connection portion 291 can be arranged outside of the path along which the relative positions of the recording head and the recording medium P change. Accordingly, it is possible to avoid the case where the connection portion 291 hinders change in the relative positions of the recording head and the recording medium P. Note that the connection portion 291 is not limited to being arranged outside of the mechanism unit 203A. The arrangement of the connection portion 291 may involve the inside of the mechanism unit 203A as long as the connection portion 291 is outside of the path along which the relative positions of the recording head and the recording medium P change.

In this working example, the tank 210D and the air introduction portion 275A can be separated from each other by disconnecting the connection between the tank 210D and the air introduction portion 275A by the connection portion 291. According to this configuration, it is possible to add the air introduction portion 275 to the tank 210 or extend the air introduction portion 275. Also, the tank 210D and the air introduction portion 275A are connected via the connection portion 291, thus making it possible to easily change the position of the air introduction portion 275A relative to the tank 210D. Accordingly, it is possible to raise the degree of freedom regarding the position of the air introduction portion 275A relative to the tank 210D.

Also, by employing a flexible tube as the connection portion 291, it is possible to raise the degree of freedom regarding the piping route of the connection portion 291. Accordingly, it is possible to facilitate arrangement in a narrow space between the mechanism unit 203A and the casing 206 of the liquid ejection system 201, a narrow space inside the mechanism unit 203A, and the like.

Figure 48:
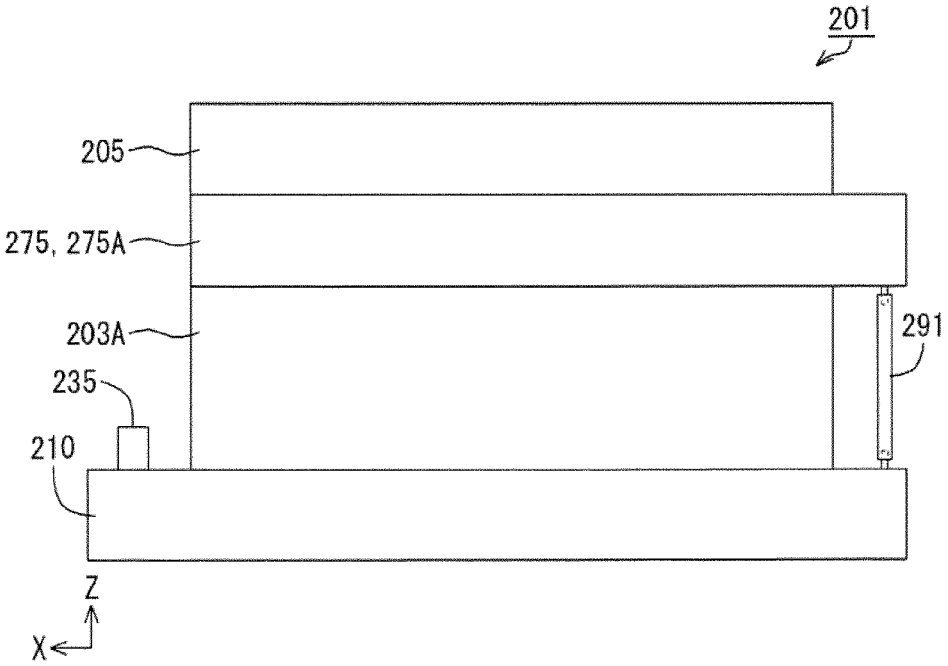
FIG. 48 is a side view schematically showing an example of another configuration of the liquid ejection system of the second embodiment.

In Working Examples 2-1 to 2-4 of the second embodiment, a configuration is possible in which portions of the air introduction portion 275 and the air introduction portion 275A that are located on the Z axis direction side of the mechanism unit 203A are located on the −Z axis direction side of the scanner unit 205 as shown in FIG. 48. With this configuration, in the in-use orientation of the liquid ejection system 201, the portions of the air introduction portion 275 and the air introduction portion 275A that are overlapped with the region of the mechanism unit 203A are located vertically below the scanner unit 205. According to this configuration, an increase in the projected area (footprint) of the scanner unit 205, the air introduction portion 275, the air introduction portion 275A, and the mechanism unit 203A in a plan view is readily mitigated.

Figure 49:
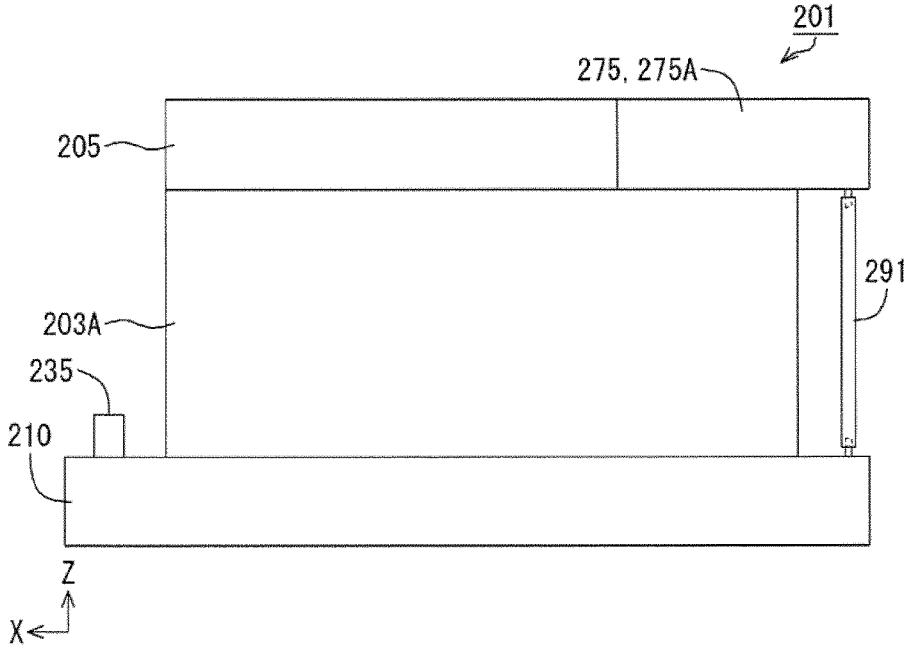
FIG. 49 is a side view schematically showing an example of yet another configuration of the liquid ejection system of the second embodiment.

In Working Examples 2-2 to 2-4 of the second embodiment, a configuration is possible in which portions of the air introduction portion 275 and the air introduction portion 275A that are located on the Z axis direction side of the mechanism unit 203A are located to one side of the scanner unit 205 as shown in FIG. 49. With this configuration, in the in-use orientation of the liquid ejection system 201, the portions of the air introduction portion 275 and the air introduction portion 275A that are overlapped with the region of the mechanism unit 203A are located to one side of the scanner unit 205. According to this configuration, an increase in the thickness of the liquid ejection system 201 is readily mitigated. Accordingly, an increase in the size of the liquid ejection system 201 is readily mitigated.

In the above embodiments, the liquid ejection device may be a liquid ejection device that consumes a liquid other than ink by ejecting, discharging, or applying the liquid. Note that the states of liquid discharged as very small droplets from the liquid ejection device includes a granular shape, a tear-drop shape, and a shape having a thread-like trailing end. Furthermore, the liquid mentioned here may be any kind of material that can be consumed by the liquid ejection device. For example, the liquid need only be a material whose substance is in the liquid phase, and includes fluids such as an inorganic solvent, an organic solvent, a solution, a liquid resin, and a liquid metal (metal melt) in the form of a liquid body having a high or low viscosity, a sol, gel water, or the like. Furthermore, the liquid is not limited to being a one-state substance, and also includes particles of a functional material made from solid matter, such as pigment or metal particles, that are dissolved, dispersed, or mixed in a solvent. Representative examples of the liquid include ink such as that described in the above embodiments, liquid crystal, or the like. Here, "ink" encompasses general water-based ink and oil-based ink, as well as various types of liquid compositions such as gel ink and hot melt-ink. Moreover, sublimation transfer ink can be used as the ink. Sublimation transfer ink is ink that includes a sublimation color material such as a sublimation dye. One example of a printing method is a method in which sublimation transfer ink is ejected onto a transfer medium by a liquid ejection device, a printing target is brought into contact with the transfer medium and heated to cause the color material to sublimate and be transferred to the printing target. The printing target is a T-shirt, a smartphone, or the like. In this way, if the ink includes a sublimation color material, printing can be performed on a diverse range of printing targets (printing media). Specific examples of the liquid ejection device include a liquid ejection device that ejects liquid including a material, such as an electrode material or a color material that is used for manufacturing a liquid crystal display, an EL (electro-luminescence) display, a surface emission display, or a color filter, for example, in the form of being dispersed or dissolved. The liquid ejection device may also be a liquid ejection device that ejects biological organic matter used in manufacturing of a biochip, a liquid ejection device that is used as a precision pipette and ejects a liquid serving as a sample, a textile printing apparatus, a microdispenser, or the like. Furthermore, the liquid ejection device may be a liquid ejection device that ejects lubricating oil in a pinpoint manner to a precision machine such as a watch or a camera, or a liquid ejection device that ejects, onto a substrate, transparent resin liquid such as UV-cured resin for forming, for example, a micro-hemispherical lens (optical lens) that is used in an optical communication element or the like. The liquid ejection device may also be a liquid ejection device that ejects acid or alkaline etchant, for example, for etching substrates or the like.

Note that the invention is not limited to the above embodiments and working examples, and can be achieved as various configurations without departing from the gist of the invention. For example, the technical features in the embodiments and working examples that correspond to the technical features in the modes described in the summary of the invention may be replaced or combined as appropriate in order to solve a part of, or the entire foregoing problem, or to achieve some or all of the above-described effects. The technical features that are not described as essential in the specification may be deleted as appropriate.

What is claimed is:

1. A liquid ejection system capable of ejecting a liquid toward a targeted medium, the liquid ejection system comprising:

a mechanism unit that includes a liquid ejection head configured to eject the liquid, and to change a relative position of the medium relative to the liquid ejection head;

a liquid storage container comprising a liquid storage portion configured to store the liquid that is to be supplied to the liquid ejection head; and an air introduction portion that is in communication with the liquid storage portion and is configured to introduce air into the liquid storage portion, wherein a liquid injection portion configured to enable injection of the liquid into the liquid storage portion is provided in the liquid storage container, in an orientation in which the liquid injection portion faces a direction upward relative to a horizontal direction, in a plan view of the mechanism unit from vertically above, at least a portion of the liquid storage container excluding the liquid injection portion is overlapped with at least a first portion of the mechanism unit, the portion of the liquid storage container that is overlapped with the first portion of the mechanism unit is located vertically below the first portion of the mechanism unit, in the orientation in which the liquid injection portion faces a direction upward relative to the horizontal direction, in a plan view of the mechanism unit from vertically above, at least a portion of the air introduction portion is overlapped with at least a second portion of the mechanism unit, and the portion of the air introduction portion that is overlapped with the second portion of the mechanism unit is located vertically above the mechanism unit.

2. The liquid ejection system according to claim 1, wherein a volume of the air introduction portion is equivalent to a volume of the liquid storage portion, or is greater than the volume of the liquid storage portion.

3. The liquid ejection system according to claim 1, wherein the air introduction portion is configured to be able to be separated from the liquid storage container.

4. The liquid ejection system according to claim 3, wherein the air introduction portion and the liquid storage container are connected by a connection portion.

5. The liquid ejection system according to claim 4, wherein the connection portion is a tube.

6. The liquid ejection system according to claim 4, wherein the connection portion is located outside of a path along which relative positions of the liquid ejection head and the medium change.

7. The liquid ejection system according to claim 4, wherein the connection portion is located outside of the mechanism unit.

8. The liquid ejection system according to claim 1, further comprising a scanner unit configured to read an image, wherein in the orientation in which the liquid injection portion faces a direction upward relative to the horizontal direction, the scanner unit is located vertically above at least a third portion of the mechanism unit, and is arranged at a position that is overlapped with the third portion of the mechanism unit in a plan view of the mechanism unit from vertically above, and in the orientation in which the liquid injection portion faces a direction upward relative to the horizontal direction, the portion of the air introduction portion that is overlapped with the second portion of the mechanism unit is located vertically below the scanner unit.

9. The liquid ejection system according to claim 1, further comprising a scanner unit capable of reading an image, wherein in the orientation in which the liquid injection portion faces a direction upward relative to the horizontal direction, the scanner unit is located vertically above the mechanism unit, and is arranged at a position that is overlapped with the mechanism unit in a plan view of the mechanism unit from vertically above, and in the orientation in which the liquid injection portion faces a direction upward relative to the horizontal direction, the portion of the air introduction portion that is overlapped with the region of the mechanism unit is located to one side of the scanner unit.

10. The liquid ejection system according to claim 1, wherein the at least a portion of the liquid storage container faces the at least a portion of the air introduction portion.

* * * * *